US010441840B2

(12) United States Patent
Dalebout

(10) Patent No.: US 10,441,840 B2
(45) Date of Patent: Oct. 15, 2019

(54) COLLAPSIBLE STRENGTH EXERCISE MACHINE

(71) Applicant: ICON Health & Fitness, Inc., Logan, UT (US)

(72) Inventor: William T. Dalebout, North Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 86 days.

(21) Appl. No.: 15/460,984

(22) Filed: Mar. 16, 2017

(65) Prior Publication Data

US 2017/0266481 A1 Sep. 21, 2017

Related U.S. Application Data

(60) Provisional application No. 62/310,467, filed on Mar. 18, 2016.

(51) Int. Cl.

| | |
|---|---|
| ***A63B 21/00*** | (2006.01) |
| ***A63B 21/055*** | (2006.01) |
| ***A63B 21/22*** | (2006.01) |
| ***A63B 23/12*** | (2006.01) |
| *A63B 21/005* | (2006.01) |
| *A63B 71/02* | (2006.01) |
| *A63B 71/06* | (2006.01) |

(52) U.S. Cl.

CPC ..... *A63B 21/154* (2013.01); *A63B 21/0552* (2013.01); *A63B 21/4035* (2015.10); *A63B 21/4043* (2015.10); *A63B 21/0051* (2013.01); *A63B 21/225* (2013.01); *A63B 23/1209* (2013.01); *A63B 2071/027* (2013.01); *A63B 2071/065* (2013.01); *A63B 2071/0625* (2013.01); *A63B 2071/0655* (2013.01); *A63B 2071/0694* (2013.01); *A63B 2210/50* (2013.01); *A63B 2220/13* (2013.01); *A63B 2225/09* (2013.01); *A63B 2230/75* (2013.01)

(58) Field of Classification Search

CPC .... A63B 21/062–0632; A63B 2210/50; A63B 22/0076; A63B 2022/0079–0084; A63B 2210/00; A63B 22/02–0292; A63B 23/12

See application file for complete search history.

(56) References Cited

U.S. PATENT DOCUMENTS

| | | | |
|---|---|---|---|
| 9,595 | A | 2/1853 | Moreland |
| 9,695 | A | 5/1853 | Hinsdale |
| 34,577 | A | 3/1862 | Jabden |
| 104,973 | A | 7/1870 | Man |
| 115,826 | A | 6/1871 | Creed |

(Continued)

*Primary Examiner* — Nyca T Nguyen

(74) *Attorney, Agent, or Firm* — Ray Quinney & Nebeker

(57) ABSTRACT

An exercise machine includes a standing platform, a pivot connection incorporated into the standing platform, an upright structure attached to the standing platform at the pivot connection, and a movable element connected to the upright structure where the movable element is movable during the performance of an exercise. The upright structure is rotated about the pivot connection in a transverse orientation to the standing platform when the exercise machine is in an operational mode and the upright structure is rotated about the pivot connection in an aligned orientation with the standing platform when the exercise machine is in a storage mode.

19 Claims, 7 Drawing Sheets

(56) References Cited

U.S. PATENT DOCUMENTS 192,338 A 6/1877 Marshall
232,022 A 9/1880 Gifford
232,579 A 9/1880 Weeks
248,121 A 10/1881 Tuttle
321,388 A 6/1885 Ruebsam
325,435 A 9/1885 North
337,942 A 3/1886 Parley
353,089 A 11/1886 Smith
356,219 A 1/1887 Yeoman
359,778 A 3/1887 Pauber
372,272 A 10/1887 Murphy
374,496 A 12/1887 Reach
428,912 A 5/1890 Holmes
457,400 A 8/1891 Dowd
480,271 A 8/1892 Newton
484,352 A 10/1892 Ayton
588,350 A 8/1897 Perkins
603,350 A 5/1898 Towers
610,716 A 9/1898 Marshal
624,995 A 5/1899 Tellefsen
679,784 A 8/1901 Ryan
680,556 A 8/1901 Wray
682,988 A 9/1901 Carroll
685,788 A 11/1901 Mcfadden
689,418 A 12/1901 Ryan
722,462 A 3/1903 Smith
723,625 A 3/1903 Thonrley
754,992 A 3/1904 Grabner
760,374 A 5/1904 Belvoir
761,504 A 5/1904 Kleinbach
772,906 A 10/1904 Splading
776,824 A 12/1904 Reach
807,670 A 12/1905 Grabner
846,389 A 3/1907 Blackburn
852,193 A 4/1907 Mcmillan
943,127 A 12/1909 Van Boven
964,745 A 7/1910 Blakoe
979,609 A 12/1910 Vaughn
1,019,861 A 3/1912 Titus
1,082,940 A 12/1913 Smith
1,115,826 A 11/1914 Johnson
1,123,272 A 1/1915 Goodman
1,144,085 A 6/1915 Abplanalp
1,316,683 A 9/1919 Calvert
1,422,888 A 7/1922 Reeves
1,495,278 A 5/1924 Titus
1,539,214 A 5/1925 Shockey
1,576,474 A 3/1926 Walker
1,585,748 A 5/1926 Wendelken
1,672,944 A 6/1928 Jowett
1,698,831 A 1/1929 Titus
1,851,843 A 3/1932 Inman
1,917,566 A 7/1933 Wood
1,928,089 A 9/1933 Blickman
1,982,843 A 12/1934 Traver
1,982,872 A 12/1934 Newton
1,991,520 A 2/1935 Postl
2,129,262 A 9/1938 Rex
2,145,940 A 2/1939 Marlowe
2,153,077 A 4/1939 Clarke
2,183,345 A 12/1939 Brandon
2,209,034 A 7/1940 Rene
2,219,219 A 10/1940 Boger
2,274,574 A 2/1942 Zerne
2,315,485 A 4/1943 Jones Le Roy
2,346,105 A 4/1944 Haehnel
2,379,984 A 7/1945 Nereaux
2,436,987 A 3/1948 Bailleaux
2,438,548 A 3/1948 Ehmann
2,456,017 A 12/1948 Park
2,470,544 A 5/1949 Bell
2,472,391 A 6/1949 Albizu
2,500,299 A 3/1950 Spitzkeit
2,512,417 A 6/1950 Polite
2,573,351 A 10/1951 Motis
2,632,645 A 3/1953 Barkschat
2,637,319 A 5/1953 Bruene
2,640,696 A 6/1953 Lemieux
2,641,250 A 6/1953 Brockman
2,642,288 A 6/1953 Bell
2,646,282 A 7/1953 Ringman
2,648,540 A 8/1953 Hunter
2,654,135 A 10/1953 Grizzard et al.
2,695,797 A 11/1954 Mccarthy et al.
2,714,507 A 8/1955 Goodrich
2,740,178 A 4/1956 Kellems
2,763,156 A 9/1956 Garigal
2,843,858 A 7/1958 Bjorklund
2,855,200 A 10/1958 Blickman
2,924,456 A 2/1960 Miller
2,927,006 A 3/1960 Brooks
2,938,695 A 5/1960 Ciampa
2,968,337 A 1/1961 Bartlett
2,969,060 A 1/1961 Swanda
2,977,120 A 3/1961 Morris
2,978,830 A 4/1961 Killian
2,985,933 A 5/1961 Peterson et al.
3,000,628 A 9/1961 Kellogg
3,057,201 A 10/1962 Erich
3,068,002 A 12/1962 Balne
3,090,092 A 5/1963 Szemplak
3,099,509 A 7/1963 Duenke
3,115,332 A 12/1963 Singleton
3,118,441 A 1/1964 Prosser
3,161,395 A 12/1964 Carter
3,193,287 A 7/1965 Robinson
3,194,598 A 7/1965 Goldfuss
3,205,888 A 9/1965 Stroop
3,246,894 A 4/1966 Salisbury
3,256,630 A 6/1966 Spector
3,270,494 A 9/1966 Holmes
3,312,466 A 4/1967 Melchiona
3,323,367 A 6/1967 Searle
3,342,485 A 9/1967 Martin
3,345,067 A 10/1967 Smith
3,349,621 A 10/1967 Mullen
3,370,584 A 2/1968 William
3,373,993 A 3/1968 Oja et al.
3,380,737 A 4/1968 Petros
3,381,958 A 5/1968 Gulland
3,384,370 A 5/1968 Eugene et al.
3,390,460 A 7/1968 Brown
3,411,776 A 11/1968 Holkesvick et al.
3,428,311 A 2/1969 Mitchell
3,428,312 A 2/1969 Machen
3,432,164 A 3/1969 Deeks
3,438,627 A 4/1969 La Lanne
3,446,503 A 5/1969 Lawton
3,456,592 A 7/1969 Nelson
3,465,592 A 9/1969 Perrine
3,482,835 A 12/1969 Dean
3,488,051 A 1/1970 Scherer
3,495,824 A 2/1970 Cuinier
3,501,140 A 3/1970 Eichorn
3,511,500 A 5/1970 Dunn
3,540,724 A 11/1970 Hunter
3,563,541 A 2/1971 Sanquist
3,566,861 A 3/1971 Beacon Enterprises Inc
3,567,219 A 3/1971 Foster
3,572,700 A 3/1971 Mastropaolo
3,588,101 A 6/1971 Jungreis
3,589,193 A 6/1971 Thornton
3,589,720 A 6/1971 Agamian
3,598,404 A 8/1971 Bowman
3,601,398 A 8/1971 Brochman
3,606,406 A 9/1971 Keystone Consolidated Ind Inc
3,614,097 A 10/1971 Blickman
3,614,108 A 10/1971 Garten
3,617,056 A 11/1971 Herbold
3,638,941 A 2/1972 Kulkens
3,640,528 A 2/1972 Proctor
3,640,530 A 2/1972 Henson et al.
3,643,943 A 2/1972 Erwin, Jr. et al.
3,647,209 A 3/1972 La Lanne

(56) References Cited

U.S. PATENT DOCUMENTS 3,652,085 A 3/1972 Civalier
3,658,327 A 4/1972 Thiede
3,659,845 A 5/1972 Quinton
3,664,910 A 5/1972 Hollie
3,664,916 A 5/1972 Rhodiaceta
3,672,124 A 6/1972 Pirotta
3,679,244 A 7/1972 Reddy
3,690,655 A 9/1972 Chapman
3,708,166 A 1/1973 Paramount Health Equip Corp
3,708,167 A 1/1973 Potgieter
3,758,109 A 9/1973 Bender
3,759,511 A 9/1973 Zinkin
3,761,083 A 9/1973 Buchner
3,767,195 A 10/1973 Dimick
3,771,785 A 11/1973 Speyer
3,784,193 A 1/1974 Simjian
3,789,467 A 2/1974 Aratani et al.
3,792,860 A 2/1974 Seines
3,797,624 A 3/1974 Powell et al.
3,802,701 A 4/1974 Good
3,807,728 A 4/1974 Chillier
3,809,393 A 5/1974 Jones
3,814,420 A 6/1974 Encke
3,815,903 A 6/1974 Blomqvist
3,822,599 A 7/1974 Brentham
3,825,253 A 7/1974 Speyer
3,831,942 A 8/1974 Del Mar
3,833,216 A 9/1974 Philbin
3,834,696 A 9/1974 Spector
3,840,227 A 10/1974 Chesemore
3,848,467 A 11/1974 Flavell
3,851,874 A 12/1974 Wilkin
3,858,873 A 1/1975 Jones
3,858,874 A 1/1975 Weider
3,870,297 A 3/1975 Elder
3,874,375 A 4/1975 Penner
3,874,657 A 4/1975 Niebojewski
3,884,464 A 5/1975 Evangelos
3,891,207 A 6/1975 Helliwell
3,892,404 A 7/1975 Martucci
3,902,480 A 9/1975 Wilson
3,902,717 A 9/1975 Kulkens
3,913,908 A 10/1975 Speyer
3,918,710 A 11/1975 Niebojewski
3,920,240 A 11/1975 Ross
3,926,430 A 12/1975 Good, Jr.
3,938,803 A 2/1976 Wilmoth
3,953,025 A 4/1976 Mazman
3,957,266 A 5/1976 Rice
3,958,803 A 5/1976 Geisselbrecht
3,971,555 A 7/1976 Mahnke
3,976,058 A 8/1976 Tidwell
3,979,931 A 9/1976 Man
3,981,500 A 9/1976 Ryan
3,984,666 A 10/1976 Barron
3,998,454 A 12/1976 Jones
4,004,801 A 1/1977 Campanaro
4,026,545 A 5/1977 Schonenberger
4,026,548 A 5/1977 Birdwell
4,029,312 A 6/1977 Wright
4,042,305 A 8/1977 Vincent
4,043,552 A 8/1977 Kerkonian
4,059,265 A 11/1977 Wieder et al.
4,060,240 A 11/1977 Dunston
4,061,257 A 12/1977 St. Clair
4,063,727 A 12/1977 Hall
4,066,868 A 1/1978 Witkin et al.
4,071,235 A 1/1978 Zent
4,072,309 A 2/1978 Wilson
4,073,490 A 2/1978 Feather
4,074,409 A 2/1978 Smith
4,074,519 A 2/1978 Garrett
4,076,236 A 2/1978 Ionel
4,076,237 A 2/1978 Dussia
4,082,267 A 4/1978 Flavell
4,093,211 A 6/1978 Hughes et al.
4,098,100 A 7/1978 Wah
4,101,124 A 7/1978 Mahnke
4,122,585 A 10/1978 Sharp et al.
4,131,701 A 12/1978 VanAuken
4,140,312 A 2/1979 Buchmann
4,154,441 A 5/1979 Gajda
4,157,181 A 6/1979 Cecka
4,157,594 A 6/1979 Raabe
4,170,351 A 10/1979 Ozbey
4,171,805 A 10/1979 Abbott
4,176,836 A 12/1979 Coyle
4,188,030 A 2/1980 Hooper
4,193,630 A 3/1980 Steele
4,198,044 A 4/1980 Holappa
4,199,139 A 4/1980 Mahnke
4,200,279 A 4/1980 Lambert, Jr.
4,200,280 A 4/1980 Goodwin
4,204,673 A 5/1980 Speer, Sr.
4,207,879 A 6/1980 Safadago
4,208,049 A 6/1980 Wilson
4,227,689 A 10/1980 Keiser
4,231,568 A 11/1980 Riley
4,231,569 A 11/1980 Rae
4,239,092 A 12/1980 Janson
4,241,915 A 12/1980 Noble
4,249,773 A 2/1981 Giambalvo
4,252,314 A 2/1981 Ceppo
4,253,662 A 3/1981 Podolak
4,256,302 A 3/1981 Keiser et al.
4,257,590 A 3/1981 Sullivan et al.
4,258,913 A 3/1981 Brentham
4,263,897 A 4/1981 Terayama
4,274,625 A 6/1981 Gaetano
4,275,882 A 6/1981 Grosser et al.
4,278,249 A 7/1981 Forrest
4,286,782 A 9/1981 Fuhrhop
4,296,924 A 10/1981 Anzaldua et al.
4,300,760 A 11/1981 Bobroff
4,300,761 A 11/1981 Howard
4,307,880 A 12/1981 Abram
4,316,609 A 2/1982 Silberman
4,316,610 A 2/1982 Hinds
4,325,548 A 4/1982 Piccini
4,327,713 A 5/1982 Okazaki et al.
4,328,964 A 5/1982 Walls
4,328,965 A 5/1982 Hatfield
4,328,968 A 5/1982 Hacker
4,334,678 A 6/1982 Doyel
4,345,756 A 8/1982 Hoagland
4,346,888 A 8/1982 Szabo
4,349,192 A 9/1982 Lambert, Jr. et al.
4,354,675 A 10/1982 Barclay et al.
4,355,061 A 10/1982 Zeigler
4,357,010 A 11/1982 Telle
4,357,011 A 11/1982 Voris
4,368,735 A 1/1983 Filmer
4,369,966 A 1/1983 Silberman et al.
4,371,162 A 2/1983 Hartzell
4,372,553 A 2/1983 Hatfield
4,373,716 A 2/1983 Pagani
4,374,588 A 2/1983 Ruggles
4,376,533 A 3/1983 Kolbel
4,382,596 A 5/1983 Silberman
4,383,684 A 5/1983 Schliep
4,384,715 A 5/1983 Barrett, Jr.
4,387,893 A 6/1983 Baldwin
4,389,047 A 6/1983 Hall
4,390,179 A 6/1983 Szkalak
4,391,440 A 7/1983 Berger
4,397,462 A 8/1983 Wilmarth
4,398,713 A 8/1983 Ellis
4,402,504 A 9/1983 Christian
4,422,636 A 12/1983 de Angeli
4,424,693 A 1/1984 Best et al.
4,426,077 A 1/1984 Becker
4,428,577 A 1/1984 Croom
4,428,578 A 1/1984 Kirkpatrick
4,431,181 A 2/1984 Baswell

(56) References Cited

U.S. PATENT DOCUMENTS 4,431,184 A 2/1984 Lew et al.
4,441,708 A 4/1984 Brentham
4,448,434 A 5/1984 Anderson
4,452,448 A 6/1984 Ausherman
4,456,245 A 6/1984 Baldwin
4,456,246 A 6/1984 Szabo
4,461,473 A 7/1984 Cole
4,463,948 A 8/1984 Mohr
4,465,274 A 8/1984 Davenport
4,465,276 A 8/1984 Cox
4,474,370 A 10/1984 Oman
4,477,071 A 10/1984 Brown et al.
4,478,413 A 10/1984 Siwula
4,482,152 A 11/1984 Wolff
4,489,933 A 12/1984 Fisher
4,489,936 A 12/1984 Dal Monte
4,492,375 A 1/1985 Connelly
4,494,662 A 1/1985 Clymer
4,502,679 A 3/1985 De Lorenzo
4,502,682 A 3/1985 Miller
4,505,475 A 3/1985 Olschansky et al.
4,505,495 A 3/1985 Foss et al.
4,511,137 A 4/1985 Jones
4,512,571 A 4/1985 Hermelin
4,515,363 A 5/1985 Schleffendorf
4,521,013 A 6/1985 Dofel
4,529,194 A 7/1985 Haaheim
4,529,196 A 7/1985 Logan
4,529,197 A 7/1985 Gogarty
4,529,198 A 7/1985 Hettick, Jr.
4,531,727 A 7/1985 Pitre
4,531,731 A 7/1985 Law
4,533,136 A 8/1985 Smith et al.
4,537,396 A 8/1985 Hooper
4,538,805 A 9/1985 Parviainen
4,540,171 A 9/1985 Clark
4,540,173 A 9/1985 Hopkins, Jr.
4,542,899 A 9/1985 Hendricks
4,546,967 A 10/1985 Kecala
4,546,970 A 10/1985 Mahnke
4,546,971 A 10/1985 Raasoch
4,549,433 A 10/1985 Gneiss et al.
4,549,733 A 10/1985 Salyer
4,549,734 A 10/1985 Hibler, Jr.
4,555,109 A 11/1985 Hartmann
4,556,216 A 12/1985 Pitkanen
4,563,001 A 1/1986 Terauds
4,563,003 A 1/1986 Bugallo et al.
4,564,193 A 1/1986 Stewart
4,565,369 A 1/1986 Bedgood
4,566,689 A 1/1986 Ogden
4,566,690 A 1/1986 Schook
4,569,518 A 2/1986 Fulks
4,569,519 A 2/1986 Mattox et al.
4,575,074 A 3/1986 Damratoski
4,576,377 A 3/1986 Wolff
4,577,861 A 3/1986 Bangerter et al.
4,579,360 A 4/1986 Nishimura et al.
4,582,320 A 4/1986 Shaw
4,587,695 A 5/1986 Jensen
4,591,150 A 5/1986 Mosher
4,591,151 A 5/1986 Hensley
4,592,544 A 6/1986 Smith et al.
4,598,908 A 7/1986 Morgan
4,600,188 A 7/1986 Bangerter et al.
4,600,189 A 7/1986 Olschansky et al.
4,600,196 A 7/1986 Jones
4,603,855 A 8/1986 Sebelle
4,603,856 A 8/1986 Fiore
4,606,540 A 8/1986 Chin Sen
4,606,541 A 8/1986 Kirkpatrick
4,607,840 A 8/1986 Harper
4,607,841 A 8/1986 Gala
4,608,969 A 9/1986 Hamlin
4,609,174 A 9/1986 Nakatani
4,610,448 A 9/1986 Hill
4,610,449 A 9/1986 Diercks, Jr.
4,611,805 A 9/1986 Franklin et al.
4,618,139 A 10/1986 Haaheim
4,618,140 A 10/1986 Brown
4,618,144 A 10/1986 Gibson
4,620,701 A 11/1986 Mojden
4,620,704 A 11/1986 Shifferaw
4,621,623 A 11/1986 Wang
4,621,807 A 11/1986 Stramer
4,621,810 A 11/1986 Cummins
4,624,457 A 11/1986 Silberman et al.
4,625,962 A 12/1986 Street
4,627,614 A 12/1986 De Angeli
4,627,615 A 12/1986 Nurkowski
4,627,616 A 12/1986 Kauffman
4,627,618 A 12/1986 Schwartz
4,632,385 A 12/1986 Geraci
4,632,388 A 12/1986 Schleffendorf
4,632,390 A 12/1986 Richey
4,632,393 A 12/1986 Van Noord
4,632,414 A 12/1986 Ellefson
4,632,421 A 12/1986 Shamie
4,634,118 A 1/1987 Jensen
4,634,127 A 1/1987 Rockwell
4,635,926 A 1/1987 Minkow
4,638,994 A 1/1987 Gogarty
4,641,833 A 2/1987 Trethewey
4,643,420 A 2/1987 Riley
4,645,198 A 2/1987 Levenston
4,647,037 A 3/1987 Donohue
4,647,040 A 3/1987 Ehrenfried
4,648,481 A 3/1987 Lee
4,648,594 A 3/1987 Schleffendorf
4,650,183 A 3/1987 McIntyre
4,650,185 A 3/1987 Cartwright
4,651,988 A 3/1987 Sobel
4,655,448 A 4/1987 Harder
4,657,246 A 4/1987 Salyer
4,659,077 A 4/1987 Stropkay
4,660,550 A 4/1987 Bodine
4,662,629 A 5/1987 Plovie
4,666,149 A 5/1987 Olschansky et al.
4,666,151 A 5/1987 Chillier
4,673,180 A 6/1987 Rice
4,678,185 A 7/1987 Mahnke
4,679,786 A 7/1987 Rodgers
4,679,787 A 7/1987 Guilbault
4,684,126 A 8/1987 Dalebout et al.
4,685,670 A 8/1987 Zinkin
4,685,671 A 8/1987 Hagerman et al.
4,697,809 A 10/1987 Rockwell
4,700,946 A 10/1987 Breunig
4,705,267 A 11/1987 Jackson
4,706,953 A 11/1987 Graham
4,709,920 A 12/1987 Schnell
4,717,146 A 1/1988 Nohara
4,720,099 A 1/1988 Carlson
4,721,301 A 1/1988 Drake
4,721,303 A 1/1988 Fitzpatrick
4,722,522 A 2/1988 Lundgren
4,725,057 A * 2/1988 Shifferaw ..... A63B 21/026
482/121
4,726,581 A 2/1988 Chang
4,726,582 A 2/1988 Fulks
4,728,099 A 3/1988 Pitre
4,729,558 A 3/1988 Kuo
4,729,562 A 3/1988 Pipasik
4,730,828 A 3/1988 Lane
4,730,829 A 3/1988 Carlson
4,733,860 A 3/1988 Steffee
4,733,905 A 3/1988 Buickerood
4,741,530 A 5/1988 Wolf
4,743,010 A 5/1988 Geraci
4,743,015 A 5/1988 Marshall
4,743,017 A 5/1988 Jaeger
4,744,559 A 5/1988 Mahnke et al.
4,746,115 A 5/1988 Lahman
4,750,736 A 6/1988 Watterson

(56) References Cited

U.S. PATENT DOCUMENTS 4,750,738 A 6/1988 Dang
4,753,437 A 6/1988 Lapcevic
4,756,527 A 7/1988 Ledbetter
4,763,897 A 8/1988 Yakata
4,765,610 A 8/1988 Sidwell
4,765,613 A 8/1988 Voris
4,765,616 A 8/1988 Wolff
4,768,780 A 9/1988 Hayes
4,772,015 A 9/1988 Carlson et al.
4,773,640 A 9/1988 Kolbel et al.
4,775,149 A 10/1988 Wilson
4,776,581 A 10/1988 Shepherdson
4,776,587 A 10/1988 Carlson et al.
4,778,173 A 10/1988 Joutras
4,779,867 A 10/1988 Hinds
4,784,384 A 11/1988 Deola
4,786,050 A 11/1988 Geschwender
4,789,153 A 12/1988 Brown
4,790,522 A 12/1988 Drutchas
4,790,596 A 12/1988 Shifferaw
4,793,608 A 12/1988 Mahnke et al.
4,798,377 A 1/1989 White
4,799,671 A 1/1989 Hoggan et al.
4,801,139 A 1/1989 Vanhoutte
4,801,140 A 1/1989 Bergeron
4,804,178 A 2/1989 Friedebach
4,807,874 A 2/1989 Little
4,807,893 A 2/1989 Huang
4,809,972 A 3/1989 Rasmussen et al.
4,809,973 A 3/1989 Johns
4,809,976 A 3/1989 Berger
4,813,667 A 3/1989 Weslo Inc
4,822,034 A 4/1989 Shields
4,822,035 A 4/1989 Jennings et al.
4,822,038 A 4/1989 Maag
4,826,153 A 5/1989 Schalip
4,826,157 A 5/1989 Fitzpatrick
4,826,158 A 5/1989 Fields, Jr.
4,830,363 A 5/1989 Kennedy
4,830,365 A 5/1989 March
4,832,332 A 5/1989 Dumbser
4,834,365 A 5/1989 Jones
4,834,396 A 5/1989 Schnell
4,836,535 A 6/1989 Pearson
4,838,180 A 6/1989 Gutgsell
4,838,543 A 6/1989 Armstrong et al.
4,838,544 A 6/1989 Sasakawa et al.
4,840,373 A 6/1989 Maag
4,842,268 A 6/1989 Jenkins
4,842,274 A 6/1989 Oosthuizen
4,844,448 A 7/1989 Niznik
4,844,450 A 7/1989 Rodgers, Jr.
4,844,453 A 7/1989 Hestilow
4,844,456 A 7/1989 Habing et al.
4,846,458 A 7/1989 Potts
4,848,737 A 7/1989 Ehrenfield
4,852,874 A 8/1989 Sleichter, III et al.
4,854,578 A 8/1989 Fulks
4,856,773 A 8/1989 Deola
4,856,775 A 8/1989 Colledge
4,858,912 A 8/1989 Boyd
4,858,915 A 8/1989 Szabo
4,858,918 A 8/1989 Iams et al.
4,861,020 A 8/1989 Soligny, Sr.
4,861,023 A 8/1989 Wedman
4,861,025 A 8/1989 Rockwell
4,863,161 A 9/1989 Telle
4,863,163 A 9/1989 Wehrell
4,869,493 A 9/1989 Johnston
4,872,670 A 10/1989 Nichols
4,877,239 A 10/1989 Dela Rosa
4,878,662 A 11/1989 Chern
4,880,227 A 11/1989 Sowell
4,880,229 A 11/1989 Broussard
4,880,230 A 11/1989 Cook
4,887,929 A 12/1989 Hale
4,889,458 A 12/1989 Taylor
4,893,409 A 1/1990 Poehlmann
4,893,810 A 1/1990 Lee
4,898,381 A 2/1990 Gordon
4,900,013 A 2/1990 Rodgers, Jr.
4,900,016 A 2/1990 Caruthers
4,900,018 A 2/1990 Ish, III
4,902,006 A 2/1990 Stallings, Jr.
4,902,007 A 2/1990 Ferrari
4,907,795 A 3/1990 Shaw et al.
4,907,797 A 3/1990 Gezari et al.
4,907,798 A 3/1990 Burchatz
4,909,505 A 3/1990 Tee
4,911,436 A 3/1990 Lighter
4,911,438 A 3/1990 Van Straaten
4,913,419 A 4/1990 McAuliffe
4,913,422 A 4/1990 Elmore
4,913,423 A 4/1990 Farran
4,915,377 A 4/1990 Malnke et al.
4,915,379 A 4/1990 Sapp
4,919,419 A 4/1990 Houston
4,921,242 A 5/1990 Watterson
4,921,245 A 5/1990 Roberts
4,925,200 A 5/1990 Jones
4,927,136 A 5/1990 Leask
4,927,138 A 5/1990 Ferrari
4,928,961 A 5/1990 Madden
4,930,768 A 6/1990 Lapcevic
4,930,769 A 6/1990 Nenoff
4,930,770 A 6/1990 Baker
4,934,690 A 6/1990 Bull
4,934,692 A 6/1990 Owens
4,940,233 A 7/1990 Bull
4,944,511 A 7/1990 Francis
4,944,518 A 7/1990 Flynn
4,948,121 A 8/1990 Haaheim et al.
4,948,123 A 8/1990 Schook
4,949,951 A 8/1990 Deola
4,949,954 A 8/1990 Hix
4,949,958 A 8/1990 Richey
4,949,959 A 8/1990 Stevens
4,958,832 A 9/1990 Kim
4,964,632 A 10/1990 Rockwell
4,971,305 A 11/1990 Rennex
4,971,316 A 11/1990 Dalebout et al.
4,973,050 A 11/1990 Santoro
4,974,836 A 12/1990 Hirsch
4,974,838 A 12/1990 Sollenberger
4,976,428 A 12/1990 Ghazi
4,978,122 A 12/1990 Dibowski
4,982,955 A 1/1991 Heasley
4,986,689 A 1/1991 Drutchas
4,989,860 A 2/1991 Iams et al.
4,990,838 A 2/1991 Kawato et al.
4,992,190 A 2/1991 Shtarkman
4,995,777 A 2/1991 Warmington
4,998,723 A 3/1991 Santoro
5,000,440 A 3/1991 Lynch
5,000,442 A * 3/1991 Dalebout ..... A63B 21/018
482/120
5,000,446 A 3/1991 Sarno
5,004,224 A 4/1991 Wang
5,005,832 A 4/1991 Hoeven
5,011,139 A 4/1991 Towley, III
5,011,142 A 4/1991 Eckler
5,015,926 A 5/1991 Casler
5,018,725 A 5/1991 Cook
5,022,377 A 6/1991 Stevens
5,026,049 A 6/1991 Goodman
5,029,848 A 7/1991 Sleamaker
5,029,849 A 7/1991 Nurkowski
5,029,850 A 7/1991 Van Straaten
5,031,905 A 7/1991 Walsh
5,032,048 A 7/1991 Walton et al.
5,033,740 A 7/1991 Schwartz
5,037,090 A 8/1991 Fitzpatrick
5,039,088 A 8/1991 Shifferaw
5,039,089 A 8/1991 Lapcevic

(56) References Cited

U.S. PATENT DOCUMENTS

| | | | |
|---|---|---|---|
| 5,039,091 | A | 8/1991 | Johnson |
| 5,040,785 | A | 8/1991 | Charnitski |
| 5,040,787 | A | 8/1991 | Brotman |
| 5,040,788 | A | 8/1991 | Randall |
| 5,042,704 | A | 8/1991 | Izzo |
| 5,042,799 | A | 8/1991 | Stanley |
| 5,044,629 | A | 9/1991 | Ryan |
| 5,044,631 | A | 9/1991 | Jones |
| 5,044,632 | A | 9/1991 | Jones |
| 5,048,825 | A | 9/1991 | Kelly |
| 5,048,826 | A | 9/1991 | Ryan |
| 5,050,872 | A | 9/1991 | Farenholtz |
| 5,050,873 | A | 9/1991 | Jones |
| 5,051,638 | A | 9/1991 | Pyles |
| 5,052,684 | A | 10/1991 | Kosuge et al. |
| 5,056,777 | A | 10/1991 | Capjon et al. |
| 5,058,882 | A | 10/1991 | Dalebout et al. |
| 5,058,884 | A | 10/1991 | Fuller, Sr. |
| 5,058,888 | A | 10/1991 | Walker et al. |
| 5,062,627 | A | 11/1991 | Bingham |
| 5,062,630 | A | 11/1991 | Nelson |
| 5,062,631 | A | 11/1991 | Dau et al. |
| 5,062,633 | A | 11/1991 | Engel et al. |
| 5,064,191 | A | 11/1991 | Johnson |
| 5,071,115 | A | 12/1991 | Welch |
| 5,071,119 | A | 12/1991 | Johnson |
| 5,074,550 | A | 12/1991 | Sloan |
| 5,080,353 | A | 1/1992 | Tench |
| 5,085,430 | A | 2/1992 | Habing |
| 5,090,694 | A | 2/1992 | Pauls et al. |
| 5,094,449 | A | 3/1992 | Stearns |
| 5,100,129 | A | 3/1992 | Illene |
| 5,102,121 | A | 4/1992 | Solow et al. |
| 5,102,122 | A | 4/1992 | Piane, Jr. |
| 5,102,124 | A | 4/1992 | Diodati |
| 5,104,120 | A | 4/1992 | Watterson et al. |
| 5,106,079 | A | 4/1992 | Escobedo |
| 5,108,090 | A | 4/1992 | Reed |
| 5,108,093 | A | 4/1992 | Watterson |
| 5,110,117 | A | 5/1992 | Fisher et al. |
| 5,110,118 | A | 5/1992 | Winey |
| 5,110,121 | A | 5/1992 | Foster |
| 5,112,287 | A | 5/1992 | Brewer |
| 5,114,391 | A | 5/1992 | Pitzen et al. |
| 5,116,297 | A | 5/1992 | Stonecipher |
| 5,120,289 | A | 6/1992 | Yu |
| 5,123,885 | A | 6/1992 | Shields |
| 5,123,886 | A | 6/1992 | Cook |
| 5,125,647 | A | 6/1992 | Smith |
| 5,125,884 | A | 6/1992 | Weber et al. |
| 5,129,872 | A | 7/1992 | Dalton et al. |
| 5,131,898 | A | 7/1992 | Panagos |
| 5,135,216 | A | 8/1992 | Bingham et al. |
| 5,135,445 | A | 8/1992 | Christensen |
| 5,135,449 | A | 8/1992 | Jones |
| 5,135,453 | A | 8/1992 | Sollenberger |
| 5,135,458 | A | 8/1992 | Huang |
| 5,135,459 | A | 8/1992 | Perry, Jr. |
| 5,137,272 | A | 8/1992 | Wilkinson |
| 5,141,478 | A | 8/1992 | Upper |
| 5,141,483 | A | 8/1992 | Smith |
| 5,145,481 | A | 9/1992 | Friedebach |
| 5,147,266 | A | 9/1992 | Ricard |
| 5,149,312 | A | 9/1992 | Croft et al. |
| 5,151,071 | A | 9/1992 | Jain et al. |
| 5,156,650 | A | 10/1992 | Bals |
| 5,158,518 | A | 10/1992 | Pizzuto |
| 5,158,520 | A | 10/1992 | Lemke et al. |
| 5,160,305 | A | 11/1992 | Lin |
| 5,167,850 | A | 12/1992 | Shtarkman |
| 5,169,362 | A | 12/1992 | Schwartz |
| 5,169,363 | A | 12/1992 | Campanaro |
| 5,171,196 | A | 12/1992 | Lynch |
| 5,176,601 | A | 1/1993 | Reynolds |
| 5,176,602 | A | 1/1993 | Roberts |
| 5,178,590 | A | 1/1993 | Stephens |
| 5,178,599 | A | 1/1993 | Scott |
| 5,180,352 | A | 1/1993 | Sreter |
| 5,181,894 | A | 1/1993 | Shieng |
| 5,184,991 | A | 2/1993 | Brangi |
| 5,184,994 | A | 2/1993 | Morris |
| 5,190,509 | A | 3/1993 | Davison, Jr. |
| 5,190,513 | A | 3/1993 | Habing et al. |
| 5,192,257 | A | 3/1993 | Panasewicz |
| 5,194,059 | A | 3/1993 | Wu |
| 5,195,937 | A | 3/1993 | Engel et al. |
| 5,199,934 | A | 4/1993 | Lin |
| 5,199,935 | A | 4/1993 | Gibson et al. |
| 5,201,694 | A | 4/1993 | Zappel |
| 5,201,772 | A | 4/1993 | Maxwell |
| 5,203,126 | A | 4/1993 | Sorenson et al. |
| 5,205,802 | A | 4/1993 | Swisher |
| 5,207,621 | A | 5/1993 | Koch et al. |
| 5,207,622 | A | 5/1993 | Wilkinson et al. |
| 5,209,223 | A | 5/1993 | McGorry et al. |
| 5,209,482 | A | 5/1993 | Hopfer |
| 5,209,715 | A | 5/1993 | Walker et al. |
| 5,211,614 | A | 5/1993 | Henes |
| 5,211,617 | A | 5/1993 | Millen |
| 5,217,422 | A | 6/1993 | Domzalski |
| 5,221,240 | A | 6/1993 | Mann |
| 5,221,245 | A | 6/1993 | Yeh |
| 5,222,928 | A | 6/1993 | Yacullo |
| 5,224,909 | A | 7/1993 | Hamilton |
| 5,226,866 | A | 7/1993 | Engel et al. |
| 5,226,868 | A | 7/1993 | Montgomery |
| 5,230,680 | A | 7/1993 | Wu |
| 5,231,752 | A | 8/1993 | Hereford |
| 5,232,422 | A | 8/1993 | Bishop, Jr. |
| 5,234,392 | A | 8/1993 | Clark |
| 5,234,395 | A | 8/1993 | Miller et al. |
| 5,236,406 | A | 8/1993 | Webber |
| 5,242,340 | A | 9/1993 | Jerome |
| 5,242,342 | A | 9/1993 | Silverman |
| 5,242,344 | A | 9/1993 | Hundley |
| 5,242,345 | A | 9/1993 | Mitchell |
| 5,242,348 | A | 9/1993 | Bates |
| 5,242,353 | A | 9/1993 | Cole et al. |
| 5,250,013 | A | 10/1993 | Brangi |
| 5,254,065 | A | 10/1993 | Pollock |
| 5,254,066 | A | 10/1993 | Brown et al. |
| 5,254,067 | A | 10/1993 | Habing et al. |
| 5,256,117 | A | 10/1993 | Potts et al. |
| 5,256,121 | A | 10/1993 | Brotman |
| 5,256,126 | A | 10/1993 | Grotstein |
| 5,261,865 | A | 11/1993 | Trainor |
| 5,263,913 | A | 11/1993 | Boren |
| 5,263,915 | A | 11/1993 | Habing |
| 5,263,916 | A | 11/1993 | Bobich |
| 5,267,929 | A | 12/1993 | Chen |
| 5,267,930 | A | 12/1993 | Henes |
| 5,269,736 | A | 12/1993 | Roberts |
| 5,269,737 | A | 12/1993 | Sobotka |
| 5,269,738 | A | 12/1993 | Boren |
| 5,271,416 | A | 12/1993 | Lepley |
| 5,273,505 | A | 12/1993 | Jones |
| 5,277,683 | A | 1/1994 | Wilkins |
| 5,277,684 | A | 1/1994 | Harris |
| 5,280,936 | A | 1/1994 | Schmidlin |
| 5,281,193 | A | 1/1994 | Colbo, Jr. |
| 5,282,776 | A | 2/1994 | Dalebout |
| 5,284,461 | A | 2/1994 | Wilkinson et al. |
| 5,284,463 | A | 2/1994 | Shields |
| 5,286,243 | A | 2/1994 | Lapcevic |
| 5,290,214 | A | 3/1994 | Chen |
| 5,292,297 | A | 3/1994 | Hsu |
| 5,298,002 | A | 3/1994 | Lin |
| 5,299,992 | A | 4/1994 | Wilkinson |
| 5,299,993 | A | 4/1994 | Habing |
| 5,299,997 | A | 4/1994 | Chen |
| 5,302,161 | A | 4/1994 | Loubert et al. |
| 5,303,885 | A | 4/1994 | Wade |
| 5,306,218 | A | 4/1994 | Chen |
| 5,306,221 | A | 4/1994 | Itaru |

(56) References Cited

U.S. PATENT DOCUMENTS 5,308,234 A 5/1994 Nicke et al.
5,308,304 A 5/1994 Habing
5,310,394 A 5/1994 Kallios
5,314,390 A 5/1994 Westing et al.
5,316,534 A 5/1994 Dalebout et al.
5,318,490 A 6/1994 Henderson et al.
5,318,495 A 6/1994 Malynowsky
5,320,588 A 6/1994 Wanzer et al.
5,320,591 A 6/1994 Harmon et al.
5,322,489 A 6/1994 Webb et al.
5,328,410 A 7/1994 Amburgey et al.
5,328,428 A 7/1994 Huang
5,328,429 A 7/1994 Potash et al.
5,328,430 A 7/1994 Vittone
5,330,404 A 7/1994 Lopeteguy et al.
5,330,405 A 7/1994 Habing et al.
5,330,408 A 7/1994 Westmoreland, Jr.
5,334,120 A 8/1994 Rasmussen
5,336,142 A 8/1994 Dalebout et al.
5,336,143 A 8/1994 Wu
5,336,148 A 8/1994 Ish, III
5,336,151 A 8/1994 Van Ballegooie
5,338,274 A 8/1994 Jones
5,338,277 A 8/1994 Yang
5,342,261 A 8/1994 Johnston
5,342,269 A 8/1994 Huang
5,342,271 A 8/1994 Long
5,344,372 A 9/1994 Hung
5,344,374 A 9/1994 Telle
5,344,376 A * 9/1994 Bostic ..... A63B 22/0002
482/114
5,346,447 A 9/1994 Stearns
5,348,524 A 9/1994 Grant
5,350,344 A 9/1994 Kissel
5,350,345 A 9/1994 Frey
5,352,171 A 10/1994 Lin
5,352,174 A 10/1994 Breg Inc
5,354,251 A 10/1994 Sleamaker
5,354,252 A 10/1994 Habing
5,354,253 A 10/1994 Awbrey et al.
5,356,003 A 10/1994 Gretz et al.
5,356,357 A 10/1994 Wang et al.
5,356,358 A 10/1994 Chen
5,356,360 A 10/1994 Johns
5,358,462 A 10/1994 Calderone
5,362,290 A 11/1994 Huang
5,362,295 A 11/1994 Nurge
5,362,296 A 11/1994 Wang et al.
5,364,060 A 11/1994 Donovan et al.
5,366,428 A 11/1994 Liao
5,366,432 A 11/1994 Habing et al.
5,368,042 A 11/1994 O'Neal et al.
5,368,536 A 11/1994 Stodgell
5,370,594 A 12/1994 Grinblat
5,372,556 A 12/1994 Ropp
5,372,564 A 12/1994 Spirito
5,374,227 A 12/1994 Webb
5,374,230 A 12/1994 Bonnaime
5,376,053 A 12/1994 Ponder
5,378,216 A 1/1995 Ish, III et al.
5,387,170 A 2/1995 Rawls et al.
5,387,171 A 2/1995 Casey et al.
5,391,132 A 2/1995 Greenwald
5,392,476 A 2/1995 Williams
5,397,287 A 3/1995 Lindfors
5,403,253 A 4/1995 Gaylord
5,403,256 A 4/1995 Squires
5,407,402 A 4/1995 Brown et al.
5,407,403 A 4/1995 Coleman
5,407,404 A 4/1995 Killian et al.
5,407,405 A 4/1995 Oren
5,407,411 A 4/1995 Trainor
5,407,414 A 4/1995 Bass
5,409,330 A 4/1995 Naines et al.
5,409,435 A 4/1995 Daniels
5,413,546 A 5/1995 Basile
5,413,551 A 5/1995 Wu
5,415,608 A 5/1995 Bode
5,417,634 A 5/1995 Habing
5,419,747 A 5/1995 Piaget
5,419,749 A 5/1995 Morgenstein
5,419,751 A 5/1995 Byrd et al.
5,421,795 A 6/1995 Chen
5,421,796 A 6/1995 Jones et al.
5,421,798 A 6/1995 Bond et al.
5,421,800 A 6/1995 Mullen
5,421,801 A 6/1995 Davies, III et al.
5,423,730 A 6/1995 Hirsch
5,423,731 A 6/1995 Chen
5,429,567 A 7/1995 Gerschefske et al.
5,429,568 A 7/1995 Chen
5,429,569 A 7/1995 Gunnari
5,433,685 A 7/1995 Winslow
5,435,798 A 7/1995 Habing et al.
5,435,799 A 7/1995 Lundin
5,435,801 A 7/1995 Hung
5,437,589 A 8/1995 Habing
5,443,435 A 8/1995 Wilkinson
5,447,480 A 9/1995 Fulks
5,449,332 A 9/1995 Hervig
5,451,191 A 9/1995 Beenken
5,453,066 A 9/1995 Richter, Jr.
5,456,644 A 10/1995 Hecox et al.
5,458,553 A 10/1995 Wu
5,460,586 A 10/1995 Wilkinson
5,464,378 A 11/1995 Lee
5,467,874 A 11/1995 Whitaker
5,468,205 A 11/1995 McFall et al.
5,472,397 A 12/1995 Ammoscato et al.
5,472,399 A 12/1995 Szekely
5,476,428 A 12/1995 Potash et al.
5,478,298 A 12/1995 Chen
5,480,212 A 1/1996 Marconet
5,484,358 A 1/1996 Wang et al.
5,484,365 A 1/1996 Jones et al.
5,489,249 A 2/1996 Brewer et al.
5,492,518 A 2/1996 Measom
5,493,127 A 2/1996 Lloyd et al.
5,496,238 A 3/1996 Taylor
5,496,244 A 3/1996 Caruthers
5,498,222 A 3/1996 Hur
5,498,223 A 3/1996 Iams et al.
5,499,959 A 3/1996 Holmes et al.
5,499,961 A 3/1996 Mattox
5,501,647 A 3/1996 Snyder
5,501,656 A 3/1996 Homma et al.
5,503,608 A 4/1996 Chang
5,505,677 A 4/1996 Hinds
5,507,710 A 4/1996 Chen
5,514,059 A 5/1996 Romney
5,518,476 A 5/1996 Mcleon
5,518,477 A 5/1996 Simonson
5,518,483 A 5/1996 Oswald
5,518,486 A 5/1996 Sheeler
5,520,599 A 5/1996 Chen
5,522,783 A 6/1996 Gordon
5,527,245 A 6/1996 Dalebout et al.
5,527,249 A 6/1996 Harris
5,527,250 A 6/1996 Chen
5,527,253 A 6/1996 Wilkinson
5,529,554 A 6/1996 Eschenbach
5,529,560 A 6/1996 Dise
5,533,899 A 7/1996 Young
5,533,952 A 7/1996 Schaber
5,540,642 A 7/1996 Sprague
5,545,114 A 8/1996 Gvoich
5,549,530 A 8/1996 Fulks
5,549,532 A 8/1996 Kropp
5,549,533 A 8/1996 Olson et al.
5,554,085 A 9/1996 Dalebout
5,554,086 A 9/1996 Habing et al.
5,556,362 A 9/1996 Whipps
5,556,369 A 9/1996 Roberts
5,558,608 A 9/1996 Hall

(56) References Cited

U.S. PATENT DOCUMENTS 5,562,577 A 10/1996 Nichols, Sr. et al.
5,569,133 A 10/1996 Vittone
5,569,138 A 10/1996 Wang et al.
5,571,064 A 11/1996 Holm
5,573,485 A 11/1996 Geschwender
5,575,740 A 11/1996 Piaget
5,577,985 A 11/1996 Miller
5,577,987 A 11/1996 Brown
5,580,340 A 12/1996 Yu
5,580,341 A 12/1996 Simonson
5,582,565 A 12/1996 Soria
5,586,811 A 12/1996 Tornero
5,586,962 A 12/1996 Hallmark
5,588,938 A 12/1996 Schneider et al.
5,588,942 A 12/1996 Dillard
5,595,545 A 1/1997 O'Brien
5,595,556 A 1/1997 Dalebout et al.
5,595,559 A 1/1997 Viel
5,597,362 A 1/1997 Lee
5,597,375 A 1/1997 Simonson
5,599,261 A 2/1997 Easley et al.
5,601,518 A 2/1997 Weintraub
5,603,678 A 2/1997 Wilson
5,605,524 A 2/1997 Husted
5,607,250 A 3/1997 Tatterson et al.
5,609,278 A 3/1997 Fresco
5,613,924 A 3/1997 Lee
5,613,928 A 3/1997 Laudone
5,616,106 A 4/1997 Abelbeck
5,616,107 A 4/1997 Simonson
5,616,111 A 4/1997 Randolph
5,618,250 A 4/1997 Butz
5,620,403 A 4/1997 Lundin
5,622,527 A 4/1997 Watterson et al.
5,624,353 A 4/1997 Naidus
5,624,360 A 4/1997 Wilkins
5,624,361 A 4/1997 Lai
5,626,546 A 5/1997 Little
5,626,548 A 5/1997 Coyle
5,628,715 A 5/1997 Simonson
5,628,716 A 5/1997 Brice
5,632,711 A 5/1997 Hwang
5,634,870 A 6/1997 Wilkinson
5,637,064 A 6/1997 Olson et al.
5,643,162 A 7/1997 Landers et al.
5,645,510 A 7/1997 Wilkinson
5,653,669 A 8/1997 Cheng
5,655,997 A 8/1997 Greenberg et al.
5,656,001 A 8/1997 Baatz
5,658,227 A 8/1997 Stearns
5,662,557 A 9/1997 Watterson et al.
5,665,031 A 9/1997 Hsieh
5,665,041 A 9/1997 Hsieh
5,667,465 A 9/1997 McCollum et al.
5,669,455 A 9/1997 Dietrich
5,669,857 A 9/1997 Watterson et al.
5,669,862 A 9/1997 Sayman
5,669,865 A 9/1997 Gordon
5,672,140 A 9/1997 Watterson et al.
5,674,156 A 10/1997 Watterson et al.
5,674,167 A 10/1997 Piaget et al.
5,674,453 A 10/1997 Watterson et al.
5,676,624 A 10/1997 Watterson et al.
5,679,100 A 10/1997 Charnitski
5,681,247 A 10/1997 Webber
5,681,249 A 10/1997 Endelman
5,683,332 A 11/1997 Watterson et al.
5,683,334 A 11/1997 Webber
5,685,804 A 11/1997 Whan-Tong et al.
5,685,810 A 11/1997 Chung
5,688,196 A 11/1997 O'neil
5,688,210 A 11/1997 Chou
5,688,212 A 11/1997 Walker
5,692,996 A 12/1997 Widerman
5,692,997 A 12/1997 Stearns
5,693,004 A 12/1997 Carlson et al.
5,695,434 A 12/1997 Dalebout et al.
5,707,168 A 1/1998 Sharon
5,709,428 A 1/1998 Hugghins
5,709,633 A 1/1998 Sokol
5,709,634 A 1/1998 Pointer
5,709,636 A 1/1998 Vallone
5,709,638 A 1/1998 Mackert et al.
5,711,746 A 1/1998 Carlson
5,711,749 A 1/1998 Miller
5,716,308 A 2/1998 Lee
5,718,660 A 2/1998 Chen
5,720,702 A 2/1998 Lee
5,722,917 A 3/1998 Olschansky et al.
5,722,921 A 3/1998 Simonson
5,722,922 A 3/1998 Watterson et al.
5,725,459 A 3/1998 Rexach
5,725,463 A 3/1998 Colonello et al.
5,733,227 A 3/1998 Lee
5,733,229 A 3/1998 Dalebout et al.
5,733,232 A 3/1998 Hsu
5,735,773 A 4/1998 Vittone
5,738,616 A 4/1998 Robertson
5,743,833 A 4/1998 Watterson et al.
5,746,687 A 5/1998 Vial et al.
5,746,688 A 5/1998 Prager
5,749,668 A 5/1998 Mcilvain
5,749,807 A 5/1998 Webb
5,749,809 A 5/1998 Lin
5,749,813 A 5/1998 Domzalski
5,752,879 A 5/1998 Berdut
5,752,901 A 5/1998 Lee
5,755,645 A 5/1998 Miller et al.
5,755,646 A 5/1998 Chu
5,755,823 A 5/1998 Cleary
5,759,139 A 6/1998 Wright
5,762,584 A 6/1998 Daniels
5,762,587 A 6/1998 Dalebout et al.
5,766,118 A 6/1998 Conner
5,769,759 A 6/1998 Alter
5,769,762 A 6/1998 Towley, III et al.
5,772,563 A 6/1998 Lin
5,776,040 A 7/1998 Webb et al.
5,779,604 A 7/1998 Towley, III et al.
5,779,607 A 7/1998 Harris
5,785,632 A 7/1998 Greenberg et al.
5,788,616 A 8/1998 Polidi
5,788,618 A 8/1998 Joutras
5,792,027 A 8/1998 Gvoich
5,792,028 A 8/1998 Jarvie
5,792,029 A 8/1998 Gordon
5,792,034 A 8/1998 Kozlovsky
5,795,274 A 8/1998 Kasbohm
5,797,639 A 8/1998 Zorzenon
5,800,310 A 9/1998 Jones
5,800,321 A 9/1998 Webber
5,800,323 A 9/1998 Ansel
5,803,874 A 9/1998 Wilkinson
5,803,877 A 9/1998 Franey
5,803,882 A 9/1998 Habing et al.
5,807,214 A 9/1998 Riazi
5,810,696 A 9/1998 Webb
5,810,698 A 9/1998 Hullett et al.
5,810,702 A 9/1998 Wilkinson
5,816,372 A 10/1998 Carlson et al.
5,816,983 A 10/1998 Dawes et al.
5,820,478 A 10/1998 Wood et al.
5,820,529 A 10/1998 Weintraub
5,820,532 A 10/1998 Oliver
5,825,983 A 10/1998 Park et al.
5,827,158 A 10/1998 Drecksel
5,829,771 A 11/1998 Hsu
5,830,107 A 11/1998 Brigliadoro
5,830,113 A 11/1998 Coody et al.
5,833,577 A 11/1998 Hurt
5,833,582 A 11/1998 Chen
5,833,587 A 11/1998 Strong et al.
5,836,854 A 11/1998 Kuo
5,836,858 A 11/1998 Sharff

(56) References Cited

U.S. PATENT DOCUMENTS 5,839,997 A 11/1998 Roth et al.
5,842,956 A 12/1998 Strachan
5,848,954 A 12/1998 Stearns et al.
5,855,537 A 1/1999 Coody et al.
5,857,940 A 1/1999 Husted
5,857,942 A 1/1999 Moon et al.
5,857,943 A 1/1999 Murray
5,860,190 A 1/1999 Cano
5,860,893 A 1/1999 Watterson et al.
5,860,894 A 1/1999 Dalebout et al.
5,860,899 A 1/1999 Rassman
5,865,714 A 2/1999 Marlowe
5,868,648 A 2/1999 Coody et al.
5,868,653 A 2/1999 Klasen
5,871,424 A 2/1999 Conner
5,876,310 A 3/1999 Mackey et al.
5,876,313 A 3/1999 Krull
5,879,247 A 3/1999 Winter et al.
5,879,271 A 3/1999 Stearns et al.
5,879,276 A 3/1999 Miller
5,885,196 A 3/1999 Gvoich
5,885,197 A 3/1999 Barton
5,891,004 A 4/1999 Berry
5,891,042 A 4/1999 Sham et al.
5,895,342 A 4/1999 Solland
5,897,459 A 4/1999 Habing et al.
5,897,463 A 4/1999 Maresh
5,897,467 A 4/1999 Habing et al.
5,897,469 A 4/1999 Yalch
5,897,472 A 4/1999 Thulasingam
5,897,474 A 4/1999 Romero
5,899,834 A 5/1999 Dalebout et al.
5,904,638 A 5/1999 Habing et al.
5,906,564 A 5/1999 Jacobsen
5,906,566 A 5/1999 Whitcomb
5,908,373 A 6/1999 Pitre
5,910,070 A 6/1999 Henry et al.
5,910,073 A 6/1999 Conner
5,911,649 A 6/1999 Miller
5,919,118 A 7/1999 Stearns
5,921,892 A 7/1999 Easton
5,921,901 A 7/1999 Palacios
5,924,966 A 7/1999 Havlovic
5,927,780 A 7/1999 Chandler
5,928,116 A 7/1999 Chiang
5,931,767 A 8/1999 Morales
5,935,048 A 8/1999 Krull
5,938,551 A 8/1999 Warner
5,938,571 A 8/1999 Stevens
5,938,574 A 8/1999 Webber
5,941,800 A 8/1999 Laconis
5,941,803 A 8/1999 Chamberlain
5,941,807 A 8/1999 Cassidy
5,944,641 A 8/1999 Habing
5,944,642 A 8/1999 Krull
5,951,444 A 9/1999 Webber
5,954,106 A 9/1999 Huang
5,954,621 A 9/1999 Joutras et al.
5,957,819 A 9/1999 Cortesi
5,961,423 A 10/1999 Sellers
5,961,428 A 10/1999 Webber
5,967,948 A 10/1999 Carr
5,967,950 A 10/1999 Hsu
5,967,954 A 10/1999 Habing
5,971,892 A 10/1999 Lee
5,971,895 A 10/1999 Habing
5,984,836 A 11/1999 Casali
5,989,164 A 11/1999 Kullman et al.
5,989,165 A 11/1999 Giannelli et al.
5,989,166 A 11/1999 Capizzo et al.
5,993,358 A 11/1999 Gureghian et al.
5,997,447 A 12/1999 Giannelli et al.
5,998,897 A 12/1999 Bosten et al.
6,003,294 A 12/1999 Fitzgerald et al.
6,004,246 A 12/1999 Sencil
6,004,247 A 12/1999 Webber
6,007,268 A 12/1999 Whittington et al.
6,010,432 A 1/2000 Vawter
6,011,134 A 1/2000 Marks et al.
6,015,367 A 1/2000 Scaramucci
6,015,371 A 1/2000 Davitt
6,017,293 A 1/2000 Pfefferle
6,019,403 A 2/2000 Corbett
6,022,300 A 2/2000 Hightower
6,022,302 A 2/2000 McBride
6,024,677 A 2/2000 Siwertz
6,027,429 A 2/2000 Daniels
6,027,433 A 2/2000 Flynn
6,030,320 A * 2/2000 Stearns ..... A63B 22/0664 482/51
6,033,347 A 3/2000 Dalebout et al.
6,033,350 A 3/2000 Krull
6,036,622 A 3/2000 Gordon
6,036,625 A 3/2000 Woodruff
6,039,677 A 3/2000 Spletzer
6,039,678 A 3/2000 Dawson
6,042,516 A 3/2000 Norton
6,042,523 A 3/2000 Graham
6,045,487 A 4/2000 Miller
6,045,491 A 4/2000 McNergney
6,050,920 A 4/2000 Ehrenfried
6,050,921 A 4/2000 Wang
6,053,816 A 4/2000 Immel
6,053,853 A 4/2000 Hinds
6,056,678 A 5/2000 Giannelli et al.
6,059,695 A 5/2000 Hung
6,059,698 A 5/2000 Mazor
6,059,701 A 5/2000 George et al.
6,065,572 A 5/2000 Schober et al.
6,066,077 A 5/2000 Horst
6,071,216 A 6/2000 Giannelli et al.
6,071,217 A 6/2000 Barnett
6,074,328 A 6/2000 Johnson
6,077,199 A 6/2000 Hsu
6,077,200 A 6/2000 Lin
6,079,915 A 6/2000 Bosten et al.
6,080,091 A 6/2000 Habing et al.
6,082,346 A 7/2000 Andrews et al.
6,083,144 A 7/2000 Towley, III et al.
6,086,520 A 7/2000 Rodriquez
6,086,521 A 7/2000 Solland
6,090,016 A 7/2000 Kuo
6,090,020 A 7/2000 Webber
6,095,954 A 8/2000 Svanberg
6,099,442 A 8/2000 Krull
6,099,444 A 8/2000 Domenge
6,101,684 A 8/2000 Ginocchio
6,102,836 A 8/2000 Person
6,102,837 A 8/2000 Hubbard
6,106,437 A 8/2000 Brooks
6,106,439 A 8/2000 Boland
6,110,075 A 8/2000 Woodruff
6,110,076 A 8/2000 Hurt
6,110,081 A 8/2000 Barrett
6,112,624 A 9/2000 Chen
6,113,323 A 9/2000 Bosten et al.
6,113,518 A 9/2000 Maresh
6,113,522 A 9/2000 Montgomery
6,113,564 A 9/2000 McGuire
6,117,049 A 9/2000 Lowe
6,120,424 A 9/2000 Arline
6,123,649 A 9/2000 Lee
6,123,650 A 9/2000 Birrell
6,126,577 A 10/2000 Chang
6,128,981 A 10/2000 Bondhus et al.
6,129,651 A 10/2000 Denaro
6,132,347 A 10/2000 Alessandri
6,135,926 A 10/2000 Lee
6,135,927 A 10/2000 Lo
6,149,551 A 11/2000 Pyles et al.
6,149,556 A 11/2000 Jordan
6,149,558 A 11/2000 Chen
6,149,559 A 11/2000 Mackey
6,152,864 A 11/2000 Giannelli et al.

(56) References Cited

U.S. PATENT DOCUMENTS

| | | | |
|---|---|---|---|
| 6,162,153 | A | 12/2000 | Perez, Jr. |
| 6,165,107 | A | 12/2000 | Birrell |
| 6,165,110 | A | 12/2000 | Gajda |
| 6,168,557 | B1 | 1/2001 | Liao |
| 6,172,178 | B1 | 1/2001 | Koning et al. |
| 6,174,265 | B1 | 1/2001 | Alessandri |
| 6,174,268 | B1 | 1/2001 | Novak |
| 6,175,994 | B1 | 1/2001 | Nicoletti |
| 6,179,748 | B1 | 1/2001 | Barr |
| 6,183,397 | B1 | 2/2001 | Stearns et al. |
| 6,183,400 | B1 | 2/2001 | Pope |
| 6,183,401 | B1 | 2/2001 | Krull |
| 6,183,403 | B1 | 2/2001 | Dunn |
| 6,186,290 | B1 | 2/2001 | Carlson |
| 6,186,926 | B1 | 2/2001 | Ellis |
| 6,186,927 | B1 | 2/2001 | Krull |
| 6,186,928 | B1 | 2/2001 | Chen |
| 6,186,929 | B1 | 2/2001 | Endelman et al. |
| 6,190,289 | B1 | 2/2001 | Pyles et al. |
| 6,193,635 | B1 | 2/2001 | Webber et al. |
| 6,196,952 | B1 | 3/2001 | Chen |
| 6,196,954 | B1 | 3/2001 | Chen |
| 6,199,732 | B1 | 3/2001 | Swetish |
| 6,203,473 | B1 | 3/2001 | Atwood |
| 6,203,474 | B1 | 3/2001 | Jones |
| 6,206,804 | B1 | 3/2001 | Maresh |
| 6,213,923 | B1 | 4/2001 | Cameron et al. |
| 6,217,483 | B1 | 4/2001 | Kallassy |
| 6,217,493 | B1 | 4/2001 | Spletzer |
| 6,217,495 | B1 | 4/2001 | Yalch |
| 6,220,990 | B1 | 4/2001 | Crivello |
| 6,220,992 | B1 | 4/2001 | Shafik |
| 6,224,519 | B1 | 5/2001 | Doolittle |
| 6,228,003 | B1 | 5/2001 | Hald et al. |
| 6,231,489 | B1 | 5/2001 | McBride et al. |
| 6,234,941 | B1 | 5/2001 | Chu |
| 6,238,322 | B1 | 5/2001 | Hsu |
| 6,238,323 | B1 | 5/2001 | Simonson |
| 6,241,553 | B1 | 6/2001 | Hsia |
| 6,244,995 | B1 | 6/2001 | Prsala |
| 6,245,001 | B1 | 6/2001 | Siaperas |
| 6,251,048 | B1 | 6/2001 | Kaufman |
| 6,251,052 | B1 | 6/2001 | Simonson |
| 6,254,516 | B1 | 7/2001 | Giannelli et al. |
| 6,261,022 | B1 | 7/2001 | Dalebout et al. |
| 6,264,272 | B1 | 7/2001 | Jones et al. |
| 6,264,588 | B1 | 7/2001 | Ellis |
| 6,267,711 | B1 | 7/2001 | Hinds |
| 6,280,361 | B1 | 8/2001 | Harvey et al. |
| 6,280,362 | B1 | 8/2001 | Dalebout et al. |
| 6,283,859 | B1 | 9/2001 | Carlson et al. |
| 6,287,240 | B1 | 9/2001 | Trabbic |
| 6,287,241 | B1 | 9/2001 | Ellis |
| 6,290,630 | B1 | 9/2001 | Boland |
| 6,293,892 | B1 | 9/2001 | Slawinski et al. |
| 6,302,830 | B1 | 10/2001 | Stearns |
| 6,302,833 | B1 | 10/2001 | Ellis et al. |
| 6,309,331 | B1 | 10/2001 | Raymond |
| 6,312,366 | B1 | 11/2001 | Prusick |
| 6,315,702 | B1 | 11/2001 | Ikonomopoulos |
| 6,319,176 | B1 | 11/2001 | Landfair |
| 6,319,178 | B1 | 11/2001 | Webber |
| 6,319,179 | B1 | 11/2001 | Hinds |
| 6,322,481 | B1 | 11/2001 | Krull |
| 6,322,483 | B1 | 11/2001 | Rotella |
| 6,328,325 | B1 | 12/2001 | Greenwood |
| 6,334,624 | B1 | 1/2002 | Giglio |
| 6,335,100 | B1 | 1/2002 | Tominaga et al. |
| 6,338,701 | B1 | 1/2002 | Webber |
| 6,340,340 | B1 | 1/2002 | Stearns |
| 6,342,028 | B1 | 1/2002 | De Sane |
| 6,347,731 | B1 | 2/2002 | Burger |
| 6,350,218 | B1 | 2/2002 | Dalebout et al. |
| 6,350,219 | B1 | 2/2002 | Hobson |
| 6,350,221 | B1 | 2/2002 | Krull |
| 6,358,187 | B1 | 3/2002 | Smith |
| 6,360,408 | B1 | 3/2002 | Dykstra et al. |
| 6,368,251 | B1 | 4/2002 | Casler |
| 6,368,254 | B1 | 4/2002 | Wall |
| 6,379,287 | B1 | 4/2002 | Slawinski et al. |
| 6,387,018 | B1 | 5/2002 | Krull |
| 6,387,019 | B1 | 5/2002 | Krull |
| 6,387,022 | B1 | 5/2002 | Smith |
| 6,387,024 | B1 | 5/2002 | Monti et al. |
| 6,390,927 | B1 | 5/2002 | Cleveland, III |
| 6,394,935 | B1 | 5/2002 | Lake |
| 6,394,936 | B1 | 5/2002 | Voris |
| 6,394,938 | B1 | 5/2002 | Tornabene |
| 6,402,666 | B2 | 6/2002 | Krull |
| 6,413,196 | B1 | 7/2002 | Crowson |
| 6,413,197 | B2 | 7/2002 | McKechnie et al. |
| 6,416,446 | B1 | 7/2002 | Krull |
| 6,416,447 | B1 | 7/2002 | Harmon |
| 6,422,979 | B1 | 7/2002 | Krull |
| 6,422,980 | B1 | 7/2002 | Simonson |
| 6,422,981 | B1 | 7/2002 | Riser |
| 6,422,983 | B1 | 7/2002 | Weck |
| 6,427,805 | B1 | 8/2002 | Gibson et al. |
| 6,428,450 | B1 | 8/2002 | Ho |
| 6,436,013 | B1 | 8/2002 | Krull |
| 6,440,045 | B1 | 8/2002 | Gaston |
| 6,443,521 | B1 | 9/2002 | Nye et al. |
| 6,443,877 | B1 | 9/2002 | Hoecht |
| 6,443,878 | B1 | 9/2002 | Webber |
| 6,447,424 | B1 | 9/2002 | Ashby et al. |
| 6,447,430 | B1 | 9/2002 | Webb et al. |
| 6,447,432 | B1 | 9/2002 | Krull |
| 6,450,923 | B1 | 9/2002 | Vatti |
| 6,450,928 | B1 | 9/2002 | Larkins, Jr. |
| 6,454,050 | B2 | 9/2002 | Gibson et al. |
| 6,454,679 | B1 | 9/2002 | Radow |
| 6,458,061 | B2 | 10/2002 | Simonson |
| 6,461,284 | B1 | 10/2002 | Francavilla |
| 6,468,189 | B2 | 10/2002 | Alessandri |
| 6,471,622 | B1 | 10/2002 | Hammer et al. |
| 6,471,624 | B1 | 10/2002 | Voris |
| 6,474,193 | B1 | 11/2002 | Farney |
| 6,475,122 | B2 | 11/2002 | Wu |
| 6,478,721 | B1 | 11/2002 | Hunter |
| 6,482,134 | B1 | 11/2002 | Rasmussen |
| 6,482,139 | B1 | 11/2002 | Haag |
| 6,488,599 | B2 | 12/2002 | Nye |
| 6,488,612 | B2 | 12/2002 | Sechrest et al. |
| 6,491,268 | B1 | 12/2002 | Channer et al. |
| 6,491,609 | B2 | 12/2002 | Webber |
| 6,491,610 | B1 | 12/2002 | Henn |
| 6,494,817 | B2 | 12/2002 | Lake |
| 6,500,101 | B1 | 12/2002 | Chen |
| 6,500,102 | B1 | 12/2002 | Domenge |
| 6,506,142 | B2 | 1/2003 | Itoh et al. |
| 6,510,760 | B2 | 1/2003 | Matsuo |
| 6,514,180 | B1 | 2/2003 | Rawls |
| 6,515,182 | B2 | 2/2003 | Hosokawa et al. |
| 6,520,531 | B1 | 2/2003 | Gien |
| 6,524,226 | B2 | 2/2003 | Kushner |
| 6,527,678 | B1 | 3/2003 | Wang |
| 6,527,683 | B2 | 3/2003 | Tolles |
| 6,537,185 | B1 | 3/2003 | Hur |
| 6,540,650 | B1 | 4/2003 | Krull |
| 6,540,651 | B1 | 4/2003 | Aberton et al. |
| 6,551,217 | B2 | 4/2003 | Kaganovsky |
| 6,551,220 | B1 | 4/2003 | Schroeder |
| 6,551,223 | B2 | 4/2003 | Cheng |
| 6,551,226 | B1 | 4/2003 | Webber et al. |
| 6,558,300 | B2 | 5/2003 | Deola |
| 6,558,301 | B1 | 5/2003 | Jackson |
| 6,558,302 | B2 | 5/2003 | Cluff |
| 6,561,955 | B1 | 5/2003 | Dreissigacker et al. |
| 6,561,956 | B1 | 5/2003 | Allison |
| 6,561,960 | B2 | 5/2003 | Webber |
| 6,575,882 | B2 | 6/2003 | Chen |
| 6,575,885 | B1 | 6/2003 | Weck et al. |
| 6,579,213 | B1 | 6/2003 | Webber et al. |
| 6,579,214 | B2 | 6/2003 | Crump |

(56) References Cited

U.S. PATENT DOCUMENTS

| | | | |
|---|---|---|---|
| 6,582,342 | B2 | 6/2003 | Kaufman |
| 6,582,345 | B2 | 6/2003 | Roy |
| 6,585,626 | B2 | 7/2003 | McBride |
| 6,592,498 | B1 | 7/2003 | Trainor |
| 6,592,499 | B2 | 7/2003 | Parker |
| 6,595,905 | B2 | 7/2003 | McBride |
| 6,599,223 | B2 | 7/2003 | Wang |
| 6,601,358 | B2 | 8/2003 | Panatta |
| 6,605,024 | B2 | 8/2003 | Stearns |
| 6,607,472 | B2 | 8/2003 | Toole |
| 6,612,170 | B2 | 9/2003 | Brown |
| 6,623,407 | B2 | 9/2003 | Novak |
| 6,629,908 | B2 | 10/2003 | Hamady |
| 6,629,910 | B1 | 10/2003 | Krull |
| 6,632,160 | B2 | 10/2003 | LaFond et al. |
| 6,632,161 | B1 | 10/2003 | Nir |
| 6,634,996 | B2 | 10/2003 | Jacobsen |
| 6,634,997 | B2 | 10/2003 | Breibart et al. |
| 6,634,998 | B2 | 10/2003 | Siaperas |
| 6,645,129 | B2 | 11/2003 | Eschenbach |
| 6,645,130 | B2 | 11/2003 | Webber |
| 6,652,419 | B1 | 11/2003 | Rota |
| 6,652,424 | B2 | 11/2003 | Dalebout |
| 6,652,426 | B2 | 11/2003 | Carter |
| 6,652,429 | B2 | 11/2003 | Bushnell |
| 6,652,431 | B1 | 11/2003 | Mattox |
| 6,652,432 | B2 | 11/2003 | Smith |
| 6,656,093 | B2 | 12/2003 | Chen |
| 6,662,651 | B1 | 12/2003 | Roth |
| 6,663,127 | B2 | 12/2003 | Miller |
| 6,666,796 | B1 | 12/2003 | MacCready, Jr. |
| 6,666,800 | B2 | 12/2003 | Krull |
| 6,666,801 | B1 | 12/2003 | Michalow |
| 6,669,600 | B2 | 12/2003 | Warner |
| 6,669,606 | B2 | 12/2003 | Krull |
| 6,669,607 | B2 | 12/2003 | Slawinski et al. |
| 6,669,609 | B2 | 12/2003 | Gerschefske et al. |
| 6,672,992 | B1 | 1/2004 | Lo et al. |
| 6,676,573 | B2 | 1/2004 | Abelbeck et al. |
| 6,676,577 | B2 | 1/2004 | Stearns |
| 6,679,816 | B1 | 1/2004 | Krull |
| 6,685,600 | B1 | 2/2004 | Ullman |
| 6,685,601 | B1 | 2/2004 | Knapp |
| 6,685,602 | B2 | 2/2004 | Colosky, Jr. et al. |
| 6,685,607 | B1 | 2/2004 | Olson |
| 6,689,023 | B2 | 2/2004 | Baumler |
| 6,689,025 | B2 | 2/2004 | Emick |
| 6,691,839 | B1 | 2/2004 | El-Kassouf |
| 6,692,415 | B1 | 2/2004 | Winston |
| 6,692,417 | B2 | 2/2004 | Burrell |
| 6,695,620 | B1 | 2/2004 | Huang |
| 6,699,146 | B1 | 3/2004 | Winter et al. |
| 6,699,161 | B1 | 3/2004 | Speas |
| 6,702,723 | B2 | 3/2004 | Landfair |
| 6,702,726 | B2 | 3/2004 | Lin |
| 6,705,974 | B1 | 3/2004 | Tardif |
| 6,705,976 | B1 | 3/2004 | Piane, Jr. |
| 6,711,789 | B2 | 3/2004 | Ping |
| 6,712,740 | B2 | 3/2004 | Simonson |
| 6,719,667 | B2 | 4/2004 | Wong et al. |
| 6,719,672 | B1 | 4/2004 | Ellis et al. |
| 6,719,674 | B2 | 4/2004 | Krull |
| 6,726,601 | B1 | 4/2004 | Beutel |
| 6,733,424 | B2 | 5/2004 | Krull |
| 6,736,759 | B1 | 5/2004 | Stubbs et al. |
| 6,736,765 | B2 | 5/2004 | Wallace et al. |
| 6,736,766 | B1 | 5/2004 | Gallant |
| 6,746,370 | B1 | 6/2004 | Fleming et al. |
| 6,746,371 | B1 | 6/2004 | Brown et al. |
| 6,746,380 | B2 | 6/2004 | Lien et al. |
| 6,746,381 | B2 | 6/2004 | Krull |
| 6,749,537 | B1 | 6/2004 | Hickman |
| 6,749,547 | B2 | 6/2004 | Krull |
| 6,752,745 | B1 | 6/2004 | Davis |
| 6,755,770 | B2 | 6/2004 | Martens |
| 6,761,667 | B1 | 7/2004 | Cutler et al. |
| 6,761,672 | B1 | 7/2004 | Williams |
| 6,764,431 | B2 | 7/2004 | Yoss |
| 6,764,432 | B2 | 7/2004 | Hippensteel |
| 6,770,014 | B2 | 8/2004 | Amore |
| 6,770,015 | B2 | 8/2004 | Simonson |
| 6,783,482 | B2 | 8/2004 | Oglesby et al. |
| 6,786,847 | B1 | 9/2004 | Morgan et al. |
| 6,790,163 | B1 | 9/2004 | Van De Laarschot |
| 6,793,607 | B2 | 9/2004 | Neil |
| 6,796,925 | B2 | 9/2004 | Martinez et al. |
| 6,802,800 | B1 | 10/2004 | Hobson |
| 6,811,520 | B2 | 11/2004 | Wu |
| 6,821,230 | B2 | 11/2004 | Dalebout et al. |
| 6,827,822 | B2 | 12/2004 | Tao et al. |
| 6,830,540 | B2 | 12/2004 | Watterson |
| 6,830,542 | B2 | 12/2004 | Ball |
| 6,846,270 | B1 | 1/2005 | Etnyre |
| 6,852,068 | B2 | 2/2005 | Ogawa |
| 6,855,097 | B2 | 2/2005 | Krull |
| 6,857,993 | B2 | 2/2005 | Yeh |
| 6,860,131 | B2 | 3/2005 | Armstrong et al. |
| 6,860,836 | B1 | 3/2005 | Wu |
| 6,860,841 | B1 | 3/2005 | Mortorano |
| 6,872,173 | B2 | 3/2005 | Krull |
| 6,872,175 | B2 | 3/2005 | Lin |
| 6,875,160 | B2 | 4/2005 | Watterson et al. |
| 6,878,101 | B2 | 4/2005 | Colley |
| 6,886,645 | B2 | 5/2005 | Bise et al. |
| 6,893,381 | B2 | 5/2005 | Slawinski |
| 6,896,342 | B1 | 5/2005 | Cheng |
| 6,896,645 | B1 | 5/2005 | Krull |
| 6,899,657 | B2 | 5/2005 | Chuang |
| 6,899,661 | B1 | 5/2005 | Krull |
| 6,902,515 | B2 | 6/2005 | Howell et al. |
| 6,902,516 | B2 | 6/2005 | Krull |
| 6,905,446 | B2 | 6/2005 | Greenland |
| 6,908,418 | B2 | 6/2005 | Saure |
| 6,910,992 | B2 | 6/2005 | Arguilez |
| 6,913,562 | B2 | 7/2005 | Chen |
| 6,916,278 | B2 | 7/2005 | Webber |
| 6,918,859 | B1 | 7/2005 | Yeh |
| 6,918,861 | B2 | 7/2005 | Liao et al. |
| 6,921,354 | B1 | 7/2005 | Shifferaw |
| 6,921,355 | B2 | 7/2005 | Campanaro et al. |
| 6,923,748 | B1 | 8/2005 | Mauz |
| 6,923,749 | B1 | 8/2005 | Smith |
| 6,926,649 | B2 | 8/2005 | Slawinski |
| 6,929,589 | B1 | 8/2005 | Bruggemann et al. |
| 6,932,745 | B1 | 8/2005 | Ellis |
| 6,932,748 | B2 | 8/2005 | Huang |
| 6,941,620 | B1 | 9/2005 | Hinds |
| 6,945,916 | B2 | 9/2005 | Schroeder |
| 6,945,917 | B1 | 9/2005 | Baatz |
| 6,949,052 | B2 | 9/2005 | Millington |
| 6,960,156 | B2 | 11/2005 | Smith |
| 6,964,633 | B2 | 11/2005 | Kolda |
| 6,971,974 | B2 | 12/2005 | Bowman |
| 6,971,975 | B2 | 12/2005 | Croft |
| 6,971,978 | B2 | 12/2005 | Hyder |
| 6,974,404 | B1 | 12/2005 | Watterson et al. |
| 6,974,405 | B2 | 12/2005 | Krull |
| 6,976,941 | B2 | 12/2005 | Britt |
| 6,976,943 | B1 | 12/2005 | Hsiung |
| 6,979,283 | B2 | 12/2005 | Pan |
| 6,994,683 | B1 | 2/2006 | Starr |
| 6,997,856 | B1 | 2/2006 | Krull |
| 7,003,122 | B2 | 2/2006 | Chen |
| 7,004,887 | B2 | 2/2006 | Pan et al. |
| 7,008,356 | B2 | 3/2006 | Hung |
| 7,008,359 | B2 | 3/2006 | Fan et al. |
| 7,011,326 | B1 | 3/2006 | Schroeder et al. |
| 7,011,607 | B2 | 3/2006 | Kolda et al. |
| 7,011,609 | B1 | 3/2006 | Kuo |
| 7,011,610 | B2 | 3/2006 | Wawrzyniak |
| 7,011,611 | B1 | 3/2006 | Ripley |
| 7,014,598 | B2 | 3/2006 | Fenelon et al. |
| 7,014,599 | B2 | 3/2006 | Ashley |
| 7,025,713 | B2 | 4/2006 | Dalebout |

(56) References Cited

U.S. PATENT DOCUMENTS

| | | | |
|---|---|---|---|
| 7,029,425 | B2 | 4/2006 | Krull |
| 7,037,246 | B2 | 5/2006 | Kim |
| 7,041,041 | B1 | 5/2006 | Evans |
| 7,044,066 | B1 | 5/2006 | Miller |
| 7,044,897 | B2 | 5/2006 | Myers et al. |
| 7,048,638 | B2 | 5/2006 | Novotny |
| 7,048,677 | B2 | 5/2006 | Mackert |
| 7,052,444 | B2 | 5/2006 | Webber |
| 7,052,446 | B2 | 5/2006 | Morris et al. |
| 7,060,011 | B1 | 6/2006 | Krull |
| 7,060,012 | B2 | 6/2006 | Howell et al. |
| 7,066,867 | B2 | 6/2006 | Krull |
| 7,070,542 | B2 | 7/2006 | Reyes et al. |
| 7,070,545 | B2 | 7/2006 | Lull et al. |
| 7,073,417 | B2 | 7/2006 | Beauchamp |
| 7,077,791 | B2 | 7/2006 | Krull |
| 7,083,536 | B2 | 8/2006 | Lu et al. |
| 7,083,549 | B1 | 8/2006 | Fan |
| 7,083,554 | B1 | 8/2006 | Lo Presti |
| 7,087,000 | B1 | 8/2006 | Walker |
| 7,087,003 | B1 | 8/2006 | Katterjohn |
| 7,087,005 | B2 | 8/2006 | Rouillard |
| 7,090,625 | B2 | 8/2006 | Chermack |
| 7,094,183 | B2 | 8/2006 | Hsieh |
| 7,094,184 | B1 | 8/2006 | Chen et al. |
| 7,094,185 | B2 | 8/2006 | Greenland |
| 7,097,593 | B2 | 8/2006 | Chang |
| 7,097,601 | B1 | 8/2006 | Ronnow |
| 7,101,124 | B2 | 9/2006 | Keightley |
| 7,101,322 | B2 | 9/2006 | Carle |
| 7,108,636 | B1 | 9/2006 | Garcia |
| 7,108,641 | B2 | 9/2006 | Pertegaz-Esteban |
| 7,111,526 | B1 | 9/2006 | Flojo |
| 7,112,163 | B2 | 9/2006 | Krull |
| 7,113,166 | B1 | 9/2006 | Rosenberg et al. |
| 7,115,078 | B1 | 10/2006 | Kalember et al. |
| 7,115,080 | B2 | 10/2006 | Cockrill, Jr. et al. |
| 7,118,517 | B1 | 10/2006 | Hale |
| 7,121,980 | B2 | 10/2006 | Chen |
| 7,121,988 | B2 | 10/2006 | Walkerdine |
| 7,125,371 | B2 | 10/2006 | Henderson |
| 7,125,373 | B1 | 10/2006 | Garza |
| 7,128,696 | B1 | 10/2006 | Krull |
| 7,128,697 | B1 | 10/2006 | Krull |
| 7,128,701 | B1 | 10/2006 | Ketcham |
| 7,132,939 | B2 | 11/2006 | Tyndall et al. |
| 7,134,987 | B2 | 11/2006 | Goldstein |
| 7,137,644 | B2 | 11/2006 | Kimberley |
| 7,137,931 | B2 | 11/2006 | Liu |
| 7,137,932 | B2 | 11/2006 | Doudiet |
| 7,137,935 | B2 | 11/2006 | Clarke |
| 7,137,936 | B1 | 11/2006 | Shaw |
| 7,141,003 | B2 | 11/2006 | Wu |
| 7,141,008 | B2 | 11/2006 | Krull et al. |
| 7,150,168 | B1 | 12/2006 | Kuo |
| 7,153,244 | B2 | 12/2006 | Towley |
| 7,153,248 | B2 | 12/2006 | Chen |
| 7,156,782 | B1 | 1/2007 | Krull |
| 7,156,783 | B2 | 1/2007 | Chen |
| 7,163,488 | B2 | 1/2007 | Anders |
| 7,163,500 | B2 | 1/2007 | Endelman et al. |
| 7,166,062 | B1 | 1/2007 | Watterson et al. |
| 7,166,066 | B2 | 1/2007 | Webber |
| 7,166,067 | B2 | 1/2007 | Talish et al. |
| 7,169,093 | B2 | 1/2007 | Simonson et al. |
| 7,172,536 | B2 | 2/2007 | Liu |
| 7,172,538 | B2 | 2/2007 | Keiser |
| 7,178,637 | B2 | 2/2007 | Asano et al. |
| 7,179,208 | B1 | 2/2007 | Nalley |
| 7,179,209 | B2 | 2/2007 | Sechrest et al. |
| 7,179,212 | B2 | 2/2007 | Hsiung et al. |
| 7,189,190 | B2 | 3/2007 | Lamar et al. |
| 7,189,791 | B2 | 3/2007 | Solan |
| 7,192,387 | B2 | 3/2007 | Mendel |
| 7,192,388 | B2 | 3/2007 | Dalebout et al. |
| 7,192,389 | B2 | 3/2007 | Allison |
| 7,197,029 | B1 | 3/2007 | Osterhout et al. |
| 7,201,712 | B2 | 4/2007 | Tiahrt |
| 7,204,790 | B2 | 4/2007 | Sleamaker |
| 7,207,929 | B2 | 4/2007 | Hamilton |
| 7,207,930 | B2 | 4/2007 | Bonutti |
| 7,211,030 | B1 | 5/2007 | Cao |
| 7,214,170 | B2 | 5/2007 | Sumners |
| 7,220,220 | B2 | 5/2007 | Stubbs |
| 7,220,221 | B2 | 5/2007 | Mosimann et al. |
| 7,223,213 | B2 | 5/2007 | Golesh |
| 7,223,214 | B2 | 5/2007 | Chen |
| 7,223,215 | B2 | 5/2007 | Bastyr |
| 7,223,216 | B1 | 5/2007 | McBride |
| 7,226,402 | B1 | 6/2007 | Joya |
| 7,228,601 | B2 | 6/2007 | Thompson |
| 7,229,391 | B2 | 6/2007 | Francis |
| 7,232,404 | B2 | 6/2007 | Nelson |
| 7,238,143 | B1 | 7/2007 | Sokolovos |
| 7,238,147 | B2 | 7/2007 | Mills et al. |
| 7,244,217 | B2 | 7/2007 | Rodgers, Jr. |
| 7,247,128 | B2 | 7/2007 | Oga |
| 7,249,540 | B1 | 7/2007 | Hacker et al. |
| 7,250,021 | B2 | 7/2007 | Leight |
| 7,250,022 | B2 | 7/2007 | Dalebout |
| 7,255,665 | B2 | 8/2007 | Ish, III |
| 7,255,666 | B2 | 8/2007 | Cardenas |
| 7,261,678 | B2 | 8/2007 | Crawford et al. |
| 7,264,554 | B2 | 9/2007 | Bentley |
| 7,264,578 | B1 | 9/2007 | Krull |
| 7,270,628 | B2 | 9/2007 | Campanaro |
| 7,276,017 | B2 | 10/2007 | Lin |
| 7,276,018 | B2 | 10/2007 | Studdard |
| 7,278,958 | B2 | 10/2007 | Morgan |
| 7,278,966 | B2 | 10/2007 | Hjelt et al. |
| 7,282,016 | B2 | 10/2007 | Simonson |
| 7,284,466 | B1 | 10/2007 | Ho |
| 7,288,053 | B2 | 10/2007 | Endelman et al. |
| 7,290,760 | B1 | 11/2007 | Lindsay |
| 7,291,096 | B2 | 11/2007 | Ho |
| 7,291,098 | B1 | 11/2007 | Krull |
| 7,294,095 | B2 | 11/2007 | Charnitski |
| 7,294,100 | B2 | 11/2007 | Bull |
| 7,299,720 | B1 | 11/2007 | Schultz et al. |
| 7,300,390 | B1 | 11/2007 | Krull |
| 7,300,392 | B1 | 11/2007 | Curran |
| 7,309,303 | B1 | 12/2007 | Proctor |
| 7,311,640 | B2 | 12/2007 | Baatz |
| 7,311,644 | B2 | 12/2007 | Hale |
| 7,314,438 | B1 | 1/2008 | Clark et al. |
| 7,318,810 | B1 | 1/2008 | Benson |
| 7,322,219 | B2 | 1/2008 | Armstrong et al. |
| 7,322,906 | B2 | 1/2008 | Webber |
| 7,322,907 | B2 | 1/2008 | Bowser |
| 7,322,909 | B1 | 1/2008 | Loccarini |
| 7,329,212 | B2 | 2/2008 | Roque |
| 7,331,908 | B2 | 2/2008 | Olsen |
| 7,331,911 | B2 | 2/2008 | Webber et al. |
| 7,335,139 | B2 | 2/2008 | Bartholomew et al. |
| 7,335,140 | B2 | 2/2008 | Webber et al. |
| 7,335,141 | B2 | 2/2008 | Piane, Jr. |
| 7,335,142 | B2 | 2/2008 | Towley, III et al. |
| 7,341,545 | B2 | 3/2008 | Cao |
| 7,344,481 | B2 | 3/2008 | Watterson et al. |
| 7,344,488 | B2 | 3/2008 | Weck et al. |
| 7,351,187 | B2 | 4/2008 | Seliber |
| 7,357,758 | B2 | 4/2008 | Polk, III |
| 7,359,121 | B2 | 4/2008 | French et al. |
| 7,361,123 | B1 | 4/2008 | Krull |
| 7,361,125 | B2 | 4/2008 | Webber et al. |
| 7,361,127 | B2 | 4/2008 | Tremayne |
| 7,364,538 | B2 | 4/2008 | Aucamp |
| 7,367,926 | B2 | 5/2008 | Clark |
| 7,367,927 | B2 | 5/2008 | Krull |
| 7,370,498 | B1 | 5/2008 | Miao |
| 7,374,519 | B2 | 5/2008 | Naidus |
| 7,374,522 | B2 | 5/2008 | Arnold |
| 7,377,886 | B2 | 5/2008 | Wu |
| 7,381,161 | B2 | 6/2008 | Ellis |

(56) References Cited

U.S. PATENT DOCUMENTS

| | | | |
|---|---|---|---|
| 7,381,167 | B2 | 6/2008 | Duhamel |
| 7,384,013 | B2 | 6/2008 | Yen |
| 7,384,209 | B2 | 6/2008 | Muders et al. |
| 7,384,381 | B2 | 6/2008 | Webber et al. |
| 7,387,597 | B2 | 6/2008 | Krull |
| 7,387,867 | B2 | 6/2008 | Hasegawa et al. |
| 7,396,319 | B1 | 7/2008 | Ellis |
| 7,413,056 | B2 | 8/2008 | Gonzi et al. |
| 7,413,065 | B2 | 8/2008 | Gauthier |
| 7,413,530 | B2 | 8/2008 | Warner et al. |
| 7,413,532 | B1 | 8/2008 | Monsrud et al. |
| 7,413,533 | B2 | 8/2008 | Lin |
| 7,429,235 | B2 | 9/2008 | Lin |
| 7,429,236 | B2 | 9/2008 | Dalebout et al. |
| 7,435,202 | B2 | 10/2008 | Daly et al. |
| 7,438,673 | B1 | 10/2008 | Jones |
| 7,448,823 | B2 | 11/2008 | Silva |
| 7,455,621 | B1 | 11/2008 | Anthony |
| 7,455,626 | B2 | 11/2008 | Trevino et al. |
| 7,455,633 | B2 | 11/2008 | Brown et al. |
| 7,462,135 | B2 | 12/2008 | Lo |
| 7,462,141 | B1 | 12/2008 | Raboin et al. |
| 7,468,025 | B2 | 12/2008 | Hauser et al. |
| 7,473,211 | B2 | 1/2009 | Lee |
| 7,475,641 | B2 | 1/2009 | Jin |
| 7,475,900 | B2 | 1/2009 | Cheng |
| 7,476,182 | B2 | 1/2009 | Denisco |
| 7,476,186 | B1 | 1/2009 | Steffee |
| 7,478,794 | B1 | 1/2009 | Gohlke et al. |
| 7,482,050 | B2 | 1/2009 | Olson |
| 7,485,076 | B2 | 2/2009 | Lee |
| 7,485,077 | B2 | 2/2009 | Chen |
| 7,485,079 | B2 | 2/2009 | Brown et al. |
| 7,488,277 | B1 | 2/2009 | Knapp |
| 7,491,155 | B2 | 2/2009 | Fenelon et al. |
| 7,491,157 | B1 | 2/2009 | Lin |
| 7,491,159 | B2 | 2/2009 | Patterson |
| 7,494,450 | B2 | 2/2009 | Solomon |
| 7,497,814 | B1 | 3/2009 | Krull |
| 7,503,883 | B2 | 3/2009 | Madden |
| 7,507,186 | B2 | 3/2009 | Stearns |
| 7,507,189 | B2 | 3/2009 | Krull |
| 7,510,508 | B2 | 3/2009 | Santomassimo et al. |
| 7,517,303 | B2 | 4/2009 | Crawford et al. |
| 7,517,304 | B1 | 4/2009 | Swanson et al. |
| 7,520,845 | B2 | 4/2009 | Towley, III et al. |
| 7,524,272 | B2 | 4/2009 | Bruck et al. |
| 7,534,200 | B1 | 5/2009 | Martinez |
| 7,537,546 | B2 | 5/2009 | Watterson et al. |
| 7,537,549 | B2 | 5/2009 | Nelson et al. |
| 7,537,550 | B1 | 5/2009 | Krull |
| 7,537,551 | B2 | 5/2009 | Steffee |
| 7,537,552 | B2 | 5/2009 | Dalebout et al. |
| 7,540,828 | B2 | 6/2009 | Watterson et al. |
| 7,540,829 | B1 | 6/2009 | Chen |
| 7,540,832 | B2 | 6/2009 | Krull |
| 7,549,949 | B2 | 6/2009 | Webber et al. |
| 7,553,260 | B2 | 6/2009 | Piaget et al. |
| 7,553,262 | B2 | 6/2009 | Piane, Jr. |
| 7,553,264 | B2 | 6/2009 | Carter |
| 7,553,267 | B1 | 6/2009 | Hauser |
| 7,559,879 | B2 | 7/2009 | Anderson et al. |
| 7,563,203 | B2 | 7/2009 | Dalebout et al. |
| 7,563,208 | B1 | 7/2009 | Chen |
| 7,563,209 | B2 | 7/2009 | Webber et al. |
| 7,563,213 | B2 | 7/2009 | Grant |
| 7,563,214 | B2 | 7/2009 | Webber et al. |
| 7,569,004 | B2 | 8/2009 | Kolomeir |
| 7,569,005 | B2 | 8/2009 | Geeting |
| 7,571,517 | B2 | 8/2009 | Smith et al. |
| 7,575,537 | B2 | 8/2009 | Ellis |
| 7,575,538 | B1 | 8/2009 | Clark |
| 7,578,771 | B1 | 8/2009 | Towley, III et al. |
| 7,578,772 | B2 | 8/2009 | Lippitt |
| 7,584,673 | B2 | 9/2009 | Shimizu |
| 7,585,251 | B2 | 9/2009 | Doody, Jr. et al. |
| 7,585,254 | B1 | 9/2009 | Vittone |
| 7,585,262 | B1 | 9/2009 | Vayntraub |
| 7,585,263 | B2 | 9/2009 | Brown et al. |
| 7,588,520 | B2 | 9/2009 | Nalley |
| 7,591,763 | B1 | 9/2009 | Fucci |
| 7,591,773 | B2 | 9/2009 | Weir |
| 7,594,873 | B2 | 9/2009 | Terao et al. |
| 7,594,880 | B2 | 9/2009 | Webber |
| 7,594,881 | B2 | 9/2009 | Shifferaw |
| 7,597,656 | B2 | 10/2009 | Trees |
| 7,601,101 | B2 | 10/2009 | Jackson et al. |
| 7,601,105 | B1 | 10/2009 | Gipson, III et al. |
| 7,601,187 | B2 | 10/2009 | Webber |
| 7,604,572 | B2 | 10/2009 | Stanford |
| 7,604,576 | B2 | 10/2009 | Drechsler |
| 7,604,577 | B2 | 10/2009 | Lin |
| 7,604,578 | B2 | 10/2009 | Liu |
| 7,608,020 | B2 | 10/2009 | Mason |
| 7,608,021 | B1 | 10/2009 | Nalley |
| 7,608,023 | B2 | 10/2009 | Casagrande |
| 7,608,024 | B2 | 10/2009 | Sechrest et al. |
| 7,608,028 | B2 | 10/2009 | Pertegaz-Esteban |
| 7,611,445 | B2 | 11/2009 | Brown et al. |
| 7,611,448 | B2 | 11/2009 | Schiff |
| 7,611,450 | B2 | 11/2009 | Mancini |
| 7,614,981 | B2 | 11/2009 | Cao |
| 7,614,984 | B1 | 11/2009 | Krull |
| 7,618,346 | B2 | 11/2009 | Crawford et al. |
| 7,618,350 | B2 | 11/2009 | Dalebout et al. |
| 7,621,847 | B2 | 11/2009 | Lamle |
| 7,621,850 | B2 | 11/2009 | Piaget et al. |
| 7,621,855 | B1 | 11/2009 | Krull |
| 7,621,856 | B1 | 11/2009 | Keith |
| 7,621,858 | B2 | 11/2009 | Sheron |
| 7,624,956 | B2 | 12/2009 | Steigert et al. |
| 7,624,967 | B1 | 12/2009 | Doebler et al. |
| 7,625,033 | B2 | 12/2009 | Michelau et al. |
| 7,625,314 | B2 | 12/2009 | Ungari |
| 7,625,319 | B2 | 12/2009 | Kang et al. |
| 7,625,321 | B2 | 12/2009 | Simonson et al. |
| 7,625,322 | B1 | 12/2009 | Krull |
| 7,625,323 | B1 | 12/2009 | Lin |
| 7,628,730 | B1 | 12/2009 | Watterson et al. |
| 7,628,737 | B2 | 12/2009 | Kowallis et al. |
| 7,628,743 | B1 | 12/2009 | Flentye et al. |
| 7,632,221 | B1 | 12/2009 | Kolander |
| 7,637,847 | B1 | 12/2009 | Hickman |
| 7,637,855 | B2 | 12/2009 | Bizzell |
| 7,641,598 | B2 | 1/2010 | Rodgers, Jr. |
| 7,645,212 | B2 | 1/2010 | Ashby et al. |
| 7,645,215 | B2 | 1/2010 | Gordon |
| 7,645,216 | B2 | 1/2010 | Edeker |
| 7,645,218 | B2 | 1/2010 | Potok et al. |
| 7,645,221 | B1 | 1/2010 | Curry |
| 7,648,446 | B2 | 1/2010 | Chiles et al. |
| 7,651,442 | B2 | 1/2010 | Carlson |
| 7,651,450 | B2 | 1/2010 | Wehrell |
| 7,654,940 | B2 | 2/2010 | Webber et al. |
| 7,654,941 | B2 | 2/2010 | Lacher |
| 7,658,698 | B2 | 2/2010 | Pacheco et al. |
| 7,662,075 | B2 | 2/2010 | Isom |
| 7,666,123 | B2 | 2/2010 | Giannelli |
| 7,670,269 | B2 | 3/2010 | Webber et al. |
| 7,670,270 | B2 | 3/2010 | Alessandri et al. |
| 7,674,185 | B2 | 3/2010 | Omidi |
| 7,674,205 | B2 | 3/2010 | Dalebout et al. |
| 7,674,216 | B1 | 3/2010 | Bolling |
| 7,678,033 | B2 | 3/2010 | Tyree |
| 7,682,287 | B1 | 3/2010 | Hsieh |
| 7,691,033 | B2 | 4/2010 | Rolli |
| 7,691,041 | B2 | 4/2010 | Abdo |
| 7,691,042 | B2 | 4/2010 | Pandozy |
| 7,695,409 | B2 | 4/2010 | Decathlon |
| 7,695,414 | B2 | 4/2010 | Tiahrt |
| 7,704,195 | B2 | 4/2010 | Alessandri et al. |
| 7,704,197 | B2 | 4/2010 | Yu |
| 7,708,668 | B2 | 5/2010 | Rodgers, Jr. |
| 7,708,672 | B2 | 5/2010 | Gibson et al. |

(56) References Cited

U.S. PATENT DOCUMENTS

| | | | |
|---|---|---|---|
| 7,717,827 | B2 | 5/2010 | Kurunmäki et al. |
| 7,717,828 | B2 | 5/2010 | Simonson et al. |
| 7,717,832 | B2 | 5/2010 | Webber et al. |
| 7,717,833 | B1 | 5/2010 | Nelson et al. |
| 7,722,509 | B2 | 5/2010 | Eder |
| 7,722,513 | B2 | 5/2010 | Habing |
| 7,730,588 | B1 | 6/2010 | Bernier |
| 7,736,279 | B2 | 6/2010 | Dalebout et al. |
| 7,736,283 | B2 | 6/2010 | Webb |
| 7,736,286 | B2 | 6/2010 | Panaiotov |
| 7,740,563 | B2 | 6/2010 | Dalebout et al. |
| 7,740,568 | B2 | 6/2010 | Webb |
| 7,740,570 | B2 | 6/2010 | Winston |
| 7,749,140 | B1 | 7/2010 | Lindemeier et al. |
| 7,758,469 | B2 | 7/2010 | Dyer et al. |
| 7,758,477 | B2 | 7/2010 | Prenatt |
| 7,758,478 | B2 | 7/2010 | Golesh et al. |
| 7,762,932 | B2 | 7/2010 | Hetrick |
| 7,762,934 | B1 | 7/2010 | Munson, Jr. et al. |
| 7,762,935 | B2 | 7/2010 | Doble |
| 7,764,641 | B2 | 7/2010 | Pelton et al. |
| 7,766,793 | B2 | 8/2010 | Hashimoto |
| 7,766,797 | B2 | 8/2010 | Dalebout |
| 7,766,802 | B2 | 8/2010 | Webber et al. |
| 7,771,319 | B1 | 8/2010 | Spoeth, Jr. et al. |
| 7,771,320 | B2 | 8/2010 | Riley et al. |
| 7,771,325 | B2 | 8/2010 | Baker |
| 7,771,329 | B2 | 8/2010 | Dalebout et al. |
| 7,771,330 | B2 | 8/2010 | Towley |
| 7,775,936 | B2 | 8/2010 | Wilkinson |
| 7,775,943 | B2 | 8/2010 | Vittone |
| 7,775,945 | B2 | 8/2010 | Smith |
| 7,775,949 | B2 | 8/2010 | Bowser |
| 7,775,952 | B1 | 8/2010 | Curran et al. |
| 7,775,953 | B2 | 8/2010 | Wang |
| 7,780,578 | B2 | 8/2010 | Packham |
| 7,780,583 | B2 | 8/2010 | Brown |
| 7,780,585 | B1 | 8/2010 | Rivas |
| 7,789,806 | B2 | 9/2010 | Yang |
| 7,789,816 | B2 | 9/2010 | Krietzman |
| 7,794,371 | B2 | 9/2010 | Webber et al. |
| 7,798,946 | B2 | 9/2010 | Dalebout et al. |
| 7,803,096 | B2 | 9/2010 | Mehta |
| 7,806,815 | B2 | 10/2010 | Fernandez |
| 7,811,202 | B2 | 10/2010 | Planke |
| 7,811,213 | B2 | 10/2010 | Chen |
| 7,815,548 | B2 | 10/2010 | Barre et al. |
| 7,815,549 | B2 | 10/2010 | Crawford et al. |
| 7,815,552 | B2 | 10/2010 | Dibble et al. |
| 7,815,554 | B2 | 10/2010 | Gibson et al. |
| 7,819,784 | B1 | 10/2010 | Caswell et al. |
| 7,819,785 | B2 | 10/2010 | Maiaro et al. |
| 7,828,703 | B1 | 11/2010 | Boesch |
| 7,833,135 | B2 | 11/2010 | Radow |
| 7,833,138 | B1 | 11/2010 | Fulks |
| 7,833,141 | B2 | 11/2010 | Kulka |
| 7,837,598 | B1 | 11/2010 | Boozel, Jr. |
| 7,837,602 | B1 | 11/2010 | Drybread |
| 7,837,603 | B1 | 11/2010 | Carnell, Sr. |
| 7,841,971 | B2 | 11/2010 | Smith |
| 7,841,973 | B2 | 11/2010 | Trancart |
| 7,842,038 | B2 | 11/2010 | Haddock et al. |
| 7,850,584 | B2 | 12/2010 | Uygan |
| 7,857,736 | B2 | 12/2010 | Merrithew et al. |
| 7,862,483 | B2 | 1/2011 | Hendrickson et al. |
| 7,862,486 | B1 | 1/2011 | Watson |
| 7,862,487 | B2 | 1/2011 | Olson |
| 7,862,489 | B2 | 1/2011 | Savšek et al. |
| 7,867,153 | B2 | 1/2011 | Roman |
| 7,871,355 | B2 | 1/2011 | Yeh |
| 7,871,357 | B2 | 1/2011 | Gibson et al. |
| 7,874,957 | B2 | 1/2011 | Hurwitz et al. |
| 7,874,961 | B2 | 1/2011 | McKee et al. |
| 7,874,971 | B2 | 1/2011 | Reyes |
| 7,878,950 | B1 | 2/2011 | Bastian |
| 7,878,953 | B2 | 2/2011 | Webber et al. |
| 7,883,445 | B2 | 2/2011 | Olrik et al. |
| 7,887,468 | B2 | 2/2011 | Ross et al. |
| 7,887,469 | B1 | 2/2011 | Chen |
| 7,887,470 | B2 | 2/2011 | Chen |
| 7,887,471 | B2 | 2/2011 | McSorley |
| 7,892,149 | B2 | 2/2011 | Wu |
| 7,892,150 | B1 | 2/2011 | Colley |
| 7,892,155 | B2 | 2/2011 | Pearson et al. |
| 7,892,159 | B2 | 2/2011 | McVay et al. |
| 7,896,782 | B2 | 3/2011 | Tamari |
| 7,900,324 | B2 | 3/2011 | Ginocchio |
| 7,901,324 | B2 | 3/2011 | Kodama |
| 7,901,335 | B2 | 3/2011 | Webber et al. |
| 7,905,819 | B2 | 3/2011 | Alessandri et al. |
| 7,909,741 | B2 | 3/2011 | Kim et al. |
| 7,909,742 | B2 | 3/2011 | Ish, III et al. |
| 7,909,743 | B1 | 3/2011 | Webber |
| 7,909,745 | B2 | 3/2011 | Mills et al. |
| 7,918,769 | B2 | 4/2011 | Lamarque |
| 7,922,621 | B1 | 4/2011 | Hamada et al. |
| 7,922,631 | B2 | 4/2011 | Ish, III |
| 7,922,632 | B2 | 4/2011 | Chou |
| 7,922,633 | B2 | 4/2011 | Januszek |
| 7,922,635 | B2 | 4/2011 | Lull et al. |
| 7,927,257 | B2 | 4/2011 | Patel |
| 7,931,563 | B2 | 4/2011 | Shaw et al. |
| 7,931,570 | B2 | 4/2011 | Hoffman |
| 7,935,026 | B2 | 5/2011 | McSorley |
| 7,935,032 | B1 | 5/2011 | Jackson |
| 7,935,038 | B2 | 5/2011 | Tyree |
| 7,938,760 | B1 | 5/2011 | Webber et al. |
| 7,938,761 | B2 | 5/2011 | Simonson |
| 7,942,788 | B2 | 5/2011 | Wu |
| 7,942,793 | B2 | 5/2011 | Mills et al. |
| 7,946,968 | B2 | 5/2011 | Kjellberg |
| 7,955,235 | B2 | 6/2011 | Keiser |
| 7,963,890 | B2 | 6/2011 | Webber et al. |
| 7,963,892 | B2 | 6/2011 | Poblete Castro et al. |
| 7,967,734 | B1 | 6/2011 | Damian |
| 7,976,440 | B2 | 7/2011 | Webber et al. |
| 7,976,443 | B2 | 7/2011 | Krull |
| 7,976,445 | B2 | 7/2011 | Lalaoua |
| 7,980,996 | B2 | 7/2011 | Hickman |
| 7,981,010 | B1 | 7/2011 | Webber et al. |
| 7,981,011 | B1 | 7/2011 | Batca |
| 7,981,012 | B1 | 7/2011 | Krull |
| 7,981,013 | B2 | 7/2011 | Krull |
| 7,985,167 | B2 | 7/2011 | Nizam |
| 7,988,598 | B2 | 8/2011 | Trzecieski |
| 7,988,600 | B2 | 8/2011 | Rodgers, Jr. |
| 7,988,604 | B2 | 8/2011 | Barnett |
| 7,988,605 | B1 | 8/2011 | Wyeroski |
| 7,993,251 | B1 | 8/2011 | Webber et al. |
| 7,998,036 | B2 | 8/2011 | Ish, III |
| 7,998,038 | B2 | 8/2011 | Keiser |
| 7,998,042 | B2 | 8/2011 | Bowser et al. |
| 8,001,472 | B2 | 8/2011 | Gilley et al. |
| 8,002,678 | B1 | 8/2011 | Krull |
| 8,006,711 | B2 | 8/2011 | Pietrzak et al. |
| 8,007,409 | B2 | 8/2011 | Elllis |
| 8,007,413 | B1 | 8/2011 | Wu |
| 8,007,415 | B1 | 8/2011 | Lundquist |
| 8,007,416 | B2 | 8/2011 | Arlie |
| 8,007,422 | B2 | 8/2011 | Zaccherini |
| 8,012,071 | B2 | 9/2011 | Grisdale |
| 8,012,073 | B2 | 9/2011 | Barnett |
| 8,021,277 | B2 | 9/2011 | Baudhuin |
| 8,021,285 | B2 | 9/2011 | Kushnir |
| 8,025,608 | B2 | 9/2011 | Popescu |
| 8,025,613 | B1 | 9/2011 | Wang |
| 8,029,415 | B2 | 10/2011 | Ashby et al. |
| 8,029,425 | B2 | 10/2011 | Bronston et al. |
| 8,033,960 | B1 | 10/2011 | Dalebout et al. |
| 8,033,965 | B1 | 10/2011 | Krull |
| 8,033,967 | B2 | 10/2011 | Canali |
| 8,043,198 | B2 | 10/2011 | Zhou |
| 8,047,970 | B2 | 11/2011 | Nalley |
| 8,052,584 | B2 | 11/2011 | Keiser |

(56) References Cited

U.S. PATENT DOCUMENTS

| | | | |
|---|---|---|---|
| 8,056,687 | B2 | 11/2011 | Golden et al. |
| 8,057,361 | B2 | 11/2011 | McBride et al. |
| 8,057,367 | B2 | 11/2011 | Giannelli et al. |
| 8,057,368 | B1 | 11/2011 | Lyszczarz |
| 8,070,657 | B2 | 12/2011 | Loach |
| 8,070,658 | B2 | 12/2011 | Giannelli et al. |
| 8,072,902 | B2 | 12/2011 | Moon |
| 8,075,453 | B1 | 12/2011 | Wilkinson |
| 8,079,273 | B2 | 12/2011 | Svenberg |
| 8,079,941 | B2 | 12/2011 | Nortje |
| 8,092,351 | B1 | 1/2012 | Rodgers, Jr. |
| 8,096,926 | B1 | 1/2012 | Batca |
| 8,103,379 | B2 | 1/2012 | Biba et al. |
| 8,104,987 | B2 | 1/2012 | Johnson |
| 8,106,563 | B2 | 1/2012 | Ritchey |
| 8,109,864 | B2 | 2/2012 | Tseng |
| 8,111,166 | B2 | 2/2012 | Flexer et al. |
| 8,113,994 | B2 | 2/2012 | Piaget et al. |
| 8,128,537 | B2 | 3/2012 | Signorile et al. |
| 8,142,370 | B2 | 3/2012 | Weinberg et al. |
| 8,147,386 | B2 | 4/2012 | Farnsworth et al. |
| 8,152,702 | B2 | 4/2012 | Pacheco |
| 8,167,899 | B2 | 5/2012 | Justis et al. |
| 8,172,729 | B2 | 5/2012 | Ellis |
| 8,173,087 | B2 | 5/2012 | Wei et al. |
| 8,177,693 | B2 | 5/2012 | Webber et al. |
| 8,182,399 | B2 | 5/2012 | Davis et al. |
| 8,192,332 | B2 | 6/2012 | Baker et al. |
| 8,192,337 | B2 | 6/2012 | Birch |
| 8,197,392 | B2 | 6/2012 | Silverman et al. |
| 8,200,323 | B2 | 6/2012 | Dibenedetto et al. |
| 8,206,274 | B2 | 6/2012 | Svenberg et al. |
| 8,210,995 | B2 | 7/2012 | Reyes |
| 8,212,445 | B2 | 7/2012 | Ritchey |
| 8,215,886 | B2 | 7/2012 | Campbell |
| 8,221,295 | B2 | 7/2012 | Wilkins |
| 8,235,724 | B2 | 8/2012 | Gilley et al. |
| 8,235,876 | B2 | 8/2012 | Reyes |
| 8,241,187 | B2 | 8/2012 | Moon et al. |
| 8,249,714 | B1 | 8/2012 | Hartman et al. |
| 8,251,877 | B2 | 8/2012 | Rasmussen et al. |
| 8,262,546 | B1 | 9/2012 | Lashinske |
| 8,272,996 | B2 | 9/2012 | Weier |
| 8,286,954 | B2 | 10/2012 | Zheng |
| 8,287,434 | B2 | 10/2012 | Zavadsky et al. |
| 8,298,125 | B2 | 10/2012 | Colledge et al. |
| 8,303,472 | B2 | 11/2012 | Bowser |
| 8,308,620 | B2 | 11/2012 | Lyszczarz |
| 8,309,870 | B2 | 11/2012 | Peterson et al. |
| 8,315,636 | B2 | 11/2012 | Moon et al. |
| 8,317,659 | B2 | 11/2012 | Woodson |
| 8,323,156 | B2 | 12/2012 | Ozawa et al. |
| 8,323,157 | B2 | 12/2012 | Campanaro et al. |
| 8,323,159 | B2 | 12/2012 | Perry |
| 8,348,811 | B2 | 1/2013 | Kamins |
| 8,359,954 | B2 | 1/2013 | Johnson et al. |
| 8,360,935 | B2 | 1/2013 | Olsen et al. |
| 8,376,911 | B2 | 2/2013 | Ogg et al. |
| 8,394,004 | B2 | 3/2013 | Towley, III |
| 8,398,529 | B2 | 3/2013 | Ellis |
| 8,429,223 | B2 | 4/2013 | Gilley et al. |
| 8,444,537 | B1 | 5/2013 | Santoro |
| 8,454,437 | B2 | 6/2013 | Dugan |
| 8,454,483 | B1 | 6/2013 | Bradley et al. |
| 8,470,190 | B2 | 6/2013 | Jeanne et al. |
| 8,475,338 | B2 | 7/2013 | Greenhill et al. |
| 8,485,576 | B2 | 7/2013 | Melville et al. |
| 8,485,946 | B2 | 7/2013 | Ross et al. |
| 8,485,947 | B2 | 7/2013 | Nizam |
| 8,485,950 | B2 | 7/2013 | Adams |
| 8,485,953 | B2 | 7/2013 | Chou |
| 8,485,996 | B2 | 7/2013 | Bluman |
| 8,500,607 | B2 | 8/2013 | Vittone |
| 8,500,608 | B1 | 8/2013 | Bonomi |
| 8,506,370 | B2 | 8/2013 | Homsi |
| 8,506,459 | B2 | 8/2013 | Cassidy et al. |
| 8,512,212 | B2 | 8/2013 | Ish, III |
| 8,517,895 | B2 | 8/2013 | Shalev |
| 8,517,899 | B2 | 8/2013 | Zhou |
| 8,523,743 | B1 | 9/2013 | Miles et al. |
| 8,523,789 | B2 | 9/2013 | Keiser |
| 8,529,414 | B2 | 9/2013 | Hobson |
| 8,529,415 | B2 | 9/2013 | Svenberg |
| 8,535,204 | B2 | 9/2013 | Stacey |
| 8,540,560 | B2 | 9/2013 | Crowley et al. |
| 8,540,607 | B2 | 9/2013 | Kissel et al. |
| 8,550,964 | B2 | 10/2013 | Ish, III et al. |
| 8,556,216 | B2 | 10/2013 | Bandera |
| 8,556,780 | B2 | 10/2013 | Chen |
| 8,562,496 | B2 | 10/2013 | Webber et al. |
| 8,568,279 | B2 | 10/2013 | Golesh |
| 8,568,280 | B2 | 10/2013 | Mendoza |
| 8,568,281 | B2 | 10/2013 | Beaulieu et al. |
| 8,572,764 | B2 | 11/2013 | Thellmann |
| 8,572,820 | B2 | 11/2013 | Richards |
| 8,573,572 | B2 | 11/2013 | Bowen et al. |
| 8,585,561 | B2 | 11/2013 | Watt et al. |
| 8,588,476 | B1 | 11/2013 | Spicola, Jr. |
| 8,590,120 | B2 | 11/2013 | Sakai |
| 8,591,386 | B2 | 11/2013 | Meyer |
| 8,591,387 | B2 | 11/2013 | Fife |
| 8,602,951 | B2 | 12/2013 | Morris |
| 8,607,562 | B2 | 12/2013 | Browne |
| 8,613,689 | B2 | 12/2013 | Dyer et al. |
| 8,631,544 | B1 | 1/2014 | Shotey et al. |
| 8,647,239 | B1 | 2/2014 | Sokolovas |
| 8,668,630 | B2 | 3/2014 | Towley, III |
| 8,678,897 | B2 | 3/2014 | Englert et al. |
| 8,690,578 | B1 | 4/2014 | Nusbaum et al. |
| 8,690,735 | B2 | 4/2014 | Watterson et al. |
| 8,690,740 | B2 | 4/2014 | Yu |
| 8,696,527 | B2 | 4/2014 | Wu |
| 8,702,574 | B2 | 4/2014 | Abranchess |
| 8,708,870 | B2 | 4/2014 | Nalley |
| 8,708,872 | B2 | 4/2014 | Giannelli et al. |
| 8,715,140 | B1 | 5/2014 | Gertz |
| 8,715,143 | B2 | 5/2014 | Svenberg |
| 8,721,507 | B2 | 5/2014 | Blancher |
| 8,734,302 | B2 | 5/2014 | Hsieh |
| 8,734,304 | B2 | 5/2014 | Webber et al. |
| 8,734,308 | B1 | 5/2014 | Joslin |
| 8,740,753 | B2 | 6/2014 | Olson et al. |
| 8,758,201 | B2 | 6/2014 | Ashby et al. |
| 8,764,609 | B1 | 7/2014 | Elahmadie |
| 8,771,153 | B2 | 7/2014 | Dalebout et al. |
| 8,771,154 | B2 | 7/2014 | Fedriga |
| 8,777,820 | B2 | 7/2014 | Lo |
| 8,777,822 | B2 | 7/2014 | Agostini |
| 8,784,275 | B2 | 7/2014 | Mikan et al. |
| 8,784,286 | B2 | 7/2014 | Reyes |
| 8,801,581 | B2 | 8/2014 | Lai et al. |
| 8,814,754 | B2 | 8/2014 | Weast et al. |
| 8,815,189 | B2 | 8/2014 | Arnold et al. |
| 8,821,354 | B1 | 9/2014 | Tabahi |
| 8,821,359 | B1 | 9/2014 | Kassel |
| 8,821,870 | B2 | 9/2014 | Robinson et al. |
| 8,827,874 | B2 | 9/2014 | Nishimura |
| 8,827,879 | B2 | 9/2014 | Nicholas |
| 8,840,075 | B2 | 9/2014 | Olson |
| 8,840,569 | B2 | 9/2014 | Flaction et al. |
| 8,845,497 | B2 | 9/2014 | Turner |
| 8,845,498 | B2 | 9/2014 | Webb |
| 8,845,499 | B1 | 9/2014 | Boatwright |
| 8,858,397 | B2 | 10/2014 | Ishii |
| 8,858,409 | B2 | 10/2014 | Trees |
| 8,870,720 | B1 | 10/2014 | Webber et al. |
| 8,870,726 | B2 | 10/2014 | Watterson et al. |
| 8,876,131 | B1 | 11/2014 | Gomes |
| 8,876,674 | B2 | 11/2014 | Webb et al. |
| 8,888,660 | B1 | 11/2014 | Oteman |
| 8,917,273 | B2 | 12/2014 | Hoebel |
| 8,920,291 | B2 | 12/2014 | Chen et al. |
| 8,926,479 | B2 | 1/2015 | Chen et al. |
| 8,932,188 | B2 | 1/2015 | Svenberg |

(56) References Cited

U.S. PATENT DOCUMENTS

| | | | |
|---|---|---|---|
| 8,939,831 | B2 | 1/2015 | Dugan |
| 8,956,290 | B2 | 2/2015 | Gilley et al. |
| 8,968,155 | B2 | 3/2015 | Bird |
| 8,968,162 | B2 | 3/2015 | Jaguan |
| 8,968,164 | B2 | 3/2015 | Giannelli |
| 8,979,709 | B2 | 3/2015 | Toback et al. |
| 8,990,045 | B2 | 3/2015 | Zhu et al. |
| 8,992,392 | B2 | 3/2015 | Giannelli et al. |
| 8,992,393 | B2 | 3/2015 | Reyes |
| 9,008,973 | B2 | 4/2015 | French |
| 9,010,222 | B2 | 4/2015 | Peirce |
| 9,011,156 | B2 | 4/2015 | Hallmark |
| 9,011,291 | B2 | 4/2015 | Birrell |
| 9,011,299 | B2 | 4/2015 | Lien |
| 9,011,301 | B2 | 4/2015 | Balandis |
| 9,017,230 | B1 | 4/2015 | Pitts |
| 9,022,906 | B1 | 5/2015 | Nelson |
| 9,022,907 | B2 | 5/2015 | Wang |
| 9,028,368 | B2 | 5/2015 | Ashby et al. |
| 9,028,381 | B2 | 5/2015 | Mestemaker |
| 9,038,218 | B1 | 5/2015 | Heil et al. |
| 9,038,549 | B1 | 5/2015 | Zebarjad |
| 9,044,635 | B2 | 6/2015 | Lull |
| 9,050,497 | B2 | 6/2015 | Reyes |
| 9,050,498 | B2 | 6/2015 | Lu et al. |
| 9,072,930 | B2 | 7/2015 | Ashby et al. |
| 9,078,708 | B2 | 7/2015 | Haas |
| 9,079,068 | B2 | 7/2015 | Muehl |
| 9,114,273 | B2 | 8/2015 | Kehoe |
| 9,114,275 | B2 | 8/2015 | Lu et al. |
| 9,125,620 | B2 | 9/2015 | Walke |
| 9,126,072 | B2 | 9/2015 | Watterson |
| 9,126,076 | B2 | 9/2015 | Liang |
| 9,132,051 | B2 | 9/2015 | Heil |
| 9,132,330 | B2 | 9/2015 | Brendle |
| 9,135,347 | B2 | 9/2015 | Damman et al. |
| 9,138,607 | B2 | 9/2015 | Miranda |
| 9,138,612 | B2 | 9/2015 | Breaux |
| 9,138,614 | B2 | 9/2015 | Lu et al. |
| 9,138,615 | B2 | 9/2015 | Olson et al. |
| 9,144,703 | B2 | 9/2015 | Dalebout et al. |
| 9,144,709 | B2 | 9/2015 | Reich |
| 9,162,102 | B1 | 10/2015 | Eder et al. |
| 9,162,104 | B1 | 10/2015 | Lee |
| 9,168,414 | B2 | 10/2015 | Liu et al. |
| 9,174,085 | B2 | 11/2015 | Foley |
| 9,186,552 | B1 | 11/2015 | Deal |
| 9,192,800 | B1 | 11/2015 | Meyer et al. |
| 9,211,431 | B2 | 12/2015 | Hornback et al. |
| 9,227,101 | B2 | 1/2016 | Maguire |
| 9,248,329 | B2 | 2/2016 | Heideman |
| 9,254,409 | B2 | 2/2016 | Dalebout et al. |
| 9,259,633 | B2 | 2/2016 | Meyers |
| 9,265,984 | B2 | 2/2016 | Huber |
| 9,272,186 | B2 | 3/2016 | Reich |
| 9,283,429 | B2 | 3/2016 | Aragones et al. |
| 9,289,644 | B2 | 3/2016 | Carson |
| 9,292,935 | B2 | 3/2016 | Koduri et al. |
| 9,295,302 | B1 | 3/2016 | Reed et al. |
| 9,298,886 | B2 | 3/2016 | Homsi |
| 9,302,139 | B2 | 4/2016 | Habing et al. |
| 9,308,409 | B2 | 4/2016 | Beaver |
| 9,308,410 | B2 | 4/2016 | Beaver |
| 9,308,417 | B2 | 4/2016 | Grundy |
| 9,314,658 | B2 | 4/2016 | Kaye |
| 9,314,659 | B2 | 4/2016 | Gvoich |
| 9,314,666 | B2 | 4/2016 | Canavan et al. |
| 9,320,457 | B2 | 4/2016 | Flaction et al. |
| 9,320,935 | B1 | 4/2016 | Paris |
| 9,320,938 | B1 | 4/2016 | Belmore |
| 9,320,940 | B2 | 4/2016 | Rainey |
| 9,327,159 | B1 | 5/2016 | Medina |
| 9,333,388 | B2 | 5/2016 | Lee et al. |
| 9,339,681 | B1 | 5/2016 | Nalley |
| 9,339,682 | B2 | 5/2016 | Braier et al. |
| 9,339,692 | B2 | 5/2016 | Hashish |
| 9,352,181 | B2 | 5/2016 | O'Neil |
| 9,358,414 | B2 | 6/2016 | Dephouse |
| 9,358,426 | B2 | 6/2016 | Aragones et al. |
| 9,364,703 | B1 | 6/2016 | Kuka |
| 9,364,706 | B2 | 6/2016 | Lo |
| 9,364,712 | B2 | 6/2016 | Wu |
| 9,364,714 | B2 | 6/2016 | Koduri et al. |
| 9,375,602 | B2 | 6/2016 | Krull |
| 9,378,336 | B2 | 6/2016 | Ohnemus et al. |
| 9,387,355 | B1 | 7/2016 | Joya |
| 9,387,357 | B2 | 7/2016 | Mueller |
| 9,393,453 | B2 | 7/2016 | Watterson |
| 9,403,047 | B2 | 8/2016 | Olson |
| 9,403,048 | B2 | 8/2016 | Balandis |
| 9,409,047 | B2 | 8/2016 | Kamenskikh |
| 9,409,050 | B2 | 8/2016 | Mintz |
| 9,415,257 | B2 | 8/2016 | Habing |
| 9,427,611 | B1 | 8/2016 | Balentine |
| 9,457,219 | B2 | 10/2016 | Smith |
| 9,457,220 | B2 | 10/2016 | Olson |
| 9,463,345 | B2 | 10/2016 | Simonetti |
| 9,468,792 | B2 | 10/2016 | Simonetti |
| 9,468,793 | B2 | 10/2016 | Salmon |
| 9,474,666 | B1 | 10/2016 | Smith |
| 9,498,128 | B2 | 11/2016 | Eslami et al. |
| 9,498,666 | B1 | 11/2016 | Pryor et al. |
| 9,498,668 | B2 | 11/2016 | Muller et al. |
| 9,506,528 | B2 | 11/2016 | Tucker et al. |
| 9,506,529 | B2 | 11/2016 | Tucker et al. |
| 9,511,254 | B2 | 12/2016 | Netter |
| 9,521,901 | B2 | 12/2016 | Dalebout |
| 9,526,937 | B2 | 12/2016 | Uygan |
| 9,539,458 | B1 | 1/2017 | Ross |
| 9,539,461 | B2 | 1/2017 | Ercanbrack |
| 9,545,540 | B1 | 1/2017 | Moschel |
| 9,550,091 | B2 | 1/2017 | Emerson |
| 9,555,278 | B2 | 1/2017 | Kaye et al. |
| 9,555,280 | B2 | 1/2017 | Kaye et al. |
| 9,593,992 | B2 | 3/2017 | Wu |
| 9,604,089 | B2 | 3/2017 | Cervone et al. |
| 9,604,092 | B2 | 3/2017 | Krull |
| 9,610,475 | B1 | 4/2017 | Deknock et al. |
| 9,616,274 | B2 | 4/2017 | Wehrell |
| 9,616,284 | B1 | 4/2017 | Aganyan |
| 9,616,292 | B2 | 4/2017 | Orfield |
| 9,623,285 | B1 | 4/2017 | Ruiz |
| 9,630,048 | B2 | 4/2017 | Kaye et al. |
| 9,636,539 | B1 | 5/2017 | Brumit |
| 9,636,540 | B2 | 5/2017 | Mueller et al. |
| 9,643,042 | B2 | 5/2017 | Madden |
| 9,649,524 | B2 | 5/2017 | Giunchi |
| 9,656,115 | B2 | 5/2017 | Young |
| 9,656,144 | B2 | 5/2017 | Jafarifesharaki |
| 9,656,591 | B1 | 5/2017 | Dumenigo |
| 9,665,046 | B2 | 5/2017 | Aoto et al. |
| 9,669,261 | B2 | 6/2017 | Eder |
| 9,675,836 | B2 | 6/2017 | Babon |
| 9,682,267 | B2 | 6/2017 | Kaye et al. |
| 9,682,307 | B2 | 6/2017 | Dalebout |
| 9,687,689 | B2 | 6/2017 | Lin |
| 9,692,276 | B2 | 6/2017 | Oteman et al. |
| 9,700,752 | B1 | 7/2017 | Powers |
| 9,700,753 | B1 | 7/2017 | Boatwright |
| 9,707,435 | B1 | 7/2017 | Ferlito et al. |
| 9,720,912 | B2 | 8/2017 | Morimoto et al. |
| 9,723,381 | B2 | 8/2017 | Swanson |
| 9,724,553 | B2 | 8/2017 | Kaye et al. |
| 9,724,563 | B2 | 8/2017 | Schmidt |
| 9,731,157 | B2 | 8/2017 | Loach |
| 9,731,158 | B1 | 8/2017 | Lo |
| 9,734,477 | B2 | 8/2017 | Weast et al. |
| 9,750,454 | B2 | 9/2017 | Walke et al. |
| 9,757,605 | B2 | 9/2017 | Olson et al. |
| 9,757,611 | B1 | 9/2017 | Colburn |
| 9,764,188 | B1 | 9/2017 | Aganyan |
| 9,776,032 | B2 | 10/2017 | Moran et al. |
| 9,795,818 | B2 | 10/2017 | Powell |
| 9,795,819 | B2 | 10/2017 | Wehrell |

(56) References Cited

U.S. PATENT DOCUMENTS 9,795,822 B2 10/2017 Smith et al.
9,795,827 B2 10/2017 Wiener et al.
9,795,855 B2 10/2017 Jafarifesharaki
9,802,072 B2 10/2017 Wehrell
9,802,075 B2 10/2017 Gvoich
9,814,920 B1 11/2017 Monterrey
9,814,922 B2 11/2017 Moran et al.
9,814,930 B2 11/2017 Manzke et al.
9,833,654 B1 12/2017 Gant
9,839,804 B2 12/2017 Werner
9,841,077 B2 12/2017 Modrezejewski et al.
9,868,006 B1 1/2018 Epler
9,873,012 B2 1/2018 Huppee et al.
9,878,201 B1 1/2018 Moschel
9,884,224 B2 2/2018 Spoeth et al.
9,885,575 B2 2/2018 Collin
9,895,567 B2 2/2018 Lee
9,895,570 B2 2/2018 Shah
9,895,571 B2 2/2018 Wang
9,901,766 B2 2/2018 Ross
9,901,772 B2 2/2018 Crowley et al.
9,907,396 B1 3/2018 Labrosse et al.
9,919,183 B1 3/2018 Moschel
9,921,726 B1 3/2018 Sculley et al.
9,943,719 B2 4/2018 Smith et al.
9,950,205 B2 4/2018 Simonetti
9,951,904 B2 4/2018 Perez et al.
9,968,816 B2 5/2018 Olson et al.
9,968,821 B2 5/2018 Finlayson et al.
9,993,683 B2 6/2018 Moschel
10,004,934 B2 6/2018 Pennington
10,010,745 B1 7/2018 Brumit
10,016,646 B2 7/2018 Butler
10,022,583 B2 7/2018 Wang
10,038,952 B2 7/2018 Labrosse et al.
10,065,064 B2 9/2018 Smith et al.
10,071,285 B2 9/2018 Smith et al.
10,076,437 B2 9/2018 Plath
2002/0052268 A1 5/2002 Morcillo-Quintero
2002/0072436 A1 6/2002 Liu
2002/0086779 A1 7/2002 Wilkinson
2002/0091043 A1 7/2002 Rexach
2002/0101880 A1 8/2002 Kim
2002/0128127 A1 9/2002 Chen
2002/0160891 A1 10/2002 Gallagher
2002/0193213 A1 12/2002 Batca
2003/0008731 A1 1/2003 Anderson et al.
2003/0017918 A1 1/2003 Webb et al.
2003/0022765 A1 1/2003 Wu
2003/0022770 A1 1/2003 Lee
2003/0045406 A1* 3/2003 Stone ..... A63B 21/154 482/100
2003/0060344 A1 3/2003 David
2003/0060345 A1 3/2003 Piane
2003/0069108 A1 4/2003 Rubinstein
2003/0092532 A1 5/2003 Giannelli et al.
2003/0100413 A1 5/2003 Huang
2003/0100415 A1 5/2003 Augustine et al.
2003/0114276 A1 6/2003 Schiff
2003/0122384 A1 7/2003 Swanson et al.
2003/0148862 A1 8/2003 Chen
2003/0166434 A1 9/2003 Lopez-Santillana et al.
2003/0171189 A1 9/2003 Kaufman
2003/0176261 A1* 9/2003 Simonson ..... A63B 21/152 482/103
2003/0186792 A1 10/2003 Keeler
2003/0211916 A1 11/2003 Capuano
2003/0216230 A1 11/2003 Wang
2004/0005961 A1 1/2004 Iund
2004/0005965 A1 1/2004 Panatta
2004/0009856 A1 1/2004 Hammer
2004/0014571 A1 1/2004 Haynes
2004/0021046 A1 2/2004 Hutchison
2004/0023761 A1 2/2004 Emery
2004/0023766 A1 2/2004 Slone
2004/0025993 A1 2/2004 Russell
2004/0033866 A1 2/2004 Shapiro
2004/0033868 A1 2/2004 Van Straaten
2004/0043873 A1 3/2004 Wilkinson et al.
2004/0053752 A1 3/2004 Yang
2004/0072662 A1 4/2004 Landfair
2004/0077468 A1 4/2004 Myles
2004/0087420 A1 5/2004 Montesquieux
2004/0097353 A1 5/2004 Mencis
2004/0138032 A1 7/2004 Van Straaten
2004/0142799 A1 7/2004 Yeo
2004/0142801 A1 7/2004 Lin
2004/0162194 A1 8/2004 Habing
2004/0162196 A1 8/2004 Degroot
2004/0171464 A1 9/2004 Ashby et al.
2004/0171465 A1 9/2004 Hald
2004/0176227 A1* 9/2004 Endelman ..... A63B 21/023 482/142
2004/0185988 A1 9/2004 Hsiung
2004/0198569 A1 10/2004 Sanford-Schwentke
2004/0204294 A2 10/2004 Wilkinson
2004/0208943 A1 10/2004 Miketin
2004/0242388 A1 12/2004 Kusminsky
2004/0266591 A1 12/2004 Alessandri et al.
2005/0003931 A1 1/2005 Mills et al.
2005/0037904 A1 2/2005 Chang
2005/0044984 A1 3/2005 Jones
2005/0049117 A1 3/2005 Rodgers
2005/0049123 A1 3/2005 Dalebout et al.
2005/0054492 A1 3/2005 Neff
2005/0061587 A1 3/2005 Tsai
2005/0065003 A1 3/2005 Klotzki
2005/0085348 A1 4/2005 Kiefer
2005/0085352 A1 4/2005 Baxter
2005/0101463 A1 5/2005 Chen
2005/0107226 A1 5/2005 Monda
2005/0113223 A1 5/2005 Dovner et al.
2005/0130814 A1* 6/2005 Nitta ..... A63B 1/00 482/121
2005/0148440 A1 7/2005 Denton
2005/0148442 A1 7/2005 Watterson
2005/0159278 A1 7/2005 Mcvay
2005/0164839 A1 7/2005 Watterson
2005/0170937 A1 8/2005 van Straaten
2005/0181347 A1 8/2005 Barnes et al.
2005/0181916 A1 8/2005 Frost et al.
2005/0187075 A1 8/2005 Bellamy
2005/0233873 A1 10/2005 Chen
2005/0248713 A1 11/2005 Hirosue et al.
2005/0250619 A1 11/2005 Daikeler et al.
2005/0272564 A1 12/2005 Pyles et al.
2005/0272575 A1 12/2005 Melegati
2005/0272577 A1 12/2005 Olson
2005/0283051 A1 12/2005 Chen
2006/0003877 A1 1/2006 Harmon
2006/0019806 A1 1/2006 Mikulski
2006/0021155 A1 2/2006 Lang et al.
2006/0030465 A1 2/2006 Johnson
2006/0033392 A1 2/2006 Ritchey
2006/0035772 A1 2/2006 Golesh et al.
2006/0040810 A1 2/2006 Chu
2006/0084422 A1 4/2006 Huang et al.
2006/0084556 A1 4/2006 Payne
2006/0116253 A1 6/2006 Nizam
2006/0128540 A1 6/2006 Engle
2006/0135322 A1 6/2006 Rocker
2006/0148622 A1 7/2006 Chen
2006/0160677 A1 7/2006 Piane, Jr.
2006/0189452 A1 8/2006 Chou
2006/0217240 A1 9/2006 White
2006/0217242 A1 9/2006 Karpachev
2006/0240955 A1* 10/2006 Pu ..... A61H 1/0266 482/79
2006/0240959 A1 10/2006 Huang
2006/0247107 A1 11/2006 Carter
2006/0251638 A1 11/2006 Guenzler-Pukall
2006/0252602 A1 11/2006 Brown
2006/0252612 A1 11/2006 Sofun

(56) References Cited

U.S. PATENT DOCUMENTS

2006/0252613 A1* 11/2006 Barnes ..... A63B 21/00072 482/95
2006/0258519 A1 11/2006 Ardito, III et al.
2006/0281608 A1 12/2006 Tumminello
2007/0004569 A1 1/2007 Cao
2007/0013655 A1 1/2007 Rosenberg et al.
2007/0017025 A1 1/2007 Myer
2007/0018465 A1 1/2007 Vassilakos
2007/0021280 A1 1/2007 Tyree
2007/0042878 A1 2/2007 Lundquist
2007/0057001 A1 3/2007 Wang
2007/0066448 A1 3/2007 Pan et al.
2007/0087920 A1 4/2007 Dachraoui et al.
2007/0093369 A1 4/2007 Bocchicchio
2007/0111858 A1 5/2007 Dugan
2007/0123390 A1 5/2007 Mathis
2007/0123396 A1 5/2007 Ellis
2007/0135264 A1 6/2007 Rosenberg
2007/0135272 A1 6/2007 Stuckey
2007/0135279 A1 6/2007 Purdy et al.
2007/0141871 A1 6/2007 Scherer et al.
2007/0155600 A1 7/2007 Cunningham et al.
2007/0161468 A1 7/2007 Yanagisawa et al.
2007/0161470 A1 7/2007 Berryman
2007/0161472 A1 7/2007 Drechsler
2007/0176035 A1 8/2007 Campbell
2007/0179030 A1 8/2007 Slawinski
2007/0184944 A1 8/2007 Huang
2007/0190508 A1 8/2007 Dalton
2007/0197345 A1 8/2007 Wallace et al.
2007/0197353 A1 8/2007 Hundley
2007/0202992 A1 8/2007 Grasshoff
2007/0232455 A1 10/2007 Hanoun
2007/0232461 A1 10/2007 Jenkins et al.
2007/0232463 A1 10/2007 Wu
2007/0243975 A1 10/2007 Gearon
2007/0259759 A1 11/2007 Sumners et al.
2007/0259763 A1 11/2007 McKeown et al.
2007/0270284 A1 11/2007 Lin
2007/0281836 A1 12/2007 Gearon
2007/0287606 A1 12/2007 Mac Millan
2007/0298941 A1 12/2007 Egger
2007/0298945 A1 12/2007 Mehta
2007/0298947 A1 12/2007 Eksteen
2008/0020898 A1 1/2008 Pyles et al.
2008/0020911 A1 1/2008 Castello Neto
2008/0051256 A1* 2/2008 Ashby ..... A63B 21/00072 482/5
2008/0070755 A1 3/2008 Mckee
2008/0085820 A1 4/2008 Majkrzak
2008/0090703 A1 4/2008 Rosenberg
2008/0096735 A1 4/2008 Grider
2008/0103034 A1 5/2008 Mihara et al.
2008/0119337 A1* 5/2008 Wilkins ..... A63B 5/00 482/130
2008/0139370 A1 6/2008 Charnitski
2008/0146418 A1 6/2008 Summers
2008/0153676 A1 6/2008 Krietzman
2008/0161168 A1 7/2008 Hsiao
2008/0161170 A1 7/2008 Lumpee
2008/0161653 A1 7/2008 Lin et al.
2008/0182731 A1 7/2008 Vittone
2008/0188362 A1 8/2008 Chen
2008/0200853 A1 8/2008 Tielve
2008/0204225 A1 8/2008 Kitchen
2008/0207407 A1 8/2008 Yeh
2008/0207415 A1 8/2008 Tsai
2008/0214971 A1 9/2008 Talish
2008/0228110 A1 9/2008 Berme
2008/0242520 A1 10/2008 Hubbard
2008/0261785 A1 10/2008 Albanese
2008/0279896 A1 11/2008 Heinen et al.
2008/0280734 A1 11/2008 Dickie et al.
2008/0300118 A1 12/2008 Wehrell
2008/0318738 A1 12/2008 Chen
2008/0318744 A1 12/2008 Barra
2009/0042698 A1 2/2009 Wang
2009/0075784 A1 3/2009 Hoggan
2009/0075793 A1 3/2009 Trainor
2009/0105052 A1 4/2009 Dalebout et al.
2009/0111658 A1 4/2009 Juan
2009/0118098 A1 5/2009 Yeh
2009/0131230 A1 5/2009 Cole
2009/0149302 A1 6/2009 Thuma
2009/0181830 A1 7/2009 Wu
2009/0186748 A1 7/2009 Golesh et al.
2009/0196417 A1 8/2009 Beaver et al.
2009/0305852 A1 12/2009 Svenberg
2010/0004104 A1 1/2010 Gustafson
2010/0005624 A1 1/2010 Swearingen
2010/0031803 A1 2/2010 Lozada et al.
2010/0048368 A1 2/2010 Donofrio
2010/0056345 A1 3/2010 Liu
2010/0063426 A1 3/2010 Planke
2010/0093493 A1 4/2010 Eldridge
2010/0105530 A1 4/2010 Inaizumi
2010/0130337 A1 5/2010 Stewart
2010/0156760 A1 6/2010 Cheswick
2010/0178981 A1 7/2010 Holcomb
2010/0179035 A1 7/2010 Carnahan
2010/0184570 A1 7/2010 Cheng
2010/0197462 A1 8/2010 Piane, Jr.
2010/0197465 A1 8/2010 Stevenson
2010/0210418 A1 8/2010 Park
2010/0216600 A1 8/2010 Noffsinger
2010/0216610 A1 8/2010 Gedeon-Janvier
2010/0233664 A1 9/2010 Wroclawsky
2010/0234184 A1 9/2010 Le Page
2010/0234193 A1 9/2010 Friedman
2010/0240493 A1 9/2010 Wang
2010/0255965 A1* 10/2010 Chen ..... A63B 21/0552 482/130
2010/0285933 A1 11/2010 Nalley
2010/0304938 A1 12/2010 Olson
2010/0304940 A1 12/2010 Svenberg
2010/0311552 A1 12/2010 Sumners
2010/0317488 A1 12/2010 Cartaya
2010/0323852 A1 12/2010 Locsin
2010/0327603 A1 12/2010 Suaan
2011/0028282 A1 2/2011 Sbragia
2011/0082013 A1 4/2011 Bastian
2011/0082015 A1 4/2011 Dreissigacker et al.
2011/0087137 A1 4/2011 Hanoun
2011/0131005 A1 6/2011 Ueshima et al.
2011/0165995 A1 7/2011 Paulus
2011/0165996 A1 7/2011 Paulus
2011/0165997 A1 7/2011 Reich
2011/0172058 A1 7/2011 Deaconu
2011/0172068 A1 7/2011 Tyson, III
2011/0185309 A1 7/2011 Challinor et al.
2011/0188980 A1 8/2011 Pumroy
2011/0190096 A1 8/2011 Clarke
2011/0195819 A1 8/2011 Shaw
2011/0195825 A1 8/2011 Liester
2011/0237407 A1 9/2011 Kaleal
2011/0240403 A1 10/2011 Meillet
2011/0281249 A1 11/2011 Gammell et al.
2011/0281691 A1 11/2011 Ellis
2011/0287905 A1 11/2011 Reyes
2012/0004074 A1 1/2012 Schelzig
2012/0015787 A2 1/2012 Crawley
2012/0021876 A1 1/2012 Hsiung
2012/0021877 A1 1/2012 Lundquist et al.
2012/0035024 A1 2/2012 Price
2012/0083396 A1 4/2012 Aquino
2012/0115691 A1 5/2012 Munroe
2012/0142503 A1 6/2012 Sevadjian
2012/0158238 A1 6/2012 Daley
2012/0225758 A1 9/2012 Shaw
2012/0238411 A1 9/2012 Mcbride et al.
2012/0258433 A1 10/2012 Hope et al.
2012/0277070 A1 11/2012 Sienna
2012/0283074 A1 11/2012 Hutchins
2012/0295774 A1 11/2012 Dalebout et al.

(56) References Cited

U.S. PATENT DOCUMENTS

2012/0322625 A1 12/2012 Park
2012/0322629 A1 12/2012 Webb
2012/0329615 A1 12/2012 Jeong
2013/0018494 A1 1/2013 Amini
2013/0035219 A1 2/2013 Williams
2013/0053220 A1 2/2013 Monaco
2013/0065732 A1* 3/2013 Hopp ..... A63B 22/0012 482/52
2013/0090212 A1 4/2013 Wang
2013/0090216 A1 4/2013 Jackson
2013/0102443 A1 4/2013 Lundquist et al.
2013/0123083 A1 5/2013 Sip
2013/0178338 A1 7/2013 Ross
2013/0178346 A1 7/2013 Lin
2013/0193655 A1 8/2013 Kaye et al.
2013/0196821 A1 8/2013 Watterson et al.
2013/0225373 A1 8/2013 Poat
2013/0225377 A1 8/2013 Lee et al.
2013/0231226 A1 9/2013 Bonutti
2013/0237383 A1 9/2013 Chen
2013/0274067 A1 10/2013 Watterson et al.
2013/0274074 A1 10/2013 Ghandour
2013/0303334 A1 11/2013 Adhami
2013/0310230 A1 11/2013 Norris
2013/0337974 A1 12/2013 Yanev et al.
2013/0337980 A1 12/2013 Himmelrick et al.
2014/0073488 A1 3/2014 Wu
2014/0080678 A1 3/2014 Wu
2014/0106943 A1 4/2014 Simonetti
2014/0106948 A1 4/2014 Agostini
2014/0121071 A1 5/2014 Strom et al.
2014/0162856 A1 6/2014 Kramer
2014/0187389 A1* 7/2014 Berg ..... A61H 1/0237 482/91
2014/0221175 A1 8/2014 Liu
2014/0221881 A1 8/2014 Schlauder et al.
2014/0228175 A1 8/2014 Lemos et al.
2014/0287886 A1 9/2014 Patti
2014/0309092 A1 10/2014 De Michele
2014/0357457 A1 12/2014 Boekerna
2014/0371035 A1* 12/2014 Mortensen ..... A63B 71/0619 482/52
2015/0038300 A1* 2/2015 Forhan ..... A63B 21/00047 482/72
2015/0069738 A1 3/2015 Knight
2015/0072842 A1 3/2015 Segal
2015/0126348 A1 5/2015 Kaye et al.
2015/0148204 A1 5/2015 Sleppy
2015/0165270 A1 6/2015 Allos
2015/0202487 A1 7/2015 Wu
2015/0209610 A1 7/2015 Dalebout et al.
2015/0238801 A1 8/2015 Meredith
2015/0251055 A1 9/2015 Ashby
2015/0273267 A1 10/2015 Manzke
2015/0283420 A1 10/2015 Chang
2015/0283421 A1 10/2015 Gaylord
2015/0352396 A1 12/2015 Dalebout
2015/0360073 A1 12/2015 Moran et al.
2016/0001123 A1 1/2016 Parrish, Jr.
2016/0008650 A1 1/2016 Jue et al.
2016/0051857 A1 2/2016 Rasner
2016/0074691 A1 3/2016 Pearce et al.
2016/0096064 A1 4/2016 Gatti
2016/0101311 A1 4/2016 Workman
2016/0121156 A1 5/2016 Bach
2016/0199683 A1 7/2016 Shamlin
2016/0206248 A1 7/2016 Sartor et al.
2016/0256728 A1 9/2016 Tang
2016/0278487 A1 9/2016 Postolek
2016/0319850 A1 11/2016 Kamen et al.
2016/0321075 A1 11/2016 Catherwood et al.
2016/0346586 A1 12/2016 Pullins et al.
2016/0346617 A1 12/2016 Sprugo
2017/0021218 A1 1/2017 Peritz
2017/0050069 A1 2/2017 Ky
2017/0050074 A1 2/2017 Olson
2017/0056711 A1 3/2017 Dalebout et al.
2017/0056712 A1 3/2017 Johnson
2017/0056715 A1 3/2017 Dalebout et al.
2017/0056726 A1 3/2017 Dalebout et al.
2017/0065852 A1 3/2017 Cygan et al.
2017/0106227 A1 4/2017 Lalaoua
2017/0106240 A1 4/2017 Chuang
2017/0165552 A1 6/2017 Martin
2017/0173394 A1 6/2017 Rider
2017/0197103 A1 7/2017 Rau et al.
2017/0197106 A1 7/2017 Dalebout et al.
2017/0239509 A1 8/2017 Wang
2017/0266481 A1 9/2017 Dalebout
2017/0266503 A1 9/2017 Watterson et al.
2017/0274237 A1 9/2017 Chang
2017/0312580 A1 11/2017 Chang
2017/0319906 A1 11/2017 Chang et al.
2017/0326411 A1 11/2017 Watterson
2017/0367480 A1 12/2017 Dickerson et al.
2018/0036572 A1 2/2018 Hsu
2018/0085622 A1 3/2018 Ivan
2018/0117385 A1 5/2018 Watterson et al.
2018/0140886 A1 5/2018 Hetrick et al.
2018/0154205 A1 6/2018 Watterson
2018/0256933 A1 9/2018 Olson

* cited by examiner

COLLAPSIBLE STRENGTH EXERCISE MACHINE

RELATED APPLICATIONS

This application claims priority to U.S. Patent Application Ser. No. 62/310,467 titled "Collapsible Strength Exercise Machine" and filed on Mar. 18, 2016, which application is herein incorporated by reference for all that it discloses.

BACKGROUND

While there are numerous exercise activities that one may participate in, exercise may be broadly broken into the categories of aerobic exercise and anaerobic exercise. Aerobic exercise generally refers to activities that substantially increase the heart rate and respiration of the exerciser for an extended period of time. This type of exercise is generally directed to enhancing cardiovascular performance. Such exercise usually includes low or moderate resistance to the movement of the individual. For example, aerobic exercise includes activities such as walking, running, jogging, swimming or bicycling for extended distances and extended periods of time.

Anaerobic exercise generally refers to exercise that strengthens skeletal muscles and usually involves the flexing or contraction of targeted muscles through significant exertion during a relatively short period of time and/or through a relatively small number of repetitions. For example, anaerobic exercise includes activities such as weight training, push-ups, sit-ups, pull-ups, or a series of short sprints.

To build skeletal muscle, a muscle group is contracted against resistance. The contraction of some muscle groups produces a pushing motion, while the contraction of other muscle groups produces a pulling motion. A cable machine is a popular piece of exercise equipment for building those muscle groups that produce pulling motions. A cable machine often includes a cable with a handle connected to a first end and a resistance mechanism connected to a second end. Generally, the resistance mechanism is a selectable set of weights. A midsection of the cable is supported with at least one pulley. To move the cable, a user pulls on the handle with a force sufficient to overcome the force of the resistance mechanism. As the cable moves, the pulley or pulleys direct the movement of the cable and carry a portion of the resistance mechanism's load.

One type of cable exercise machine is disclosed in WIPO Patent Publication No. WO/2007/015096 issued to Andrew Loach. In this reference, an exercise apparatus allows the user to perform a variety of aerobic and strength training exercises. A user input means allows the user to apply torque to an input shaft of a resistance unit. A control means adjusts the resistance provided by a resistance means coupled to the input shaft according to the output of a number of sensors. In a preferred embodiment, the resistance unit is able to simulate at the input shaft the dynamic response of a damped flywheel or the dynamic response of an object driven through a viscous medium, or to maintain the resistance at a constant level that is set by the user. The resistance unit includes a battery or an electric generator device and can be operated without connection to an external power source. Other types of cable exercise machines are described in U.S. Patent Publication Nos. 2012/0065034 issued to Andrew Loach and 2006/0148622 issued to Ping Chen.

SUMMARY

In one embodiment, an exercise machine includes a standing platform, a pivot connection incorporated into the standing platform, an upright structure attached to the standing platform at the pivot connection, and a movable element connected to the upright structure where the movable element is movable during the performance of an exercise. The upright structure is rotated about the pivot connection in a transverse orientation to the standing platform when the exercise machine is in an operational mode and the upright structure is rotated about the pivot connection in an aligned orientation with the standing platform when the exercise machine is in a storage mode.

The upright structure may include an arm assembly.

The arm assembly may include an arm, an arm distal end of the arm, and a distal pulley connected to the arm distal end.

The arm assembly may include an arm proximal end of the arm, a pin opening defined proximate the arm proximal end, a retracted pin partially disposed within the pin opening, a proximal axle connected to the arm proximal end, and a locking plate with multiple locking openings defined therein. The arm may be pivotal about the proximal axle and lockable in an angular position that corresponds to one of the multiple locking openings.

The movable element may be a cable, and the may be cable directed with the distal pulley.

The exercise machine may include a cable distal end of the cable and a handle attached to the cable distal end.

The exercise machine may include a resistance mechanism incorporated into the exercise machine and a proximal end of the cable is attached to the resistance mechanism.

The exercise machine may include a proximal pulley located near the proximal end of the arm. The cable may be directed with the proximal pulley and the distal pulley.

The exercise machine may include a passage defined within a length of the arm. A section of the cable between the proximal pulley and the distal pulley may reside within the passage.

The standing platform may include a rail and a floor section connected to the rail.

The exercise machine may include a locking mechanism incorporated into the floor section. The floor section may selectively move along a length of the rail and selectively lock into a stationary position with the rail with the locking mechanism.

In one embodiment, an exercise machine includes a standing platform. The standing platform may include a rail, a floor section connected to the rail, and a locking mechanism incorporated into the floor section. The floor section is selectively movable along a length of the rail and selectively lockable into a stationary position with the rail with the locking mechanism. The exercise machine also includes a pivot connection incorporated into the standing platform, an upright structure attached to the standing platform at the pivot connection, and an arm assembly attached to the upright structure. The arm assembly includes an arm, an arm distal end of the arm, and a distal pulley connected to the arm distal end. The exercise machine also includes a cable connected to the arm assembly where the cable is movable during the performance of an exercise. The upright structure is rotated about the pivot connection in a transverse orientation to the standing platform when the exercise machine is in an operational mode and the upright structure is rotated about the pivot connection in an aligned orientation with the standing platform when the exercise machine is in a storage mode.

The arm assembly may include an arm proximal end of the arm, a pin opening defined proximate the arm proximal end, a retracted pin partially disposed within the pin opening, a proximal axle connected to the arm proximal end, and a locking plate with multiple locking openings defined therein. The arm may be pivotal about the proximal axle and lockable in an angular position that corresponds to one of the multiple locking openings.

The movable element may be a cable, and the cable may be directed with the distal pulley.

The exercise machine may include a cable distal end of the cable and a handle attached to the cable distal end.

The exercise machine may include a resistance mechanism incorporated into the exercise machine and a proximal end of the cable may be attached to the resistance mechanism.

The exercise machine may include a proximal pulley located near the proximal end of the arm. The cable may be directed with the proximal pulley and the distal pulley.

The exercise machine may include a locking mechanism incorporated into the floor section. The floor section may be selectively movable along a length of the rail and selectively lockable into a stationary position with the rail with the locking mechanism.

The pivot connection may include a tube of the standing platform, a tube face of the tube, at least one tube section of the upright structure, an interlocking face of the tube section that complements the tube face, a pivot rod resides within a bore collectively defined by the tube and the at least one tube section, a knob threaded to an end of the pivot rod, anti-rotating features formed in the tube face and the interlocking face. When the knob is rotated in a first direction, the tube face and the interlocking face may come together so that anti-rotation features interlock.

The pivot connection may include an anti-rotation feature.

In one embodiment, an exercise machine includes a standing platform. The standing platform includes a rail, a floor section connected to the rail, and a locking mechanism incorporated into the floor section. The floor section is selectively movable along a length of the rail and selectively lockable into a stationary position with the rail with the locking mechanism. The exercise machine includes a pivot connection incorporated into the standing platform, an upright structure attached to the standing platform at the pivot connection, and an arm assembly attached to the upright structure. The arm assembly includes an arm, an arm distal end of the arm, a distal pulley connected to the arm distal end, an arm proximal end of the arm, a proximal pulley located near the proximal end of the arm, a pin opening defined proximate the arm proximal end, a retracted pin partially disposed within the pin opening, a proximal axle connected to the arm proximal end, a passage defined within a length of the arm, and a locking plate with multiple locking openings defined therein. The arm is pivotal about the proximal axle and lockable in an angular position that corresponds to one of the multiple locking openings. The exercise machine also includes a resistance mechanism incorporated into the exercise machine and a cable connected to the arm assembly where the cable is movable during the performance of an exercise. The cable includes a cable distal end of the cable, a handle attached to the cable distal end, and a proximal end of the cable is attached to the resistance mechanism. The cable is directed with the proximal pulley and the distal pulley and a section of the cable between the proximal pulley and the distal pulley resides within the passage defined in the arm. The upright structure is rotated about the pivot connection in a transverse orientation to the standing platform when the exercise machine is in an operational mode and the upright structure is rotated about the pivot connection in an aligned orientation with the standing platform when the exercise machine is in a storage mode.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

DETAILED DESCRIPTION

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

Figure 1:
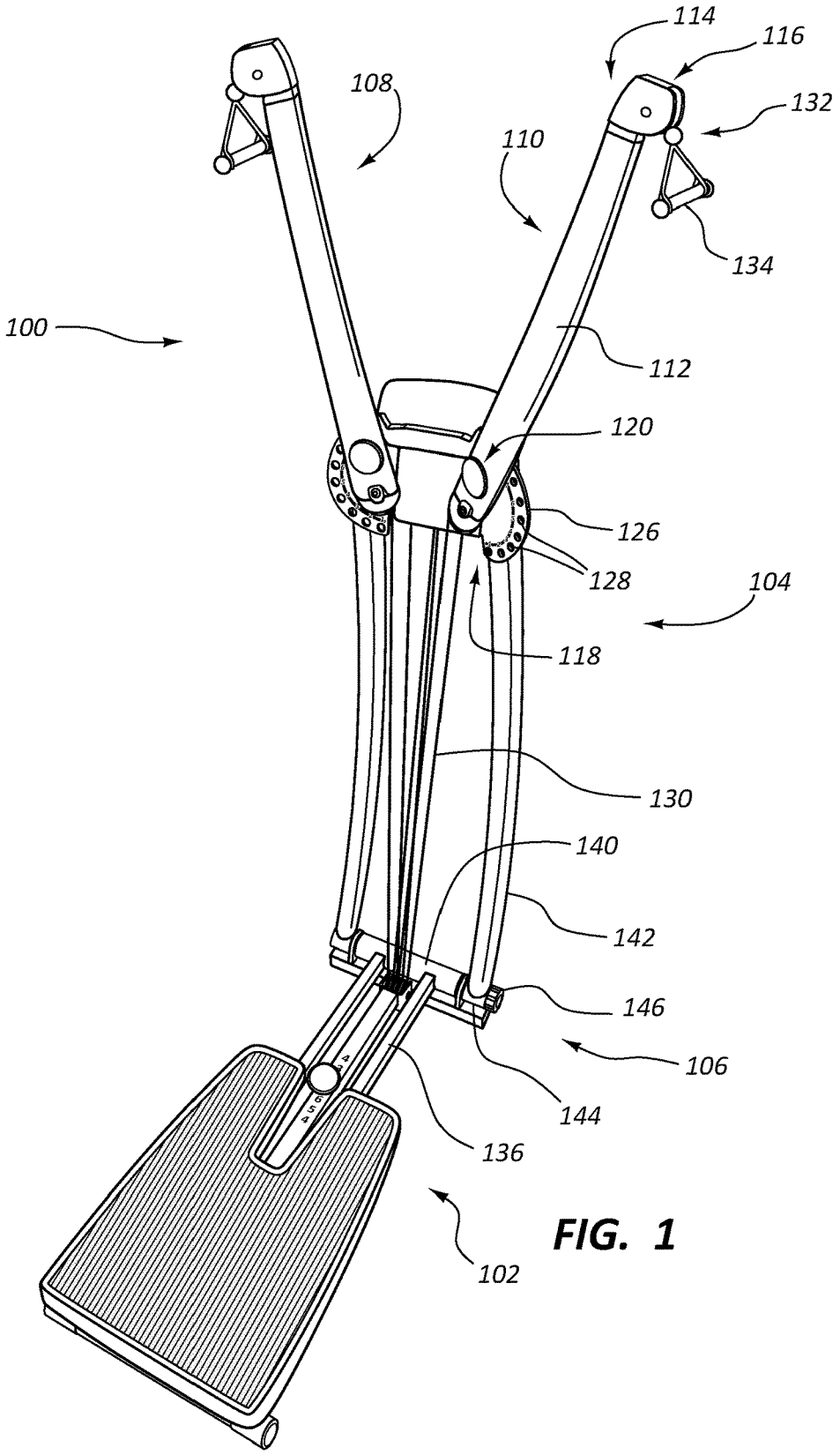
FIG. 1 illustrates a perspective view of an example of an exercise machine in accordance with the present disclosure.

FIG. 1 depicts an example of an exercise machine 100. In this example, the exercise machine 100 includes a standing platform 102 connected to an upright structure 104 at a pivot connection 106.

The upright structure includes a first arm assembly 108 and a second arm assembly 110. In this example, each of the arm assemblies 108, 110 include an arm 112, a distal end 114, and a distal pulley 116 connected to the distal end 114. Further, in this example, each of the first and second arm assemblies 108, 110 include a proximal end 118, a pin opening 120 defined proximate the proximal end 118, a retracted pin 122 partially disposed within the pin opening 120, a proximal axle connected to the proximal end 118, and a locking plate 126 with multiple locking openings 128 defined therein. The arm 112 can be pivoted about the proximal axle and lockable in an angular position that corresponds to one of the multiple locking openings 128.

The arm 112 supports a movable cable 130. A distal end 132 of the cable 130 is connected to a handle 134. The exercise machine 100 may also include a resistance mechanism (not shown) and a proximal end (not shown) of the cable 130 is attached to the resistance mechanism. A proximal pulley is located near the proximal end 118 of the arm 112, and the cable 130 is directed with the proximal pulley and the distal pulley 116. Thus, when the user pulls the handle 134, the cable moves along its length. As the cable moves along its length, the cable is routed by the proximal and distal pulleys so that the resistance mechanism is moved by the movement of the cable's proximal end. Thus, the user feels the resistance load of the resistance mechanism as he or she pulls on the cable's handle.

In the example of FIG. 1, the standing platform's rails 138 are joined at the pivot connection 106 with a tube 140. A pivot rod may be inserted through the inside diameter of the tube 140. The pivot rod is longer than the length of the tube 140 and extends out of the tube 140 at both of the tube's ends. The bottom of the upright structure's beams 142 also include tubular sections 144 that have openings defined therein, but are transverse the length of the beams 142. The beams' tubular sections 144 complement the platform's tube 140 to form a collective tube in which the pivot rod resides. The pivot rod connects the upright structure 104 and the standing platform 102 through collective tube. The interface between the platform's tube 140 and the beams' tube sections 144 can include preset features, such as anti-rotation features. In one example, the face of the platform's tube includes a recess, and the complementing face of the corresponding tube section includes a protrusion sized to snugly fit within the recess. Thus, when the recess of the tube's face is lined up with the protrusion in the tube section's face, the protrusion and recess interlock preventing the beam from rotating with respect to the standing platform.

The pivot connection 106 may include a knob 146 at one end that is threaded onto a thread form of the pivot rod. The knob 146 may be accessible to the outside collective tube, and when the knob 146 is rotated in a first direction, the interfaces between the tube and tube sections come closer together. In a tightened position, the knob 146 applies a force strong enough to hold the tube 140 close to the tube sections 144 which forcibly causes the anti-rotation features of the tube 140 and tube sections 144 to interlock. When the knob 146 is rotated in a second direction that is opposite the first direction, the force between the tube 140 and the tube sections 144 is reduced. When the knob 146 is rotated far enough in the second direction, the beam's tube sections 144 can be separated from the platform's tube 140 enough that the anti-rotation features can unlock allowing the beams 142 to pivot about the pivot rod. Thus, with the knob 146 loosened enough, the upright structure 104 can rotate into a new position with respect to the standing platform 102.

Figure 2:
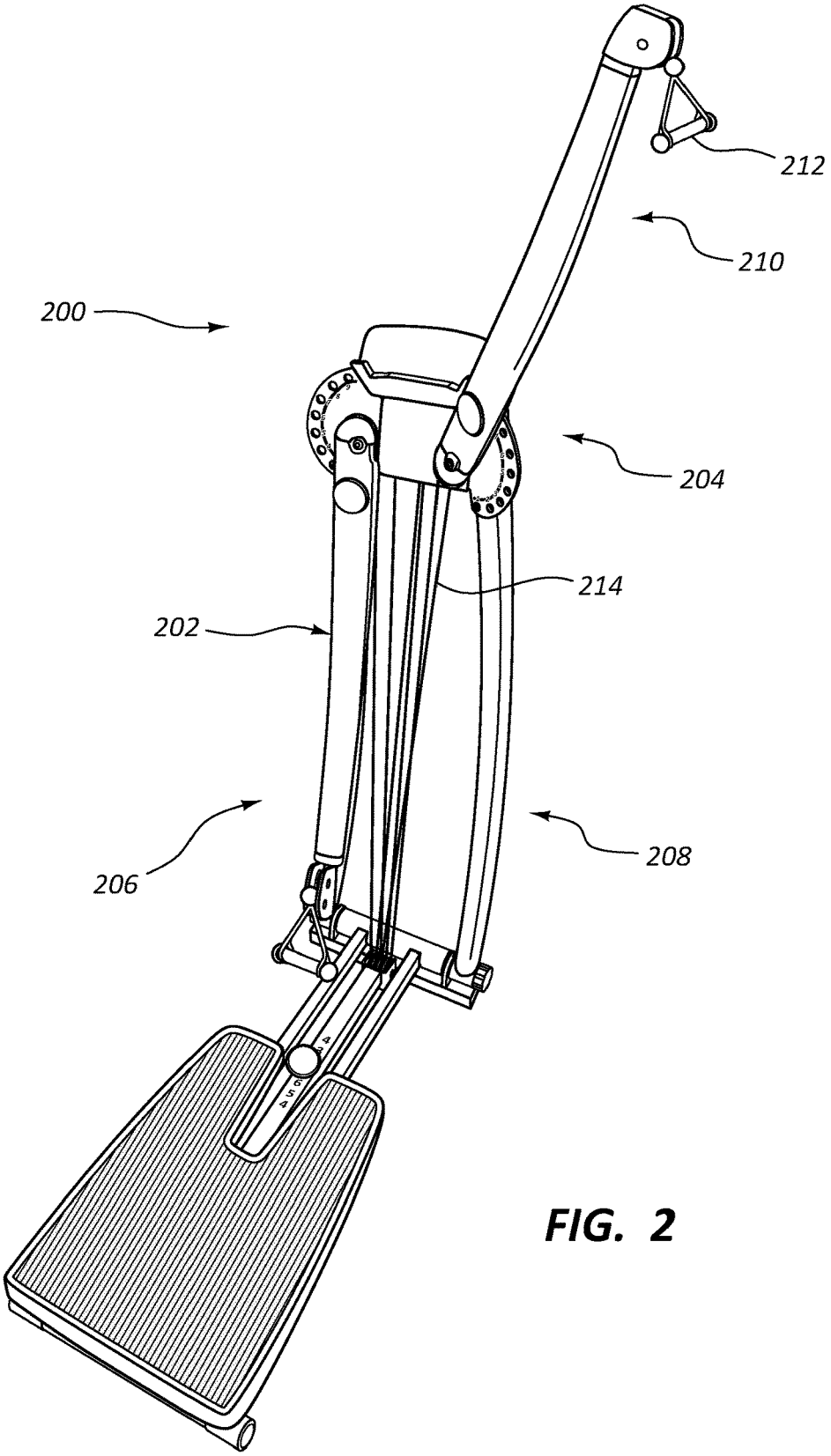
FIG. 2 illustrates a perspective view of an example of an exercise machine in accordance with the present disclosure.

FIG. 2 depicts an example of an exercise machine 200. In this example, the exercise machine 200 includes a first arm assembly 202 and a second arm assembly 204. In FIG. 2, the first arm assembly 202 is rotated and locked into a downward angular orientation 206 so that the length of the arm is aligned with the length of the upright structure 208. The first arm assembly 202 may be rotated into the aligned orientation 206 when the exercise machine 200 is in an operational mode.

The second arm assembly 204 is rotated and locked into another angular orientation 210 that positions the handle 212 of the cable 214 in a location desired by a user for performing a pull exercise. The second arm assembly 204 may be rotated into any orientation, especially orientations that are transverse the orientation of the upright structure or are at least misaligned with the orientation of the upright structure.

Figure 3:
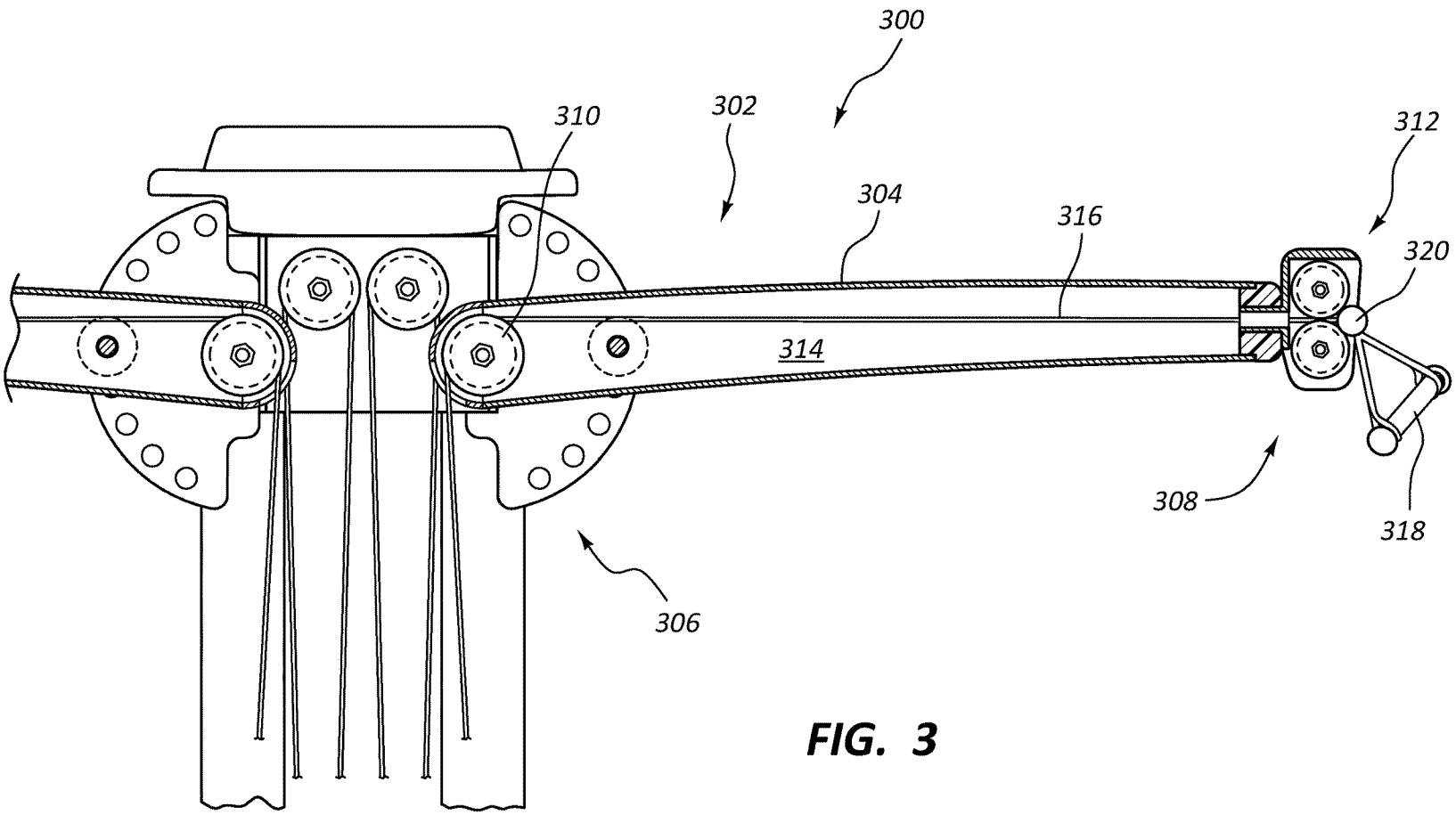
FIG. 3 illustrates a cross section view of an example of an arm of an exercise machine in accordance with the present disclosure.

FIG. 3 depicts a cross sectional view of a portion of an exercise machine 300. In this example, the arm assembly 302 include an arm 304 with a proximal end 306 and a distal end 308. The proximal pulley 310 is associated with the proximal end 306 of the arm 304, and a pair of distal pulleys 312 is associated with the arm's distal end 308. A passage 314 is defined in the arm 304 and connects the proximal end 306 and the distal end 308 along the arm's length. The cable 316 is routed within the arm's length and is directed by the proximal pulley 310 and the pair of distal pulleys 312. A handle 318 and a stopper 320 is secured at the cable's distal end. A gap between the pair of distal pulleys 312 is smaller than the cross sectional thickness of the stopper 320. Thus, the stopper 320 prevents the handle 318 and/or the proximal end 306 from being pulled into the passage 314.

Figure 4:
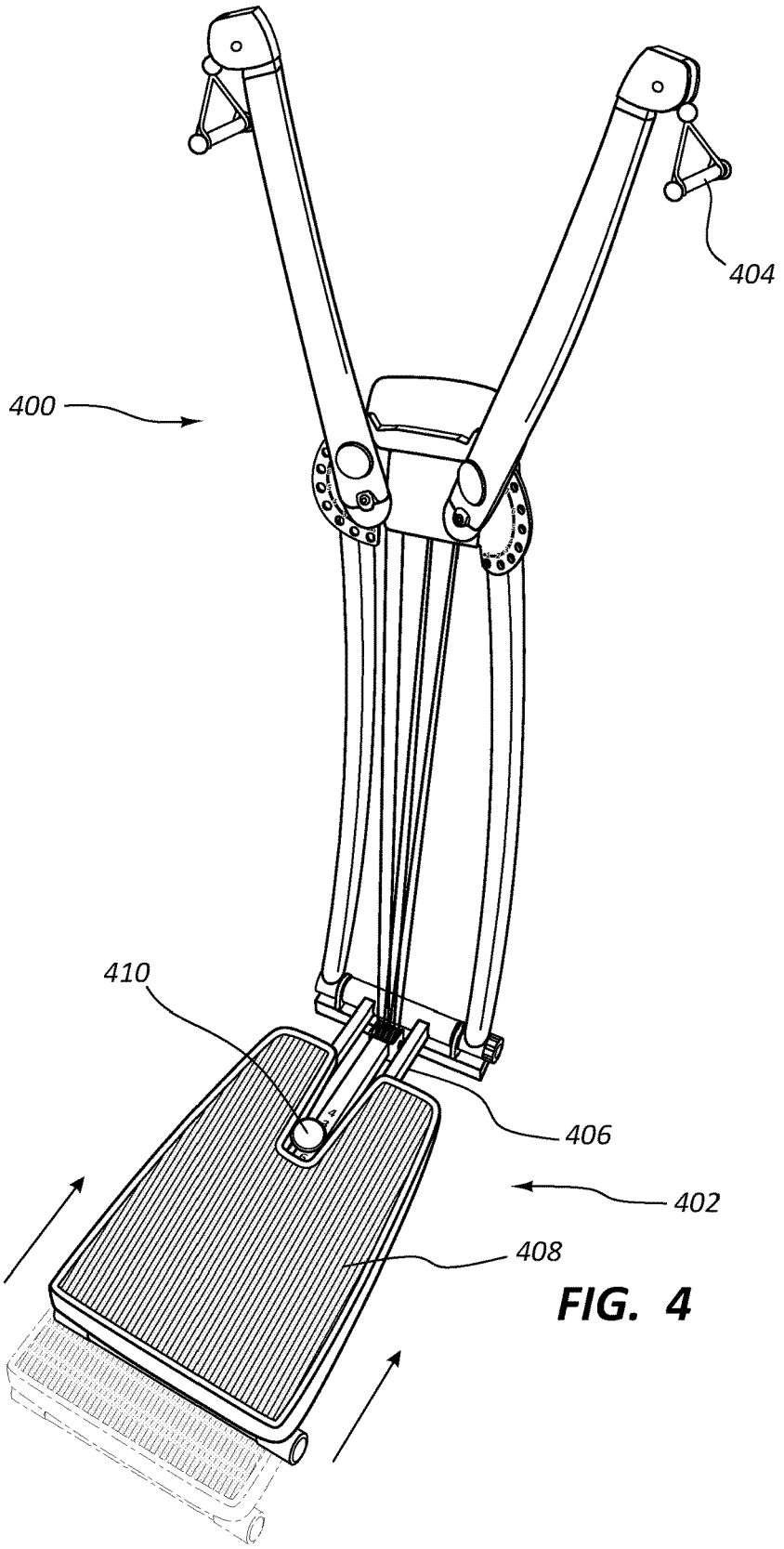
FIG. 4 illustrates a perspective view of an example of a floor sections of an exercise machine in accordance with the present disclosure.

FIG. 4 depicts an example of an exercise machine 400. In this example, the exercise machine 400 includes a standing platform 402 on which the user stands during the performance of a pull exercise. The user stands on the standing platform 402 while grasping the handle 404 connected to the cable and pulling on the handle 404. The user's own body weight assists in stabilizing the exercise machine 400 during the exercise. Thus, the user's feet remain stationary with respect to the standing platform during the performance of the pull exercise. Further, the standing platform 402 remains stationary during the performance of the pull exercise.

When the user is not executing a pull exercise while standing on the standing platform 402, the standing platform 402 may be adjusted to the user's arm length, height, preferences, or combinations thereof. In the example of FIG. 4, the standing platform 402 includes a rail 406 and a floor section 408 connected to the rail 406. The floor section 408 may slide along the rail 406. A locking mechanism 410 may be incorporated into the floor section 408 and may be used to selectively lock the floor section 408 in place along the length of the rail 406. In the example of FIG. 4, the rail 406 is a substantially straight rail.

Figure 5:
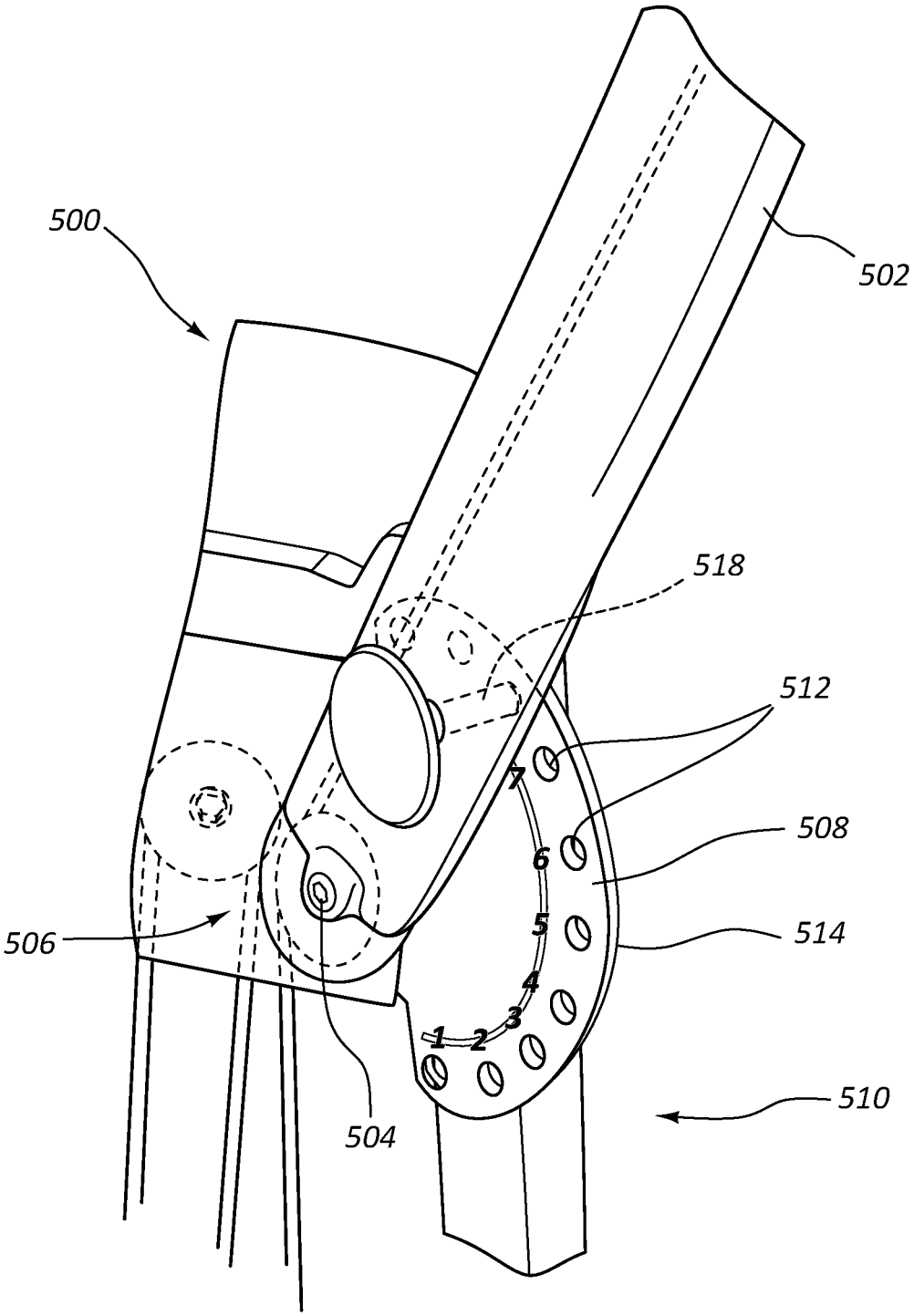
FIG. 5 illustrates a perspective diagram of an example of a proximal end of an arm of an exercise machine in accordance with the present disclosure.

FIG. 5 depicts an example of an exercise machine 500. In this example, the arm 502 is supported about a proximal axle 504 connected to the arm's proximal end 506 and the arm 502 is capable of rotating about the proximal axle 504. A locking plate 508 is attached to the upright structure 510, and the locking plate 508 include multiple locking openings 512 adjacent the plate's perimeter 514. The arm includes a pin opening 516 that can align with any one of the multiple locking openings 512 of the plate 508 depending on the angular orientation of the arm 502. When a pin 518 is inserted through both one of the locking openings of the plate 508 and the pin opening 516 of the arm 502, the arm 502 is locked in the angular orientation. As the user desires to change the arm's orientation, the pin can be removed to free the arm 502 to rotate about the proximal axle 504. When the arm 502 is lined up to the desired orientation, the pin 518 can be reinserted so that the arm 502 is angularly locked with the plate 508.

Figure 6:
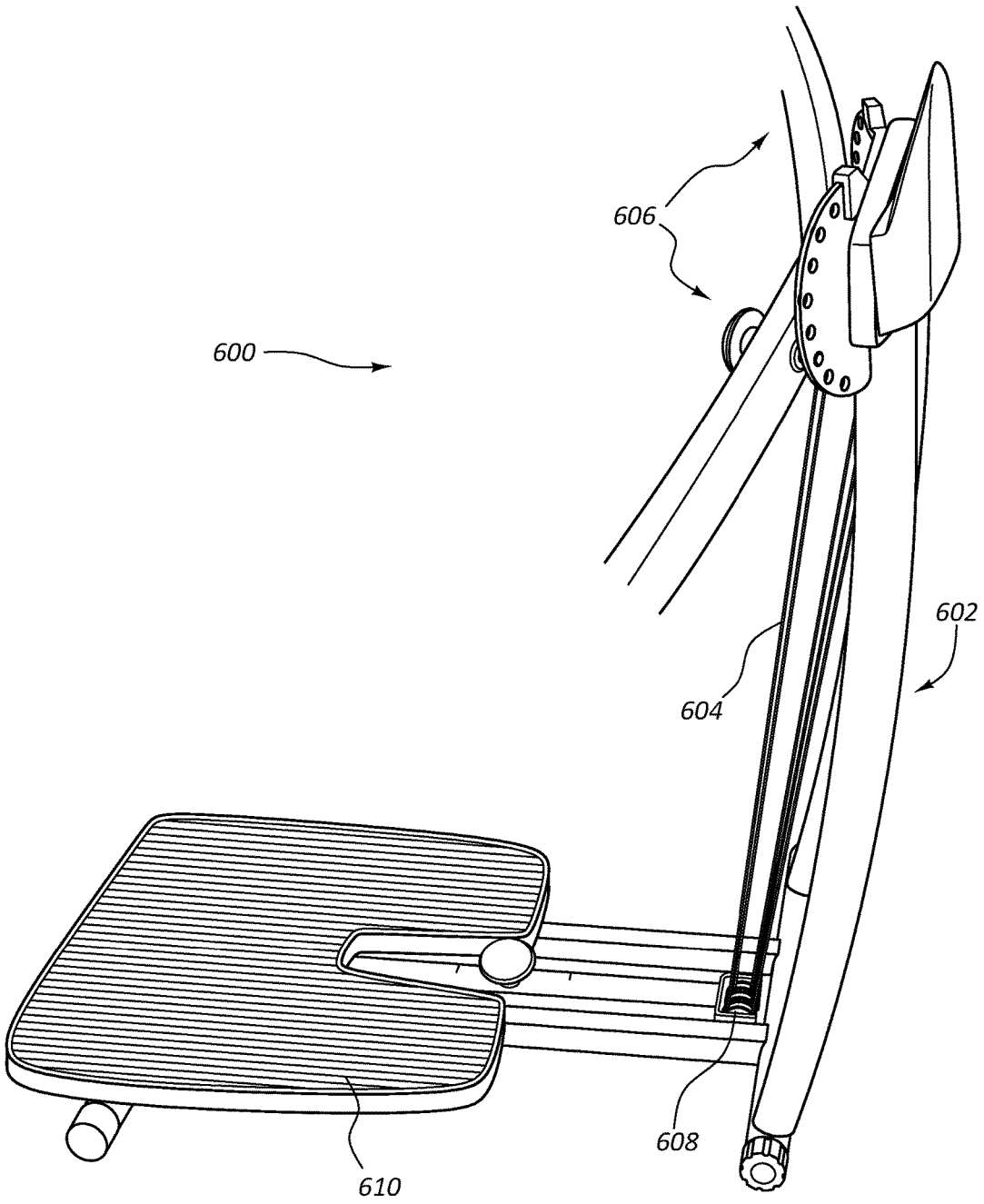
FIG. 6 illustrates a perspective view of an example of an exercise machine in accordance with the present disclosure.

FIG. 6 depicts an example of the exercise machine 600 in an operational mode. In this example, the upright structure 602 is orientated in a transverse orientation to the standing platform 604. The cable is routed from the arm assemblies 606 down along the upright structure's length. Near the pivot connection, the cable is routed by a pulley 608. In this situation, the pulley 608 directs the cable underneath the floor section 610. In this example, the resistance mechanism may be incorporated into the standing platform. In one type of example, the resistance mechanism includes a flywheel and a magnetic unit that resists the rotations of the flywheel where both the flywheel and the magnetic unit are incorporated into the standing platform. But, in alternative examples, the resistance mechanism may be located in the upright structure. The resistance mechanism may include, at least in part, the elastic resistance of the cable.

Figure 7:
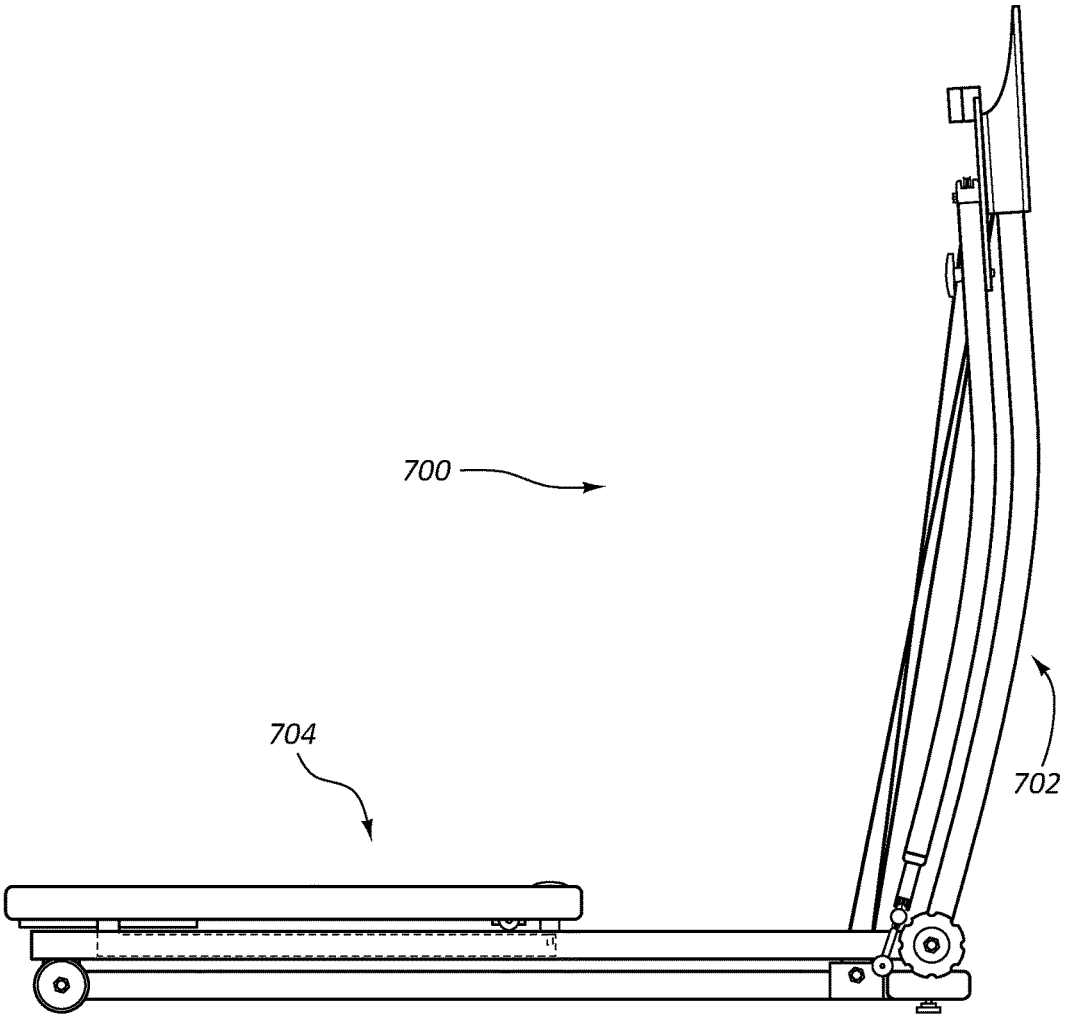
FIG. 7 illustrates a side view of an example of an exercise machine in an operational mode in accordance with the present disclosure.

FIG. 7 depicts an example of the exercise machine 700 in an operational mode. In this example, the upright structure 702 is orientated in a transverse orientation to the standing platform 704. In this mode, the user can stand on the standing platform 704 and orient the arm assemblies so that the arm assemblies position the cable end's handles within a convenient arm's reach to execute a pull exercise while the user is standing on the standing platform 704.

Figure 8:
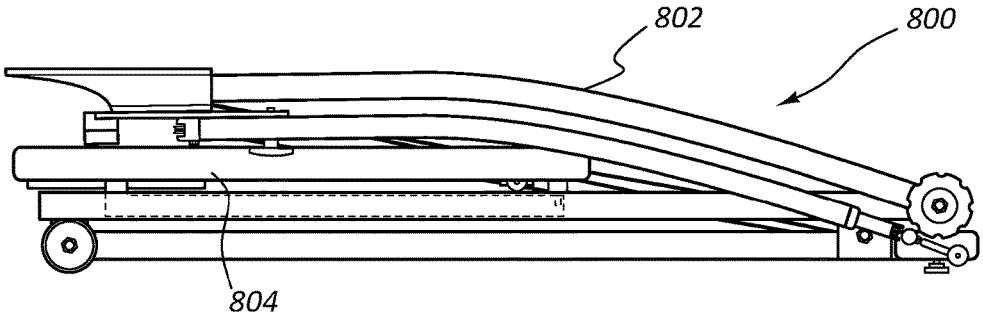
FIG. 8 illustrates a side view of an example of an exercise machine in a storage mode in accordance with the present disclosure Throughout the drawings, identical reference numbers designate similar, but not necessarily identical, elements.

FIG. 8 depicts an example of the exercise machine 800 in storage mode. In this example, the upright structure 802 is orientated in an aligned orientation to the standing platform 804. In this mode, the arm assemblies are oriented to be aligned with the upright structure 802, and the upright structure 802 is folded down to be aligned with the standing platform 804. As shown in FIG. 8, the upright structure 802 may include a bend.

GENERAL DESCRIPTION

In general, the invention disclosed herein may provide users with a collapsible exercise machine. The exercise machine may be a strength exercise machine that includes a pulley cable attached to a resistance mechanism. The user can pull the pull cable against the resistance of the resistance mechanism to build muscle.

In one example, the exercise machine includes a standing platform that is pivotally connected to an upright structure. The upright structure may include an arm assembly that includes at least one arm that supports and directs a pull cable. The pull cable is connected to a resistance mechanism that is attached to another portion of the exercise machine. The user may stand on the standing platform while pulling the distal end of the pull cable. In this manner, the user's body weight can provide stability to the exercise machine as the user pulls against the resistance mechanism's load.

The standing platform may be pivotally connected to the upright structure so that the upright structure can be in an upright orientation that is traverse the length of the standing platform when the exercise machine is in an operational mode. The user can perform an intended exercise while standing on the standing platform when the exercise machine is in the operational mode. The upright structure can rotate about the pivot connection so that the upright structure can rotate downward over the standing platform and be in an aligned orientation with the standing platform when the exercise machine is in a storage mode. In the storage mode, the exercise machine is compact to take up less space. For example, according to one embodiment, the final folded height of the exercise machine in the storage mode is 6 inches or less, measured from the floor, tangentially, to the top of the upright structure 802. In additional embodiments, the final folded height of the exercise machine in the storage mode is 4 inches or less. In some examples, a set of wheels is attached to a standing platform so that one end of the compacted exercise machine can be wheel to another location for storage. This may occur when the user lifts up another end of the exercise machine, and the weight of the exercise machine is loaded into the support floor at the wheels thereby reducing friction against the floor. In other examples, an end of the standing platform may include a low friction interface with the floor so that the user can more easily move the exercise machine in storage mode.

The pivot connection may include a pivot rod that is attached to both the upright structure and the standing platform. A frame of the upright structure may include a first beam on a first side of the upright structure and a second beam on a second side of the upright structure. Each of the first beam and the second beam may include a pivot opening defined in the beams near a connection end of the beams to receive the pivot rod. Similarly, the standing platform may include a first rail on a first side of the platform and a second rail on a second side of the platform. Each of the first rail and the second rail may include pivot openings defined in the rails near a connection end of the rails to receive the pivot rod. The upright structure may pivot about the pivot rod when both the upright structure and the standing platform are connected to the pivot rod.

In some cases, the upright structure may lock in a preset operational angular position about the pivot rod in the operational mode. Locking into an operational angular position may appropriately orient the upright structure during the performance of the user's exercise. Also, locking into an operational angular position may also prevent the upright structure from rotating about the pivot rod when the user pulls on the pull cable during the performance of the exercise thereby preventing the exercise machine from collapsing while the machine is in use.

The preset operational angular position may include anti-rotation features incorporated into the upright structure and the standing platform. In one example, the platform's rails are joined at the pivot connection with the tube. The pivot rod may be inserted through the inside diameter of the tube. In some cases, the pivot rod is longer than the length of the tube and extends out of the tube at both of the tube's ends. The bottom of the upright structure's beams may also include tubular sections that include openings defined therein, but are transverse the length of the beams. The beams' tubular sections may complement the platform's tube to form a collective tube in which the pivot rod can reside. In this example, the pivot rod connects the upright structure and the standing platform through the collective tube. The interface between the platform's tube and the beams' tube sections may include preset features, such as anti-rotation features. In one example, the face of the platform's tube includes a recess, and the complementing face of the corresponding tube section includes a protrusion sized to snugly fit within the recess. Thus, when the recess of the tube's face is lined up with the protrusion in the tube section's face, the protrusion and recess interlock preventing the beam from rotating with respect to the standing platform.

The pivot rod may include a knob at one end that is threaded onto a thread form of the pivot rod. The knob may be accessible to the outside of the collective tube and when the knob is rotated in a first direction, the interfaces between the tube and tube sections come closer together. In a tightened position, the knob applies a force strong enough to hold the tube close to the tube sections which forcibly causes the anti-rotation features of the tube and tube sections to interlock. When the knob is rotated in a second direction that is opposite the first direction, the force between the tube and the tube sections is reduced. When the knob is rotated far enough in the second direction, the beam's tube sections can be separated from the platform's tube enough that the anti-rotation features can unlock allowing the beams to pivot about the pivot rod with respect to the platform's tube. Thus, with the knob loosened enough, the upright structure can rotate into a new position with respect to the standing platform.

Further, in some examples, the upright structure may lock into a preset storage angular position in the storage mode. This angular locking mechanism may include any appropriate type of locking mechanism. In one example, the angular locking mechanism includes a retractable pin incorporated into either of the upright structure or the standing platform that can be inserted into the other. Locking into an angular storage position may prevent the upright structure from unintentional rotating about the pivot rod when the exercise machine is in the storage position, especially in those circumstances when the exercise machine is leaned up against a wall or other structure during storage.

While the pivot connection above has been described with reference to a specific type of pivot connection that includes a pivot rod, any appropriate type of pivot connection may be used in accordance with the principles described in the present disclosure. For example, a non-exhaustive list of movable features that may be incorporated into the pivot connection include a hinge joint, a ball and socket joint, a rotary actuator, a gear mechanism, a screw mechanism, a condyloid joint, a saddle joint, another type of joint, or combinations thereof.

Further, while the examples above have been described with the standing platform including multiple rails, any number of rails or other types of frame members may be used to connect to the pivot connection. Also, while the examples above have been described with an upright structure that has multiple beams, any number of beams or other types of frame members may be used to connect to the pivot connection.

In some embodiments, the standing platform may include a floor section that is connected to the rails or another type of frame member. In some cases, the floor section is movable along the length of the rails. For example, the underside of the floor section may include a feature that interlocks with a track defined in the rails. Thus, the floor section may be confined to travel along the length of the rails.

A locking mechanism may also be incorporated into the floor section to lock the floor section at a distance along the rails with respect to the upright structure and prevent the floor section from moving during the performance of the exercise.

At least one of the rails may include an opening, a catch, a recess, or another type of feature that can interlock with a locking feature of the floor section. For example, the floor section's locking feature may include a retractable pin that can interlock with the rails at the preset locations of the rails. In these examples, the user can move the floor section to the preset locations can lock the floor section in place. In other examples, the locking feature can lock the position the floor section at any desirable location along the length of the rails. In one type of example, the locking mechanism includes a brake that can apply a compressive force to any location along the length of the rails. In other examples, the floor section is moved along the rails with a mechanism that involves a gear set, and the locking mechanism causes the gear set to be locked into place.

The movable floor section allows the user to adjust the distance that the user is from the upright structure during the performance of a pulling and/or pushing exercise. The distance away that the user is from the upright structure may affect the angle at which the user pulls the cable which can affect the muscles targeted during the pull exercise. Thus, the user can adjust the floor section's location to target specific muscles and/or muscle groups. Further, some users may have different arm lengths and/or preferences that affect how far away the user is during the exercise. Thus, an adjustable floor section provides the user with an ability to make adjustments while still using the user's body weight to provide stability to the exercise machine when performing the exercise. In some alternative embodiments, the floor section is stationary with the respect to the rails and cannot move along the rails' length.

While the examples above have been described with reference to specific features of the standing platform and the locking mechanism of the standing platform, any appropriate features may be used to lock the floor section in place, move floor section along the rails' length, or to form the floor section in accordance with the principles described in the present disclosure.

The upright structure may include at least one arm assembly. In some embodiments, the upright structure includes a first arm assembly on a first side of the upright structure and a second arm assembly on a second side of the upright structure. Each of the arm assemblies may include an arm, a distal end of the arm, and a pulley connected to the distal end of the arm.

In some examples, the arm assembly also includes a proximal end of the arm and a proximal axle connected to the proximal end. The axle may be aligned in the direction of the standing platform's rails or another direction that is traverse the vertical orientation of the upright structure. The arms may be pivoted about the proximal axis so that the arms can change the position of the distal pulley with respect to the location of the user. For example, the arms can rotate so that the arms can extend away from the upright structure when the exercise machine is in the operational mode. Also, the arms may rotate downwards so that the arms are aligned with the vertical orientation of the upright structure in the storage mode.

In an example where the upright structure includes a first arm and a second arm on the first and second sides of the upright structure, at least one of the aims may form any appropriate angle between zero and 180 degrees with respect to the upright structure from the view of a user standing on the standing platform. In this example, the arm may rotate downward into the upright structure and be aligned with the upright structure at a zero degree angle or another small angle. The arm may be rotated outward to form a 45 degree angle, a 90 degree angle, or a 135 degree angle with the respect to the upright structure or any angle therein between. In another example, the arm may be rotated upward so that the arm is aligned with the upright structure, but positioned away from the upright structure. At each of these angles, the arms may be preset to lock into place. In another example, the arms can lock into place at any appropriate angle without a preset feature. In this type of example, the arm assembly may include a mechanism that applies a magnetic force, a compressive force, or another type of force that locks the arm into place.

In one example where the arm can be rotated into preset positions, the arm assembly includes a plate that is adjacent to the proximal end of the arm. Multiple locking openings are defined in the plate around the plate's circumference. The proximal end of the arm may include a pin opening defined therein. A retractable pin may reside in the pin opening and may be spring loaded to insert into one of the multiple locking openings of the plate.

In some cases, the arms in each of the first arm assembly and the second arm assembly are movable independently of each other. In an alternative embodiment, the upright structure includes a single arm that can rotate about a larger range that a 180 degrees. In such an example, the user can use a single arm to work out both of his or her arms from different sides of the exercise machine at different times. In examples where the exercise machine includes two arms on different sides of the upright structure, the user can work out both of his or her arms simultaneously.

The proximal end of the arm may also include a proximal pulley. In some examples, a channel is defined in the arm from the location of the proximal pulley to the distal pulley. The cable may include a section that resides in the channel.

The cable may have an end that is attached to a resistance mechanism. From the resistance mechanism, the cable may be directed by a group of pulleys to distribute the resistance mechanism's loads. At the proximal end of the arm, the proximal pulley can provide a fulcrum that changes the cable's direction into the channel. At the distal end of the arm, the distal pulley can provide a fulcrum that also changes the direction of the cable. The distal end of the cable may include a handle that the user can grasp during the performance of strength exercises. The distal pulley may include a swivel that allows the distal pulley's body to rotate in an additional degree of freedom and allows the user to pull the cable from different angles.

The handle may be any appropriate type of connector for allowing the user to grasp the end of the cable. In some examples, at least one of the handles includes a loop. The loop may be made of a metal, a rope, a strap, or another type of material. The handle may be a replaceable handle so that the user can change the type of grip or move the handle to a different one of the handle connectors.

The exercise machine may use any appropriate type of resistance mechanism to resist the axial movement along the cable's length as the user performs dynamic pulls or pushes during the performance of the exercise. In one example, the resistance mechanism may include a flywheel. The flywheel may be located in any appropriate location of the exercise machine. In one example, the flywheel is located underneath the standing platform. In another example, the flywheel is located in the upright structure. The pulleys may orient the direction of the cable at different points along the cable's length to direct the resistance load from the resistance mechanism's location to the cable's distal end.

The flywheel may be incorporated into a magnetic resistance mechanism that applies a load of resistance to the movement of the pull cable. The level of resistance applied by the magnetic resistance mechanism may be controlled electronically. For example, an electrical input into an electromagnetic unit may produce an output of resistance that can resist the forces exerted by the user through the cable. In other examples, the distance between a magnetic unit and the flywheel can be changed so that the amount of magnetic resistance on the flywheel changes. For example, as the magnetic unit is applying a consistent a magnetic flux to the flywheel and is moved away from the flywheel, the magnetic resistance felt by the flywheel is reduced. Conversely, as the magnetic unit is moved towards the flywheel, the magnetic resistance felt at the flywheel increases. The inputs or outputs of these and other types of adjustable resistance mechanisms can be tracked and stored. As the flywheel rotates, the sensor may track the rotation of the flywheel. In some embodiments, the sensor causes a counter to be incremented up one for each rotation of the flywheel. In other embodiments, the sensor can track partial revolutions of the flywheel.

In some cases, the amount of resistance is tracked. The amount of resistance can be determined by the position of the magnetic unit and it's the magnetic field strength. As changes to the field strength and/or the distance from the flywheel occur, the resistance level changes. Thus, the exercise machine may recognize the changes in the tracked resistance level when these parameters change. The tracked level of resistance can be sent to a calorie tracker to determine the amount of calories burned by the user. Also, a sensor that tracks the position of the flywheel can also send position information to the calorie tracker as an input. The calorie tracker can determine the amount of calories burned during each pull and/or collectively during the course of the entire workout based on the inputs about the flywheel's position and the resistance level experienced by the flywheel.

In some examples, a single flywheel resists the movement of multiple resistance cables. But, in other examples, the exercise machine uses a single cable and the flywheel resists just the movement of a single cable.

In some examples where a single flywheel is used to resist the movement of multiple cables, the flywheel can be attached to a central shaft with multiple spools coaxially mounted around the central shaft. The spools can contain attachments to at least one of the cables. As one of the pull cables is moved in a first direction, the spools are rotated in a first direction. The torque generated by rotating the spools is transferred to the flywheel, and the flywheel rotates in the first direction with the spools. But, when the pull cable is returned, the force that caused the spools to rotated in the first direction ceases. At least one return mechanism is connected to the flywheel that, in the absence of the force imposed on the pull cable, causes the spools to rotate back in the opposite direction to their original orientation before the pull cable force was imposed. But, the arrangement between the flywheel, shaft, and spools does not transfer the torque generated in the second direction to the flywheel.

Thus, in this example, the flywheel rotates in a single direction regardless of the direction that the pull cable is moving. Further, in this example, the flywheel is just rotating when a pull force is exerted by the user, thus the position of the flywheel represents just the work done as part of the workout. In other words, the return movement of the cable does not affect the calorie count. Further, the calorie counting calculations of the cable exercise machine are simplified because the sensor is insulated from at least the return forces that may skew the calorie counting calculations. Consequently, the tracked calories represents just those calories that are consumed during the course of the workout.

The flywheel may be constructed of multiple parts. For example, the flywheel may include a magnetically conductive rim. In other embodiments, the flywheel includes another type of magnetically conductive component that interacts with the magnetic flux imparted by the arm. As the magnetic flux increases, more energy is used to rotate the flywheel. Thus, a user must impart a greater amount of energy as he or she pulls on the pull cable to rotate the flywheel. As a result of the increased resistance, the user will consume more calories. Likewise, as the magnetic flux decreases, less energy is used to rotate the flywheel. Thus, a user can impart a lower amount of energy as he or she pulls on the pull cable to rotate the flywheel.

While this example has been described with specific reference to an arm producing a magnetic flux that pivots to and away from the flywheel to achieve a desired amount of resistance to the rotation of the flywheel, any appropriate mechanism for applying a resistance to the rotation of the flywheel may be used in accordance with the principles described herein. For example, the arm may remain at a fixed distance from the flywheel. In this example, the magnetic flux may be altered by providing a greater electrical input to achieve a greater magnetic output. Further, in lieu of pivoting the arm to and away from the flywheel, a magnetic unit may be moved towards or away from the flywheel with a linear actuator or another type of actuator.

The cable exercise machine may further includes a control panel which may be incorporated into the upright structure or some other convenient location. The control panel may include various input devices (e.g., buttons, switches or dials) and output devices (e.g., LED lights, displays, alarms). The control panel may further include connections for communication with other devices. These input devices may be used to instruct the flywheel assembly to change a level of magnetic resistance, track calories, set a timer, play music, play an audiovisual program, provide other forms of entertainment, execute a pre-programmed workout, perform another type of task, or combinations thereof. A display can indicate the feedback to the user about his or her performance, the resistance level at which the resistance mechanism is set, the number of calories consumed during the workout, other types of information, or combinations thereof.

While this example has been described with specific reference to the flywheel rotating in just a single direction, in other examples, the flywheel rotates in multiple directions. Further, while this example has been described with reference to a specific arrangement of cables and pulleys, these components of the cable exercise machine may be arranged in other configurations.

A sensor tracks the rotational position of the flywheel. As the flywheel rotates from the movement of the pull cables, the sensor can track the revolutions that the flywheel rotates. In some examples, the sensor may track half revolutions, quarter revolutions, other fractional revolutions, or combinations thereof.

The sensor may be any appropriate type of sensor that can determine the rotational position of the flywheel. Further, the sensor may determine the flywheel's position based on features incorporated into the flywheel body, the magnetically conductive rim, or the central shaft of the flywheel. For example, the sensor may be a mechanical rotary sensor, an optical rotary sensor, a magnetic rotary sensor, a capacitive rotary sensor, a geared multi-turn sensor, an incremental rotary sensor, another type of sensor, or combinations thereof. In some examples, a visual code may be depicted on the flywheel body, and the sensor may read the orientation of the visual code to determine the number of revolutions or partial revolutions. In other examples, the flywheel body includes at least one feature that is counted as the features rotate with the flywheel body. In some examples, a feature is a magnetic feature, a recess, a protrusion, an optical feature, another type of feature, or combinations thereof.

The sensor can feed the number of revolutions and/or partial revolutions to a processor as an input. The processor can also receive as an input the level of resistance that was applied to the flywheel when the revolutions occurred. As a result, the processor can cause the amount of energy or number of calories consumed to be determined. In some examples, other information, other than just the calorie count, is determined using the revolution count. For example, the processor may also determine the expected remaining life of the cable exercise machine based on use. The expected remaining life may be based, at least in part, on the number of flywheel revolutions. Further, the processor may also use the revolution count to track when maintenance should occur on the machine, and send a message to the user indicating that maintenance should be performed on the machine based on usage.

In some examples, the sensor is accompanied with an accelerometer. The combination of the inputs from the accelerometer and the sensor can at least aid the processor is determining the force exerted by the user during each pull. The processor may also track the force per pull, the average force over the course of the workout, the trends of force over the course of the workout, and so forth. For example, the processor may cause a graph of force per pull to be displayed to the user. In this type of graph, the amount of force exerted by the user at the beginning of the workout verses the end of the workout may be depicted. This information may be useful to the user and/or a trainer in customizing a workout for the user.

The number of calories per pull may be presented to the user in a display of the cable exercise machine. In some examples, the calories for an entire workout are tracked and presented to the user. In some examples, the calorie count is presented to the user through the display, through an audible mechanism, through a tactile mechanism, through another type of sensory mechanism, or combinations thereof.

What is claimed is:

1. An exercise machine, comprising:

a rail;

a standing platform including a floor section connected to the rail;

a pivot connection incorporated into the standing platform, wherein the pivot connection is located closer to a floor than the floor section of the standing platform;

an upright structure attached to the standing platform at the pivot connection, the upright structure having a bend;

a movable element connected to the upright structure where the movable element is movable during a performance of an exercise;

wherein the upright structure is rotated about the pivot connection in a transverse orientation to the standing platform when the exercise machine is in an operational mode and the upright structure is rotated about the pivot connection in an aligned orientation with the standing platform when the exercise machine is in a storage mode; and a locking mechanism incorporated into the floor section;

wherein the floor section is selectively movable along a length of the rail and selectively lockable into a stationary position with the rail with the locking mechanism.

2. The exercise machine of claim 1, wherein the upright structure includes an arm assembly.

3. The exercise machine of claim 2, wherein the arm assembly includes:

an arm;

an arm distal end of the arm; and a distal pulley connected to the arm distal end.

4. The exercise machine of claim 3, wherein the arm assembly further includes:

an arm proximal end of the arm;

a pin opening defined proximate the arm proximal end;

a retracted pin partially disposed within the pin opening;

a proximal axle connected to the arm proximal end; and a locking plate with multiple locking openings defined therein;

wherein the arm is pivotal about the proximal axle and lockable in an angular position that corresponds to one of the multiple locking openings.

5. The exercise machine of claim 1, wherein the exercise machine has a final folded height of 4 inches or less in the storage mode, measured tangentially from the floor to the top of the upright structure.

6. The exercise machine of claim 3, wherein the arm assembly includes an arm proximal end of the arm, and in the storage mode, the arm proximal end is adjacent to the standing platform and the arm distal end is adjacent to the pivot connection.

7. An exercise machine, comprising:

a standing platform, the standing platform including:

a rail;

a floor section connected to the rail; and a locking mechanism incorporated into the floor section;

wherein the floor section is selectively movable along a length of the rail and selectively lockable into a stationary position with the rail with the locking mechanism;

a pivot connection incorporated into the standing platform;

an upright structure attached to the standing platform at the pivot connection, the upright structure including a first beam on a first side of the rail and a second beam on a second side of the rail;

an arm assembly attached to the upright structure, the arm assembly including:

an arm;

an arm distal end of the arm; and a distal pulley connected to the arm distal end;

a cable connected to the arm assembly where the cable is movable during a performance of an exercise;

wherein the upright structure is rotated about the pivot connection in a transverse orientation to the standing platform when the exercise machine is in an operational mode and the upright structure is rotated about the pivot connection in an aligned orientation with the standing platform when the exercise machine is in a storage mode; and wherein the exercise machine has a final folded height of 6 inches or less in the storage mode, measured tangentially from the floor to the top of the upright structure.

8. The exercise machine of claim 7, wherein the arm assembly further includes:

an arm proximal end of the arm;

a pin opening defined proximate the arm proximal end;

a retracted pin partially disposed within the pin opening;

a proximal axle connected to the arm proximal end; and a locking plate with multiple locking openings defined therein;

wherein the arm is pivotal about the proximal axle and lockable in an angular position that corresponds to one of the multiple locking openings.

9. The exercise machine of claim 8, wherein the cable is directed with the distal pulley.

10. The exercise machine of claim 9, further including:

a cable distal end of the cable; and a handle attached to the cable distal end.

11. The exercise machine of claim 10, further including:

a resistance mechanism incorporated into the exercise machine; and a proximal end of the cable is attached to the resistance mechanism.

12. The exercise machine of claim 11, further including:

a proximal pulley located near the proximal end of the arm;

wherein the cable is directed with the proximal pulley and the distal pulley.

13. The exercise machine of claim 7, wherein the pivot connection includes an anti-rotation feature that interlocks the upright structure with the standing platform.

14. An exercise machine comprising:

a standing platform;

a pivot connection incorporated into the standing platform;

an upright structure attached to the standing platform at the pivot connection, the upright structure including an arm assembly, wherein the arm assembly includes:

an arm;

an arm distal end of the arm and an arm proximal end of the arm;

a distal pulley connected to the arm distal end; and a proximal pulley connected to the arm proximal end;

a platform pulley located at the standing platform; and a cable connected to the upright structure, wherein the cable is movable during a performance of an exercise and directed by the distal pulley, the proximal pulley, and the platform pulley, and wherein the upright structure is rotated about the pivot connection in a transverse orientation to the standing platform when the exercise machine is in an operational mode and the upright structure is rotated about the pivot connection in an aligned orientation with the standing platform when the exercise machine is in a storage mode.

15. The exercise machine of claim 14, further including:

a cable distal end of the cable; and a handle attached to the cable distal end.

16. The exercise machine of claim 14, further including:

a resistance mechanism incorporated into the exercise machine; and a proximal end of the cable is attached to the resistance mechanism.

17. The exercise machine of claim 14, further including:

a passage defined within a length of the arm;

wherein a section of the cable between the proximal pulley and the distal pulley resides within the passage.

18. The exercise machine of claim 16, wherein the resistance mechanism is located underneath the standing platform.

19. An exercise machine, comprising:

a standing platform;

a pivot connection incorporated into the standing platform, wherein the pivot connection is located closer to a floor than a floor section of the standing platform;

an upright structure attached to the standing platform at the pivot connection, the upright structure having a bend, wherein the upright structure includes an arm assembly;

a movable element connected to the upright structure where the movable element is movable during a performance of an exercise;

wherein the upright structure is rotated about the pivot connection in a transverse orientation to the standing platform when the exercise machine is in an operational mode and the upright structure is rotated about the pivot connection in an aligned orientation with the standing platform when the exercise machine is in a storage mode;

an arm;

an arm distal end of the arm;

a distal pulley connected to the arm distal end;

an arm proximal end of the arm;

a pin opening defined proximate the arm proximal end;

a retracted pin partially disposed within the pin opening;

a proximal axle connected to the arm proximal end; and a locking plate with multiple locking openings defined therein;

wherein the arm is pivotal about the proximal axle and lockable in an angular position that corresponds to one of the multiple locking openings.

* * * * *